US010923831B2

(12) United States Patent
Rogers

(10) Patent No.: US 10,923,831 B2
(45) Date of Patent: Feb. 16, 2021

(54) WAVEGUIDE-FED PLANAR ANTENNA ARRAY WITH ENHANCED CIRCULAR POLARIZATION

(71) Applicant: The Boeing Company, Chicago, IL (US)

(72) Inventor: John E. Rogers, Owens Cross Roads, AL (US)

(73) Assignee: THE BOEING COMPANY, Chicago, IL (US)

( * ) Notice: Subject to any disclaimer, the term of this patent is extended or adjusted under 35 U.S.C. 154(b) by 69 days.

(21) Appl. No.: 16/111,930

(22) Filed: Aug. 24, 2018

(65) Prior Publication Data

US 2020/0067201 A1 Feb. 27, 2020

(51) Int. Cl.
*H01Q 21/06* (2006.01)
*H01P 5/08* (2006.01)
(Continued)

(52) U.S. Cl.
CPC ..... *H01Q 21/065* (2013.01); *H01P 3/08* (2013.01); *H01P 3/12* (2013.01); *H01P 5/085* (2013.01);
(Continued)

(58) Field of Classification Search
CPC .. H01Q 21/065; H01Q 13/28; H01Q 21/0068; H01Q 21/005; H01P 3/08;
(Continued)

(56) References Cited

U.S. PATENT DOCUMENTS 2,677,766 A 5/1954 Litchford
3,404,405 A 10/1968 Young
(Continued)

FOREIGN PATENT DOCUMENTS

CN 105846051 A 8/2016
EP 2573872 A1 3/2013
(Continued)

OTHER PUBLICATIONS

Cheng, Yu Jian, et al., "W-band Large-Scale High-Gain Planar Integrated Antenna Array," IEEE Transactions on Antennas and Propagation, vol. 62, No. 6, Jun. 2014, pp. 3370-3373.
Grabherr, W. et al., "Microstrip to Waveguide Transition Compatible With mm-Wave Integrated Circuits," IEEE Transactions on Microwave Theory and Techniques, vol. 42, No. 9, Sep. 1994, pp. 1842-1843.
Iizuka, Hideo et al., "Millimeter-Wave Microstrip Line to Waveguide Transition Fabricated on a Single Layer Dielectric Substrate," R&D Review of Toyota Crdl, vol. 37, No. 2, Jun. 2002, pp. 13-18.
Iwasaki, H. "A circularly polarized small-size microstrip antenna with a cross slot," IEEE Transactions on Antennas and Propagation, Oct. 1996.
(Continued)

*Primary Examiner* — Dimary S Lopez Cruz
*Assistant Examiner* — Michael M Bouizza
(74) *Attorney, Agent, or Firm* — Moore IP Law

(57) ABSTRACT

A waveguide fed planar antenna array with enhanced circular polarization ("WFAECP") is disclosed. The WFAECP includes a plurality of dielectric layers forming a dielectric structure, an inner conductor formed within the dielectric structure, a first patch antenna element ("PAE"), a second PAE, a bottom and top conductor, a conductive via in signal communication with the bottom and top conductor, a first and second antenna slot within the first PAE and second PAE, and a waveguide. The dielectric layers includes top and bottom dielectric layers, where the top dielectric layer includes a top surface and the bottom dielectric layer includes a bottom surface. The first PAE is formed on the top surface of the top dielectric layer and the second PAE is formed on the bottom surface of the bottom dielectric layer. The waveguide includes a waveguide wall, backend, and cavity. The second PAE is located within the waveguide cavity.

20 Claims, 47 Drawing Sheets

(51) Int. Cl.
*H01P 11/00* (2006.01)
*H01P 3/12* (2006.01)
*H01P 3/08* (2006.01)

(52) U.S. Cl.
CPC ..... *H01P 11/002* (2013.01); *H01P 11/003* (2013.01)

(58) Field of Classification Search
CPC ..... H01P 11/003; H01P 3/12; H01P 11/002; H01P 5/085; H01P 5/107; H01P 3/121
See application file for complete search history.

(56) References Cited

U.S. PATENT DOCUMENTS 3,665,480 A 5/1972 Fassett
3,696,433 A 10/1972 Killion et al.
3,729,740 A 4/1973 Nakahara et al.
4,197,545 A 4/1980 Favaloro et al.
4,232,321 A 11/1980 Ohm
4,313,120 A 1/1982 Westerman
4,835,538 A 5/1989 McKenna et al.
4,862,185 A 8/1989 Andrews et al.
5,043,738 A 8/1991 Shapiro et al.
5,218,322 A 6/1993 Allison et al.
5,353,035 A 10/1994 Cuervo-Arango et al.
5,421,848 A 6/1995 Maier et al.
5,473,336 A 12/1995 Harman et al.
5,581,267 A 12/1996 Matsui et al.
5,726,666 A 3/1998 Hoover et al.
5,914,693 A 6/1999 Takei et al.
5,977,710 A 11/1999 Kuramoto et al.
5,977,924 A 11/1999 Takei et al.
5,982,256 A 11/1999 Uchimura et al.
6,005,520 A 12/1999 Nalbandian et al.
6,198,453 B1 3/2001 Chew
6,252,549 B1 6/2001 Derneryd
6,285,325 B1 9/2001 Nalbandian et al.
6,593,887 B2 7/2003 Luk et al.
6,646,609 B2 11/2003 Yuasa et al.
6,664,931 B1 12/2003 Nguyen et al.
7,385,462 B1 6/2008 Epp et al.
7,471,248 B2 12/2008 Popugaev et al.
7,471,258 B2 12/2008 Hsu et al.
8,197,473 B2 6/2012 Rossetto et al.
8,384,499 B2 2/2013 Suzuki et al.
8,665,142 B2 3/2014 Shijo et al.
8,860,532 B2 * 10/2014 Gong ..... H01P 1/208 333/202
9,437,184 B1 9/2016 Swett
9,496,613 B2 11/2016 Sawa
9,979,459 B2 5/2018 Savage et al.
10,283,832 B1 * 5/2019 Chayat ..... H01Q 13/18
10,291,312 B2 5/2019 Savage et al.
10,522,916 B2 12/2019 Rogers et al.
10,777,905 B2 9/2020 Diehl et al.
2002/0047803 A1 4/2002 Ishitobi et al.
2003/0006941 A1 1/2003 Ebling et al.
2003/0043086 A1 3/2003 Schaffner et al.
2003/0103006 A1 6/2003 Yamada
2004/0104852 A1 6/2004 Choi et al.
2004/0196203 A1 10/2004 Lier et al.
2006/0001574 A1 1/2006 Petros
2006/0044188 A1 3/2006 Tsai et al.
2006/0098272 A1 5/2006 Lerner et al.
2007/0216596 A1 9/2007 Lewis et al.
2007/0279143 A1 12/2007 Itsuji
2008/0136553 A1 6/2008 Choi et al.
2008/0252544 A1 10/2008 Irion et al.
2009/0046029 A1 2/2009 Nagai
2009/0289858 A1 11/2009 Olsson
2010/0001916 A1 1/2010 Yamaguchi et al.
2010/0181379 A1 7/2010 Okegawa et al.
2010/0245155 A1 9/2010 Miyazato et al.
2011/0062234 A1 3/2011 Oishi
2011/0090129 A1 4/2011 Weily et al.
2011/0165839 A1 7/2011 Kawamura et al.
2012/0276856 A1 11/2012 Joshi et al.
2012/0287019 A1 11/2012 Sudo et al.
2012/0299783 A1 11/2012 Lee et al.
2013/0063310 A1 3/2013 Mak et al.
2013/0258490 A1 10/2013 Ishihara
2013/0278467 A1 10/2013 Dassano et al.
2014/0110841 A1 4/2014 Beer et al.
2014/0168014 A1 6/2014 Chih et al.
2014/0354411 A1 12/2014 Pudenz
2015/0249283 A1 9/2015 Watanabe et al.
2015/0364823 A1 12/2015 Hashimoto et al.
2016/0056541 A1 * 2/2016 Tageman ..... H01Q 13/18 343/771
2016/0056544 A1 2/2016 Garcia et al.
2016/0126617 A1 5/2016 Jan et al.
2016/0126637 A1 5/2016 Uemichi
2016/0190696 A1 6/2016 Preradovic et al.
2016/0190697 A1 6/2016 Preradovic et al.
2016/0218420 A1 7/2016 Leung et al.
2016/0261036 A1 9/2016 Sato et al.
2016/0294045 A1 10/2016 Shiu et al.
2016/0295335 A1 10/2016 Vajha et al.
2016/0322703 A1 11/2016 Jesme et al.
2017/0084971 A1 * 3/2017 Kildal ..... H01P 1/2005
2017/0133756 A1 * 5/2017 Eastburg ..... H01Q 21/061
2019/0067805 A1 2/2019 Rogers et al.
2019/0086581 A1 3/2019 Diehl et al.
2019/0237844 A1 8/2019 Rogers et al.
2019/0237876 A1 8/2019 Rogers et al.
2020/0067165 A1 2/2020 Rogers
2020/0067201 A1 2/2020 Rogers

FOREIGN PATENT DOCUMENTS

EP 2750246 A1 7/2014
EP 3012916 A1 4/2016
JP 2003283239 A 10/2003
KR 100449846 B1 9/2004
WO 20150102938 7/2015

OTHER PUBLICATIONS

Kaneda, Noriaki et al., "A Broad-band Microstrip-to-Waveguide Transition Using Quasi-Yagi Antenna," IEEE Transactions on Microwave Theory and Techniques, Dec. 1999, pp. 1-4.
Li, B. et al., "Study on High Gain Circular Waveguide Array Antenna with Metamaterial Structure," Progress in Electromagnetics Research (PIER), vol. 6, 2006, pp. 207-219.
Lin, Ting-Huei et al., "CPW to Waveguide Transition with Tapered Slotline Probe," IEEE Microwave and Wireless Components Letters, vol. 11, No. 7, Jul. 2001, pp. 314-316.
Menzel, W. et al. "A microstrip patch antenna with coplanar feed line," IEEE Microwave and Guided Wave Letters, Nov. 1991.
Ponchak, George E et al., "A New Rectangular Waveguide to Coplanar Waveguide Transition," IEEE MTT-S International Microwave Symposium, May. 1990, 4 pgs.
Rida, Amin et al., "Proximity Coupled Fed Antenna Arrays on LCP for mm-Wave Applications," IEEE Antennas and Propagation Society International Symposium, Jul. 2010, 4 pgs.
Simon, W. et al., "A Novel Coplanar Transmission Line to Rectangular Waveguide Transition," IEEE MTT-S Digest, Jun. 1998, pp. 257-260.
Targonski, S.D. et al., "Design of wideband circularly polarized aperture-coupled microstrip antennas," IEEE Transactions on Antennas and Propagation, Feb. 1993.
Wang, C., et al., "A novel CP patch antenna with a single feed structure," IEEE Antennas and Propagation Society International Symposium, Jul. 2000.
Wang, J., et al., "Multifunctional aperture coupled stack patch antenna," Electronics Letters, Dec. 1990.
Zhang, Guo-Hua, et al. "A Circular Waveguide Antenna Using High-Impedance Ground Plane," IEEE Antennas and Wireless Propagation Letters, vol. 2, 2003, pp. 86-88.

(56) References Cited

OTHER PUBLICATIONS

Zurcher, J.F., "The SSFIP: A global concept for high-performance broadband patch antennas," Electronics Letters, Nov. 1988.
Abu Tarboush, H. F. et al., "Bandwidth Enhancement for Microstrip Patch Antenna Using Stacked Patch and Slot", 2009 IEEE International Workshop on Antenna Technology, Mar. 2-4, 2009, 4 pgs.
Allen, J. W., et al., "Design and fabrication of an RF GRIN lens 3D printing technology", Proc. Of SPIE, vol. 8624, Feb. 20, 2013, 8 pgs.
Ambresh P. A., et al., "Effect of Slots on Microstrip Patch Antenna Characteristics", International Conference on Computer, Communication and Electrical Technology—ICCCET2011, Mar. 18th & 19th, 2011, pp. 239-241.
Cook, Benjamin S. et al. "Multilayer Inkjet Printing of Millimeter-Wave Proximity-Fed Patch Arrays on Flexible Substrates", IEEE Antennas and Wireless Propagation Letters, vol. 12, 2013, pp. 1351-1354.
Davidowitz, Marat et al., "Rigorous Analysis of a Circular Patch Antenna Excited by a Microstrip Transmission Line", IEEE Transactions on Antennas and Propagation, vol. 37, No. 8, Aug. 1989, pp. 949-958.
Delgado, Guillermo et al., "Scanning Properties of Teflon Lenses," Microwave and Optical Technology Letters, vol. 11, No. 5, Apr. 5, 1996, pp. 271-273.
European Patent Office Extended Search Report, Application No. 17175267.8-1927, dated Oct. 19, 2017.
Extended European Search Report for Application No. 18189791.9 dated Feb. 18, 2019, 8 pgs.
Gauthier, Gildas P. et al., "A 94-GHz Aperture-Coupled Micromachined Microstrip Antenna," IEEE Transactions on Antennas and Propagation, vol. 47, No. 12, Dec. 1999, pp. 1761-1766.
Iwaski, Hisao, "A Circularly Polarized Small-Size Microstrip Antenna with a Cross Slot", IEEE Transactions on Antennas and Propagation, vol. 44, No. 10, Oct. 1996, pp. 1399-1401.
Jackson, D.R., Caloz, C., et al., "Leaky-wave antennas," Proceedings of the IEEE, Jul. 2012.
Jain, Sidharath, et al., "Flat-Base Broadband Multibeam Luneburg Lens for Wide Angle Scan," Cornell University, May 4, 2013, arXiv.org > physics > arXiv:1305.0964.
Kim, D.H., Eom, H.J., "Radiation of a leaky coaxial cable with narrow traverse slots," IEEE Transactions on Antennas and Propagation, Jan. 2007, pp. 107-110.
Papapolymerou, Ioannis et al., "Micromachined Patch Antennas," IEEE Transactions on Antennas and Propagation, vol. 46, No. 2, Feb. 1998, pp. 275-283.
Pozar, D.M. et al., "Increasing the Bandwidth of a Microstrip Antenna by Proximity Coupling", Electronics Letters Apr. 9, 1987 vol. 23 No. 8, pp. 368-369.
Pozar, D.M., "Microstrip Antenna Aperture Coupled to a Microstripline", Electronics Letters Jan. 17, 1985 vol. 21 No. 2, pp. 49-50.
Pozar, David M. et al., "A Rigorous Analysis of a Microstripline Fed Patch Antenna", IEEE Transactions on Antennas and Propagation, vol. AP-35, No. 12, Dec. 1987, pp. 1343-1350.
Rida, Amin et al., "Proximity Coupled Fed Antenna Arrays on LCP with mm-Wave Applications," IEEE 2010, 4 pgs.
Satoshi, Y., Tahara, Y., et al., "Inclined slot array antennas on a rectangular coaxial line," Proceedings of the 5th European Conference on Antennas and Propagation, 2011.
Schoenlinner, Bernhard, "Compact Wide Scan-Angle Antennas for Automotive Applications and RF MEMS Switchable Frequency-Selective Surfaces," A dissertation submitted in partial fulfillment of the requirements for the degree of Doctor of Philosophy, The University of Michigan, 2004, 72 pgs.
Schoenlinner, Bernhard, "Wide-Scan Spherical-Lens Antennas for Automotive Radars," IEEE Transactions on Microwave theory and Techniquest, vol. 50, No. 9, Sep. 2002, pp. 2166-2175.
Sorkherizi, Milad S. et al., "Planar High-efficiency Antenna Array Using New Printed Ridge Gap Waveguide Technology," IEEE Transactions on Antennas and Propogation, vol. 65, No. 7, Jul. 2017, pp. 3772-3776.
Tribe, J. et al., "Additively manufactured hetrogeneous substrates for three-dimensional control of permittivity," Electronics Letters, May 8, 2014, vol. 50, No. 10, pp. 745-746.
Zhang, S. et al., "3D-printed flat lens for microwave applications," presented at the Antennas and Propagation Conference (LAPC2015) Loughborough University, 4 pgs.

* cited by examiner

WAVEGUIDE-FED PLANAR ANTENNA ARRAY WITH ENHANCED CIRCULAR POLARIZATION

CROSS-REFERENCE TO RELATED APPLICATIONS

This application is related to U.S. patent application Ser. No. 16/111,830, entitled "APERTURE-COUPLED MICROSTRIP-TO-WAVEGUIDE TRANSITIONS," filed on Aug. 24, 2018, to inventor John E. Rogers, and U.S. patent application Ser. No. 16/111,778, entitled "CONFORMAL ANTENNA WITH ENHANCED CIRCULAR POLARIZATION," filed on Aug. 24, 2018, to inventor John E. Rogers, both of which applications are incorporated by reference herein in their entireties.

BACKGROUND

1. Field

The present disclosure is related to planar antenna arrays, and more specifically, to waveguide fed planar antenna arrays.

2. Related Art

At present, planar antenna arrays are typically fed by a microstrip or stripline feed that is connected to some coaxial adapter that enables signal transmission and reception. For high frequencies, such as millimeter-wave frequencies, waveguides are preferred over coaxial cables for signal transmission and reception due to the inherent low-loss of waveguides. As such, waveguides are used in many RF applications for low-loss signal propagation; however, they are generally not compatible with RF electronics.

Known approaches to adapt a waveguide to a planar antenna array utilize both a coaxial adapter and a coax-to-waveguide adapter. These approaches utilize waveguide-to-coax adapters for first transitioning from a waveguide to the electronics-compatible coax cable and then utilize a coax-to-RF board adapter. Unfortunately, existing waveguide-to-coax adapters do not mate well with RF boards because they are typically bulky devices that include waveguide tubing, flanges and a combination of a coaxial probe assembly with coaxial adapter and connection hardware to connect the coaxial adapter to the RF board. Moreover, existing coaxial and coax-to-waveguide adapters can be cost prohibitive at millimeter-wave frequencies as well as increase the overall size and weight of the antenna.

As such, there is a need for a waveguide fed planar antenna array that addresses one or more of these issues.

SUMMARY

Disclosed is a waveguide fed planar antenna array with enhanced circular polarization ("WFAECP"). The WFAECP includes a plurality of dielectric layers forming a dielectric structure, an inner conductor formed within the dielectric structure, a first patch antenna element ("PAE"), a second PAE, a bottom conductor, a top conductor, a conductive via in signal communication with the bottom conductor and the top conductor, a first antenna slot within the first PAE, a second antenna slot within the second PAE, and a waveguide. The plurality of dielectric layers includes a top dielectric layer and a bottom dielectric layer, where the top dielectric layer includes a top surface and the bottom dielectric layer includes a bottom surface. The first PAE is formed on the top surface of the top dielectric layer and the second PAE is formed on the bottom surface of the bottom dielectric layer. The waveguide includes at least one waveguide wall and a waveguide backend. The waveguide backend has a waveguide backend surface that is a portion of the bottom surface of the bottom dielectric layer and the waveguide backend surface and the at least one waveguide wall form a waveguide cavity within the waveguide. The second PAE is located within the waveguide cavity at the waveguide backend surface, and the first PAE and second PAE are conductors. The WFAECP is configured to support a transverse electromagnetic ("TEM") signal within the dielectric structure.

Also disclosed is a method for fabricating the WFAECP utilizing a lamination process. The method includes patterning a first conductive layer on a bottom surface of a first dielectric layer, where the first conductive layer includes a first portion and a second portion. Patterning the first portion of the first conductive layer produces a second PAE with an antenna slot and patterning the second portion of the first conductive layer produces a bottom conductor. The first dielectric layer includes a top surface. The method then patterns a second conductive layer on a portion of a top surface of a second dielectric layer to produce an inner conductor, where the second dielectric layer includes a bottom surface and the second conductive layer includes a top surface. The method then laminates the bottom surface of the second dielectric layer to the top surface of the first dielectric layer and patterns a third conductive layer on a top surface of a third dielectric layer to produce a CE. The third dielectric layer includes a bottom surface. The method then patterns a fourth conductive layer on a top surface of a fourth dielectric layer, where the fourth conductive layer includes a first portion and a second portion. Patterning the first portion of the fourth conductive layer produces a first PAE with an antenna slot and patterning the second portion of the first conductive layer produces a top conductor. The method then laminates a bottom surface of the fourth dielectric layer to the top surface of the third conductive layer and the top surface of the third dielectric layer, and laminates a bottom surface of the third dielectric layer to the top surface of the second conductive layer and the top surface of the second dielectric layer. The method then produces at least one conductive via between the second portion of the fourth conductive layer and the second portion of the first conductive layer and attaches a waveguide to the bottom surface of a first dielectric layer, wherein the second PAE is located within a cavity of the waveguide.

Moreover, another method for fabricating the WFAECP is also disclosed utilizing a three-dimensional ("3-D") additive printing process. The method includes printing a first dielectric layer having a top surface, bottom surface, and a first width and printing a first conductive layer on the bottom surface of the first dielectric layer. The first conductive layer includes a first portion and a second portion, where printing the first portion of the first conductive layer produces a second PAE with an antenna slot, and printing the second portion of the first conductive layer produces a bottom conductor. The method also includes printing a second dielectric layer on the top surface of the first dielectric layer, where the second dielectric layer includes a top surface, and printing a second conductive layer on a portion of the top surface of the second dielectric layer, where the second conductive layer has a top surface, and printing a third dielectric layer on the top surface of the second dielectric layer and the top surface of the second conductive layer, where the third dielectric layer has a top surface. Moreover, the method also includes printing a third conductive layer on a portion of the top surface of the third dielectric layer, wherein the third conductive layer has a top surface, printing a fourth dielectric layer on the top surface of the third dielectric layer and the top surface of the third conductive layer, where the fourth dielectric layer has a top surface, and printing a fourth conductive layer on the top surface of the fourth dielectric layer. The fourth conductive layer includes a first portion and a second portion, where printing the first portion of the fourth conductive layer produces a first PAE with an antenna slot and printing the second portion of the fourth conductive layer produces a top conductor. The method further includes producing at least one conductive via between the second portion of the fourth conductive layer and the second portion of the first conductive layer and attaching a waveguide to the bottom surface of a first dielectric layer, where the second PAE is located within a cavity of the waveguide.

Other devices, apparatuses, systems, methods, features, and advantages of the invention will be or will become apparent to one with skill in the art upon examination of the following figures and detailed description. It is intended that all such additional devices, apparatuses, systems, methods, features, and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
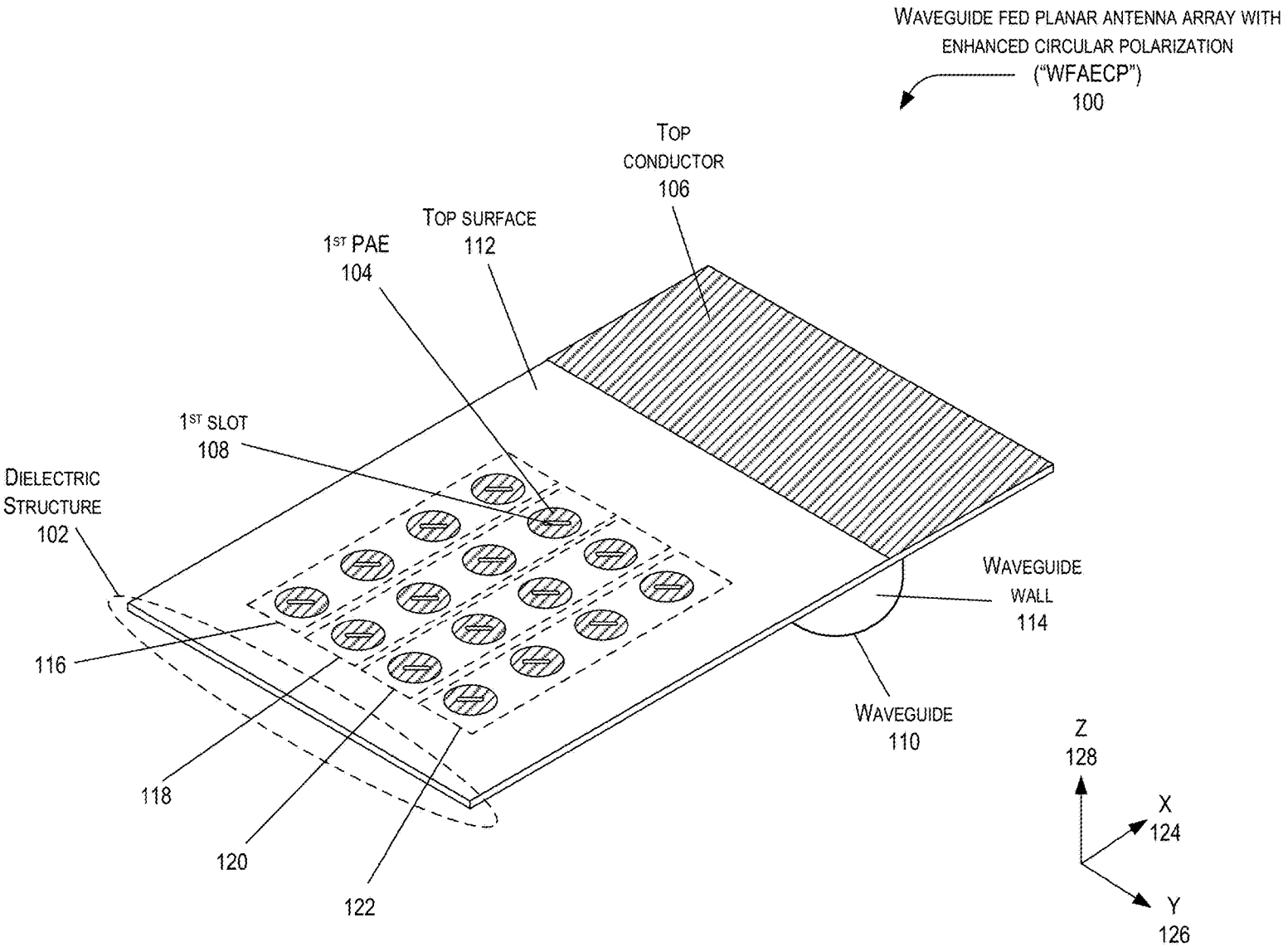
FIG. 1 is a perspective top view of an example of an implementation of a waveguide fed planar antenna array with enhanced circular polarization ("WFAECP") in accordance with the present disclosure.

A waveguide fed planar antenna array with enhanced circular polarization ("WFAECP") is disclosed. The WFAECP includes a plurality of dielectric layers forming a dielectric structure, an inner conductor formed within the dielectric structure, a first patch antenna element ("PAE"), a second PAE, a bottom conductor, a top conductor, a conductive via in signal communication with the bottom conductor and the top conductor, a first antenna slot within the first PAE, a second antenna slot within the second PAE, and a waveguide. The plurality of dielectric layers includes a top dielectric layer and a bottom dielectric layer, where the top dielectric layer includes a top surface and the bottom dielectric layer includes a bottom surface. The first PAE is formed on the top surface of the top dielectric layer and the second PAE is formed on the bottom surface of the bottom dielectric layer. The waveguide includes at least one waveguide wall and a waveguide backend. The waveguide backend has a waveguide backend surface that is a portion of the bottom surface of the bottom dielectric layer and the waveguide backend surface and the at least one waveguide wall form a waveguide cavity within the waveguide. The second PAE is located within the waveguide cavity at the waveguide backend surface, and the first PAE and second PAE are conductors. The WFAECP is configured to support a transverse electromagnetic ("TEM") signal within the dielectric structure.

Also disclosed is a method for fabricating the WFAECP utilizing a lamination process. The method includes patterning a first conductive layer on a bottom surface of a first dielectric layer, where the first conductive layer includes a first portion and a second portion. Patterning the first portion of the first conductive layer produces a second PAE with an antenna slot and patterning the second portion of the first conductive layer produces a bottom conductor. The first dielectric layer includes a top surface. The method then patterns a second conductive layer on a portion of a top surface of a second dielectric layer to produce an inner conductor, where the second dielectric layer includes a bottom surface and the second conductive layer includes a top surface. The method then laminates the bottom surface of the second dielectric layer to the top surface of the first dielectric layer and patterns a third conductive layer on a top surface of a third dielectric layer to produce a CE. The third dielectric layer includes a bottom surface. The method then patterns a fourth conductive layer on a top surface of a fourth dielectric layer, where the fourth conductive layer includes a first portion and a second portion. Patterning the first portion of the fourth conductive layer produces a first PAE with an antenna slot and patterning the second portion of the first conductive layer produces a top conductor. The method then laminates a bottom surface of the fourth dielectric layer to the top surface of the third conductive layer and the top surface of the third dielectric layer and laminates a bottom surface of the third dielectric layer to the top surface of the second conductive layer and the top surface of the second dielectric layer. The method then produces at least one conductive via between the second portion of the fourth conductive layer and the second portion of the first conductive layer and attaches a waveguide to the bottom surface of a first dielectric layer, wherein the second PAE is located within a cavity of the waveguide.

Moreover, another method for fabricating the WFAECP is also disclosed utilizing a three-dimensional ("3-D") additive printing process. The method includes printing a first dielectric layer having a top surface, bottom surface, and a first width and printing a first conductive layer on the bottom surface of the first dielectric layer. The first conductive layer includes a first portion and a second portion, where printing the first portion of the first conductive layer produces a second PAE with an antenna slot, and printing the second portion of the first conductive layer produces a bottom conductor. The method also includes printing a second dielectric layer on the top surface of the first dielectric layer, where the second dielectric layer includes a top surface, and printing a second conductive layer on a portion of the top surface of the second dielectric layer, where the second conductive layer has a top surface, and printing a third dielectric layer on the top surface of the second dielectric layer and the top surface of the second conductive layer, where the third dielectric layer has a top surface. Moreover, the method also includes printing a third conductive layer on a portion of the top surface of the third dielectric layer, wherein the third conductive layer has a top surface, printing a fourth dielectric layer on the top surface of the third dielectric layer and the top surface of the third conductive layer, where the fourth dielectric layer has a top surface, and printing a fourth conductive layer on the top surface of the fourth dielectric layer. The fourth conductive layer includes a first portion and a second portion, where printing the first portion of the fourth conductive layer produces a first PAE with an antenna slot and printing the second portion of the fourth conductive layer produces a top conductor. The method further includes producing at least one conductive via between the second portion of the fourth conductive layer and the second portion of the first conductive layer and attaching a waveguide to the bottom surface of a first dielectric layer, where the second PAE is located within a cavity of the waveguide.

In FIG. 1, a perspective top view of an example of an implementation of a WFAECP 100 is shown in accordance with the present disclosure. The WFAECP 100 includes a plurality of dielectric layers (not shown) forming a dielectric structure 102, an inner conductor (not shown) formed within the dielectric structure (not shown), a first patch antenna element ("PAE") 104, a second PAE (not shown), a bottom conductor (not shown), a top conductor 106, a conductive via (not shown) in signal communication with the bottom conductor and the top conductor 106, a first antenna slot 108 within the first PAE 104, a second antenna slot (not shown) within the second PAE, and a waveguide 110. In this example, the plurality of dielectric layers includes a top dielectric layer (not shown) and a bottom dielectric layer (not shown), where the top dielectric layer includes a top surface 112 and the bottom dielectric layer includes a bottom surface (not shown). The first PAE 104 is formed on the top surface 112 of the top dielectric layer and the second PAE is formed on the bottom surface of the bottom dielectric layer. The waveguide 110 includes at least one waveguide wall 114 and a waveguide backend (not shown). The waveguide backend has a waveguide backend surface (not shown) that is a portion (not shown) of the bottom surface of the bottom dielectric layer and the waveguide backend surface and the at least one waveguide wall 114 form a waveguide cavity (not shown) within the waveguide 110. The second PAE is located within the waveguide cavity at the waveguide backend surface and the first PAE 104 and second PAE are conductors.

As an example, the WFAECP 100 is shown to be a 4×4 planar antenna array having 16 PAEs (including the first PAE 104) arranged into four (4) columns 116, 118, 120, and 122 of PAEs having four (4) PAEs each. It is appreciated by those of ordinary skill in the art that 16 PAEs are shown only as an example and the WFAECP 100 may optionally include any number of PAEs from a signal PAE (i.e., PAE 104) to any number of PAE based on the design of the WFAECP 100. In this example, the PAEs of each of the four columns 116, 118, 120, and 122 of PAEs extend out in a direction along an X-axis 124 and the four columns are located in adjacent positions to each other along a direction along a Y-axis 126. The waveguide 110 extends out from the WFAECP 100 in a negative direction along a Z-axis 128.

Figure 2:
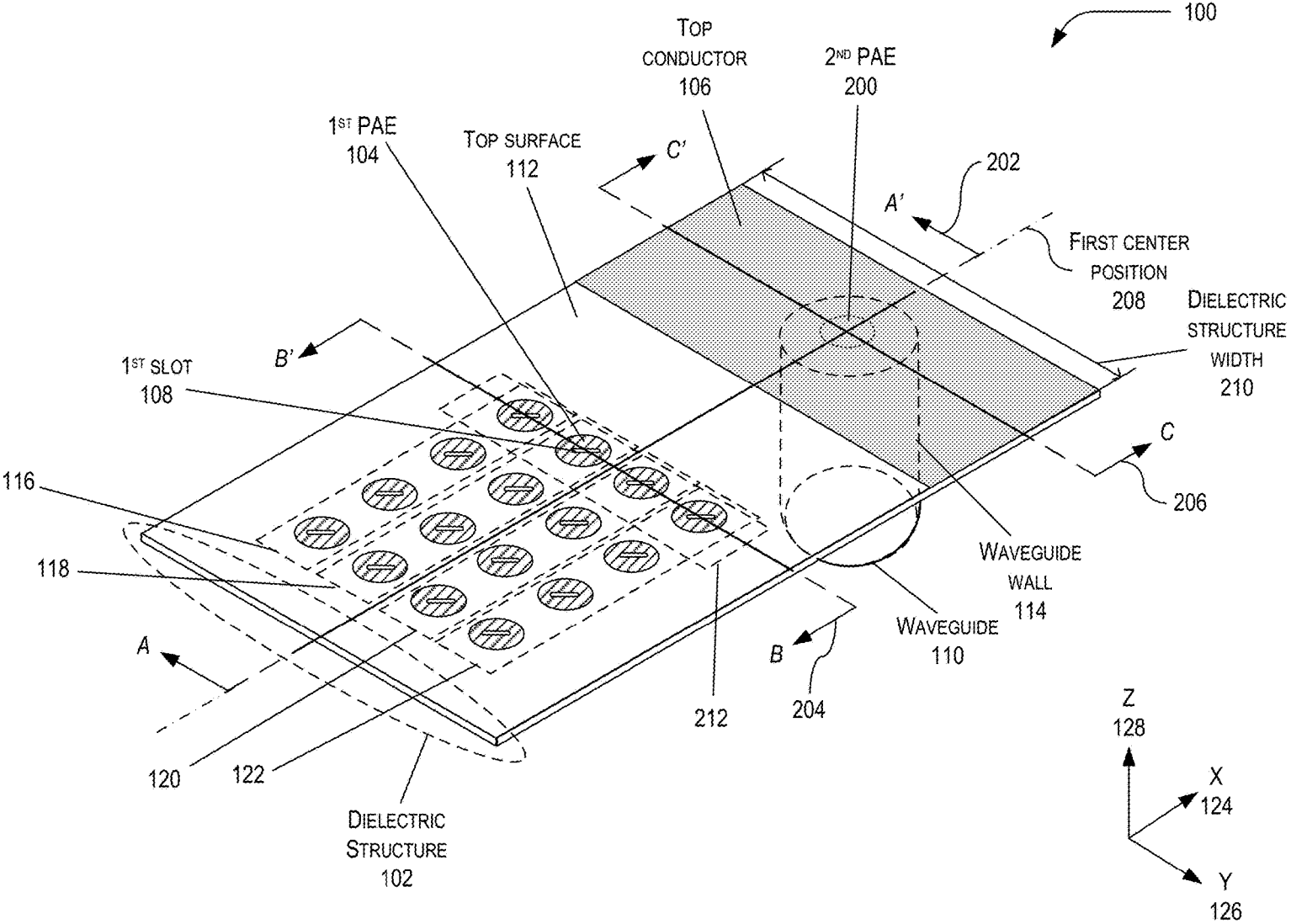
FIG. 2 is another perspective top view of the implementation of the WFAECP (shown in FIG. 1) in accordance with the present disclosure.

In FIG. 2, another perspective top view of the implementation of the WFAECP 100 is shown in accordance with the present disclosure. In this view, an outline of the waveguide 110 and second PAE 200 are shown. Moreover, in this view, a first cutting plane A-A' 202, a second cutting plane B-B' 204, a third cutting plane C-C' 206 are shown. In this example, the first cutting plane A-A' 202 cuts through a first center position 208 of the WFAECP 100 that also cuts through the approximate center of the second PAE 200 and looks into the WFAECP 100 in a negative direction along the Y-axis 126. The first center position 208 is located at position that is equal to approximately half of a dielectric structure width 210 of the dielectric structure 102 along the Y-axis 126. The second cutting plane B-B' 204 is orthogonal to the first cutting plane A-A' 202 and cuts through a row 212 of PAEs that includes one PAE from each of the four columns 116, 118, 120, and 122 of PAEs, where the row 212 of PAEs extends along the Y-axis 126. The second cutting plane B-B' 204 looks into the WFAECP 100 in a negative direction along the X-axis 124. The third cutting plane C-C' 206 is orthogonal to the first cutting plane A-A' 202 and cuts through the second PAE 200. The third cutting plane C-C' 206 looks into the WFAECP 100 in a direction along the X-axis 124.

Figure 3:
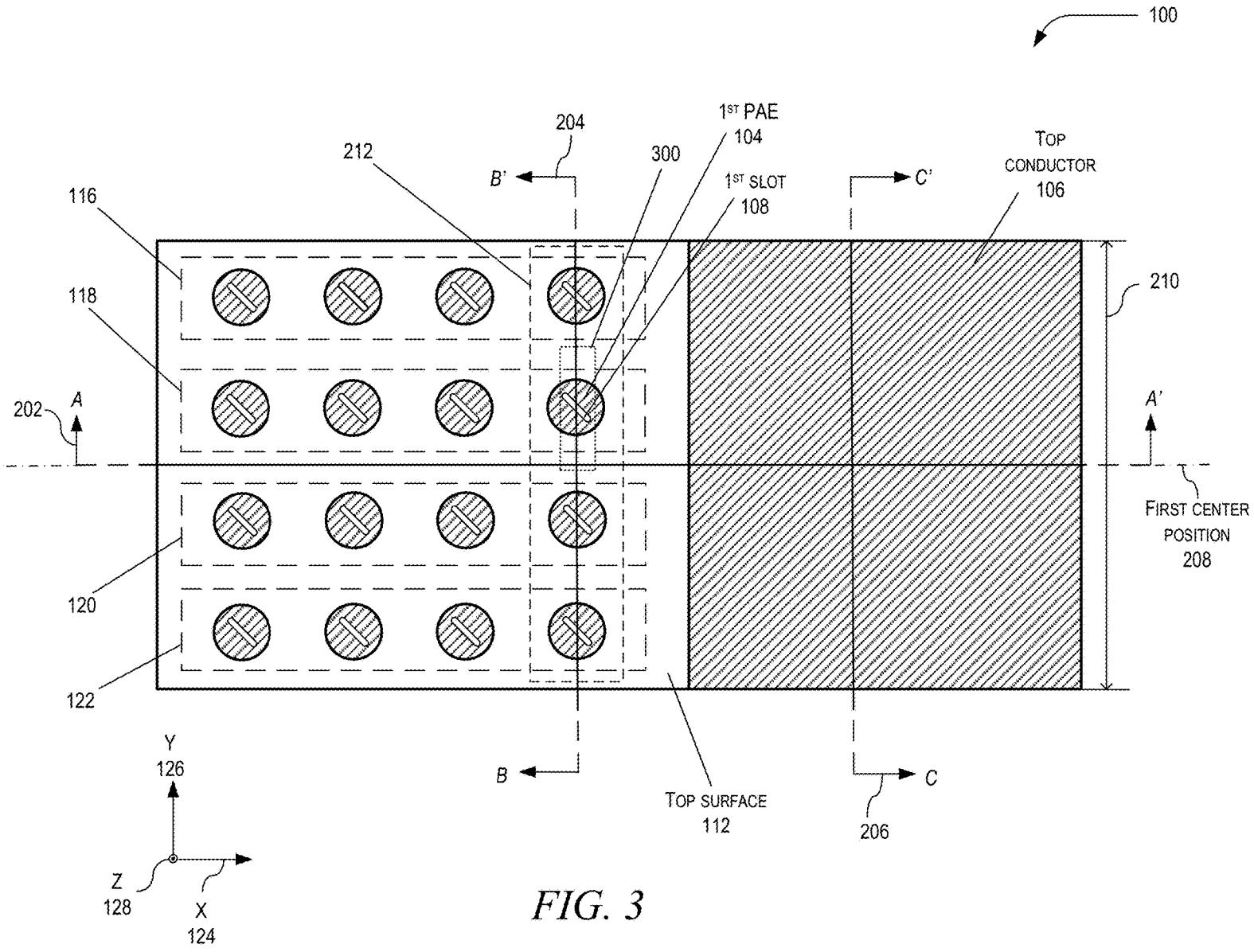
FIG. 3 is a top view of the WFAECP (shown in FIGS. 1 and 2) in accordance with the present disclosure.

In FIG. 3, a top view of the WFAECP 100 is shown in accordance with the present disclosure. In this view, an expanded sectional view 300 of the first PAE 104 is shown along the second cutting plane B-B' 204.

Figure 4:
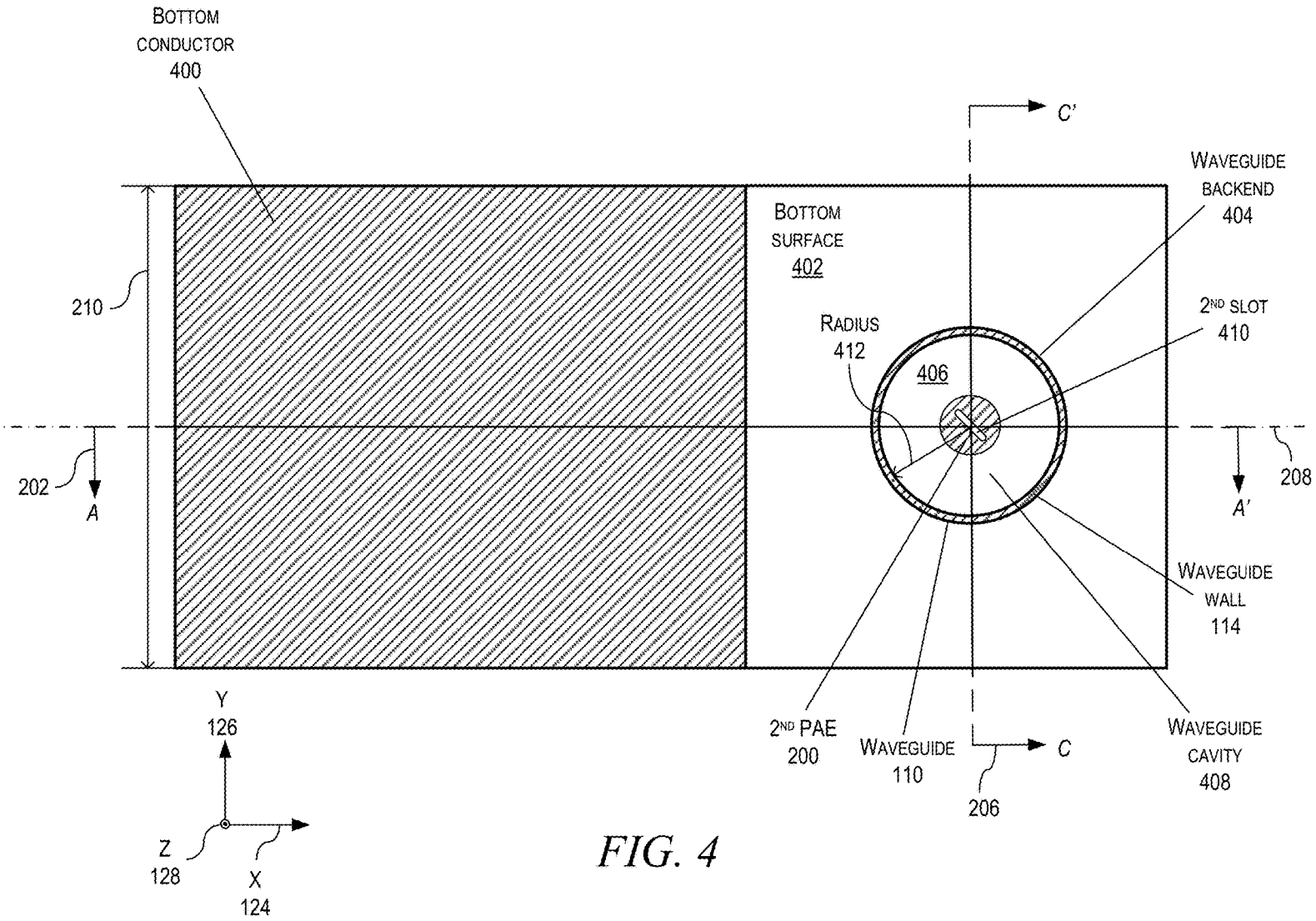
FIG. 4 is a bottom view of the WFAECP (shown in FIGS. 1-3) in accordance with the present disclosure.

In FIG. 4, a bottom view of the WFAECP 100 is shown in accordance with the present disclosure. In this view, the bottom conductor 400, bottom surface 402 of the bottom dielectric layer of the plurality of dielectric layers, waveguide backend 404, waveguide backend surface 406, waveguide cavity 408, second PAE 200, and the second antenna slot 410 within the second PAE 200. The waveguide backend surface 406 is a portion of the bottom surface 402 of the bottom dielectric layer. The waveguide backend surface 406 and the waveguide wall 114 form the waveguide cavity 408 within the waveguide 110. The second PAE 200 is located within the waveguide cavity 408 at the waveguide backend surface 406. In this example, the waveguide 110 is shown to be generally an elliptical waveguide that for purposes of simplicity of illustration is shown to be a circular waveguide. The waveguide 110 has a waveguide radius 412.

Figure 5:
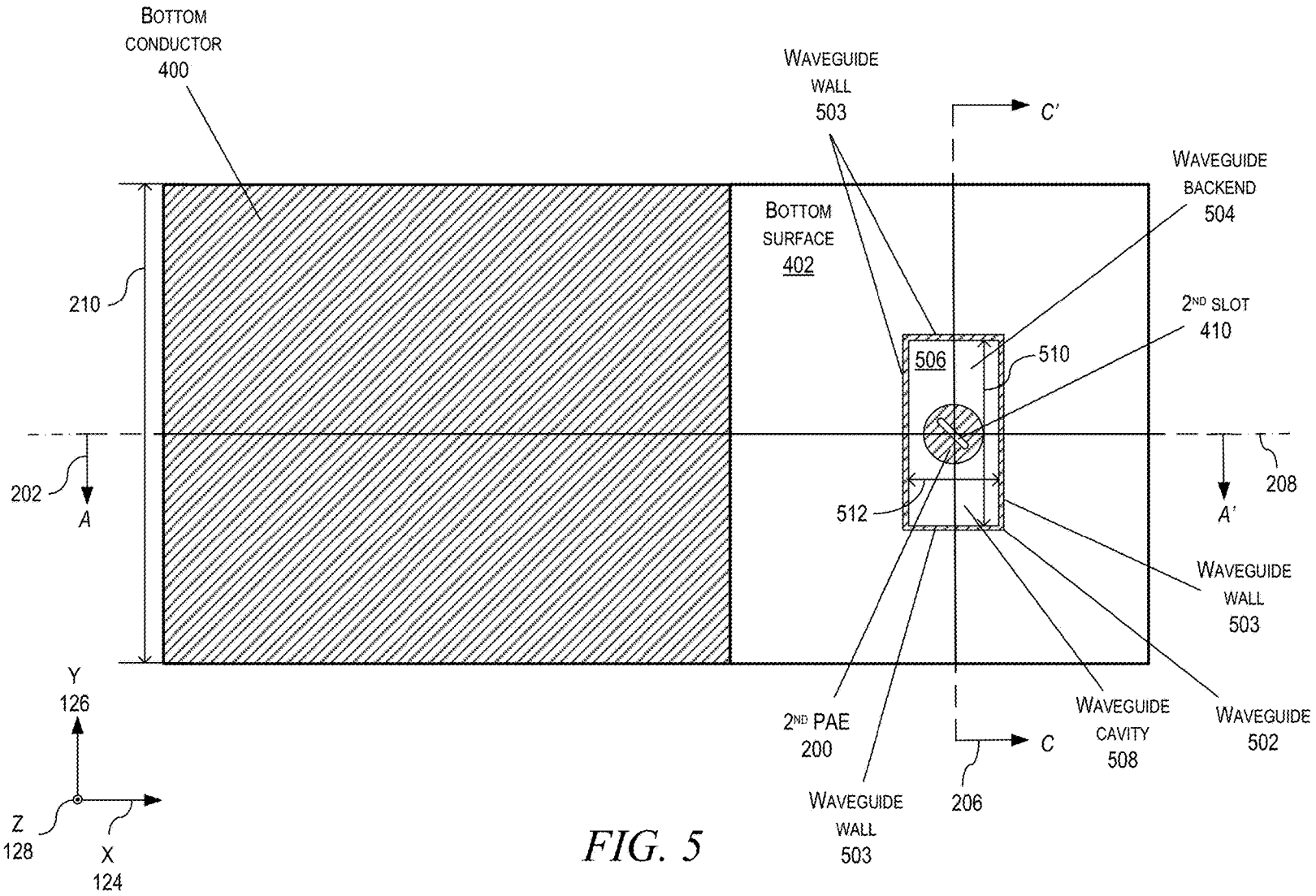
FIG. 5 is a bottom view of another example of an implementation of the WFAECP in accordance with the present disclosure.

In FIG. 5, a bottom view of another example of an implementation of the WFAECP 500 is shown in accordance with the present disclosure. In this example, the waveguide 502 is shown be a rectangular waveguide having four waveguide walls 503, a waveguide backend 504, waveguide backend surface 506, and waveguide cavity 508. The waveguide backend surface 506 is a portion of the bottom surface 402 of the bottom dielectric layer. The waveguide backend surface 506 and the four waveguide walls 503 form the waveguide cavity 508 within the waveguide 502. The second PAE 200 is located within the waveguide cavity 508 at the waveguide backend surface 506. In this example, the waveguide 502 is shown to be a rectangular waveguide having a waveguide width 510 and waveguide height 512 that is based on the design of the WFAECP 500.

Figure 6:
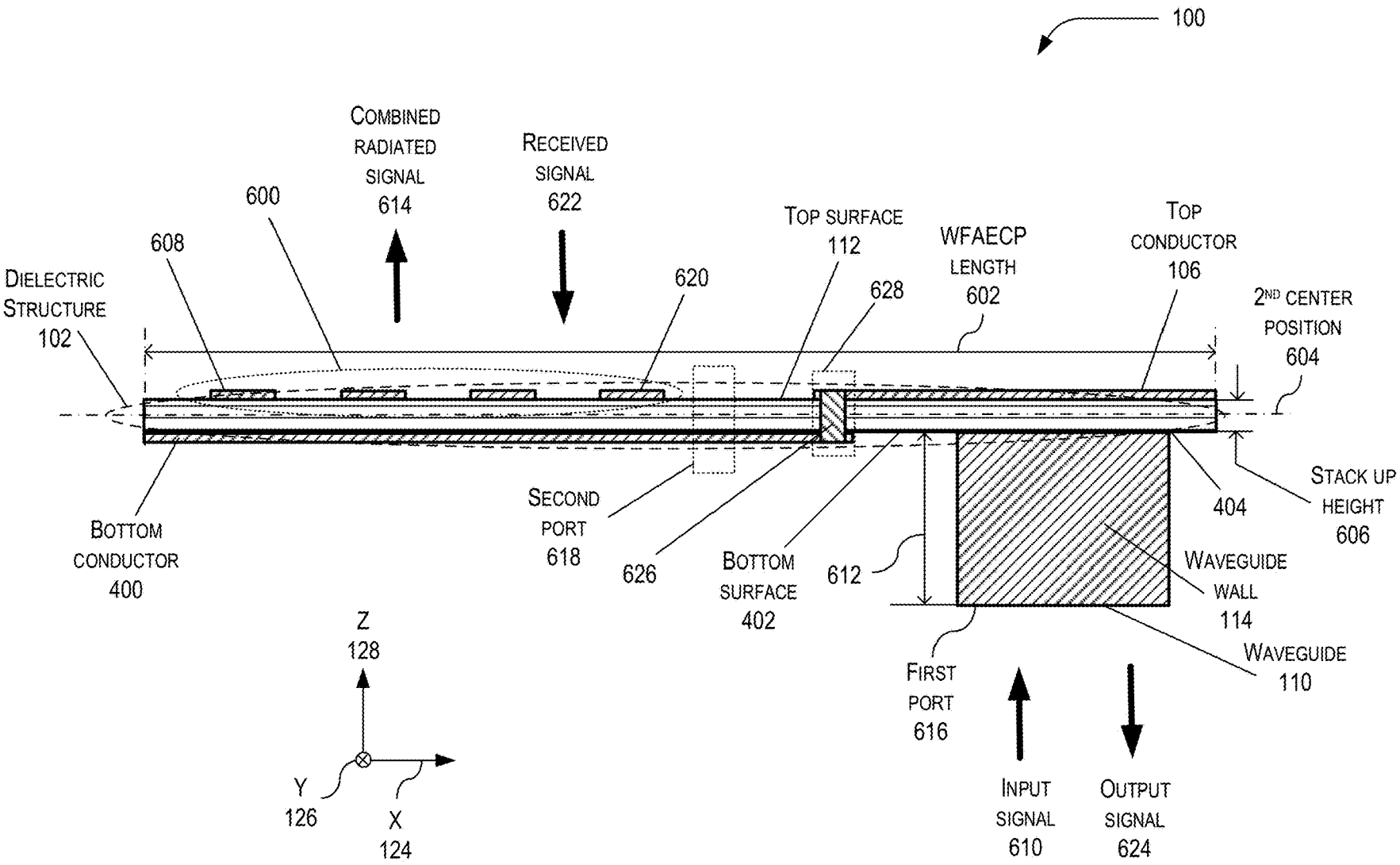
FIG. 6 is a side view of the WFAECP (shown in FIGS. 1-4) in accordance with the present disclosure.

In FIG. 6, a side view of the WFAECP 100 is shown in accordance with the present disclosure. In this view, the dielectric structure 102, top conductor 106, bottom conductor 400, top surface 112 of the top dielectric layer, bottom surface 402 of the bottom dielectric layer, waveguide 110, and waveguide wall 114 are shown. Moreover, a plurality of PAEs 600 (including the first PAE 104) are also shown on the top surface 112.

In this example, the inner conductor (not shown) within the dielectric structure 102 runs partially along a WFAECP length 602 (along the X-axis 124) at approximately a second center position 604. The second center position 604 is located at a position approximately equal to half of a stack-up height 606 of the dielectric structure 102. In general, the inner conductor length (not shown) extends from a first position above the second PAE 200 at the waveguide 110 to a second position below a last PAE 608 of the plurality of PAEs 600. The inner conductor is either a radio frequency ("RF") microstrip or stripline and the inner conductor, bottom conductor 400, each PAE of the plurality of PAEs 600, top conductor 106, and at least one waveguide wall 114 may be metal conductors. In this example, each PAE of the plurality of PAEs 600 includes an antenna slot that is cut into the corresponding PAE.

While conductive vias have been described to electrically connect the top conductor 106 to the bottom conductor 400 so as to place them at the same reference potential (i.e., form an extended reference ground plane), it is appreciated by those of ordinary skill in the art that the either in addition to or as substitution for the conductive via (based on the design of the WFAECP 100), one or more conductive paths 626 may electrically connect the top conductor 106 and bottom conductor 400. Moreover, it is appreciated that at the point of overlap 628 of the top conductor 106 and the bottom conductor 400, the inner conductor (not shown) will be a stripline transmission line because it is passing through a portion of the dielectric structure 102 has both a top and bottom ground plane.

In an example of operation, the WFAECP 100 is configured to propagate an input signal 610 that is transmitted through the waveguide 110 along the direction of the Z-axis 128 and, in response, produces an input TEM signal (not shown) that is transmitted along the inner conductor along the negative direction of the X-axis 124.

Specifically, the input signal 610 propagates along a length 612 of the waveguide 110 towards the waveguide backend surface (that is part of the bottom surface 402) where the combined second PAE 200 and second antenna slot 410 are located. Once the input signal 610 reaches the combined second PAE 200 and second antenna slot 410, electromagnetic coupling occurs between the combined second PAE 200 and second antenna slot 410 and the inner conductor to produce the input TEM signal that is propagated along the inner conductor towards the plurality of PAEs 600.

The input TEM signal travels through the WFAECP length 602 of the dielectric structure 102 along the inner conductor in combination with either the top conductor 106 or bottom conductor 400 until it reaches the plurality of PAEs 600. Once the input TEM signal reaches the plurality of PAEs 600, electromagnetic coupling occurs between each combined PAE and antenna slot and the inner conductor to produce a combined radiated signal 614 that is radiated from the WFAECP 100.

In this example, it is appreciated by those of ordinary skill in the art that the electromagnetic characteristics of the input TEM signal are determined by the geometry (i.e., shape), dimensions (e.g., radius, thickness), and position of the second PAE 200 along the bottom surface 402, the geometry and dimensions of the second antenna slot 410 within the second PAE 200, the position of the inner conductor in relation to the position of the second PAE 200, and the position of an optional coupling element ("CE") (if present) with regards to the position of the second PAE 200 and the position of the inner conductor. Furthermore, the electromagnetic characteristics of the combined radiated signal 614 are determined by the geometry (i.e., shape), dimensions (e.g., radius, thickness), and position of the each PAE (of the plurality of PAEs 600) along the top surface 112, the geometry and dimensions of the antenna slots within each of the PAEs, the position of inner conductor in relation to the position of the PAEs, and the position of any optional CEs (if present) with regards to the position of the corresponding PAEs and the position of the inner conductor.

It is also appreciated by those of ordinary skill in the art that the WFAECP 100 is a reciprocal device because it is a passive device that only contains isotropic materials. In this example, the WFAECP 100 includes a first port 616 at an opening of the waveguide cavity 408 and a second port 618. The second port 618 is a reference port (i.e., a virtual port along the inner conductor) at a combination of the inner conductor and bottom conductor 400 within the dielectric structure 102 at a position next to an initial PAE 620 of the plurality of PAEs 600. The second port 618 is a feed point where the inner conductor from the second PAE 200 feeds the plurality of PAEs 600. Based on the design and number of PAEs in the plurality of PAEs 600, this feed point may be at a power divider network (not shown) that divides the original inner conductor from the second PAE 200 into a number of feed inner conductors that feed either individual PAEs or groups of PAEs. For example, in an example of a 4×4 planar antenna array, the plurality of PAEs 600 may be divided into the four columns (or groups) 116, 118, 120, and 122 shown in FIGS. 1, 2, and 3. In this example, each column 116, 118, 120, or 122 includes a feed inner conductor within the dielectric structure 102 under each corresponding column 116, 118, 120, or 122 that feeds the four (4) PAEs within each corresponding column 116, 118, 120, and 122.

As such, since the WFAECP 100 is a reciprocal device, the transmission of a signal between the two ports 616 and 618 does not depend on the direction of propagation of the signal. Specifically, as described earlier, the input signal 610 injected into the first port 616 at the waveguide 110 produces the input TEM signal propagating along the combination of the inner conductor and bottom conductor 400 at the second port 618, then under the plurality of PAEs 600, producing the combined radiated signal 614.

In the opposite direction, the WFAECP 100 is configured to take a received signal 622 at the plurality of PAEs 600 and, in response, produce an output TEM signal (not shown) that is injected into the second port 618 and propagated along the combination of the inner conductor and bottom conductor 400, in a direction along the X-axis 124, to the combination of the second PAE 200 and second antenna slot 410. Once the output TEM signal reaches the combination of the second PAE 200 and second antenna slot 410, the combination of the second PAE 200 and second antenna slot 410 produces an output signal 624 that is transmitted along the waveguide 110, at the first port 616, along the negative direction of the Z-axis 128.

Figure 7:
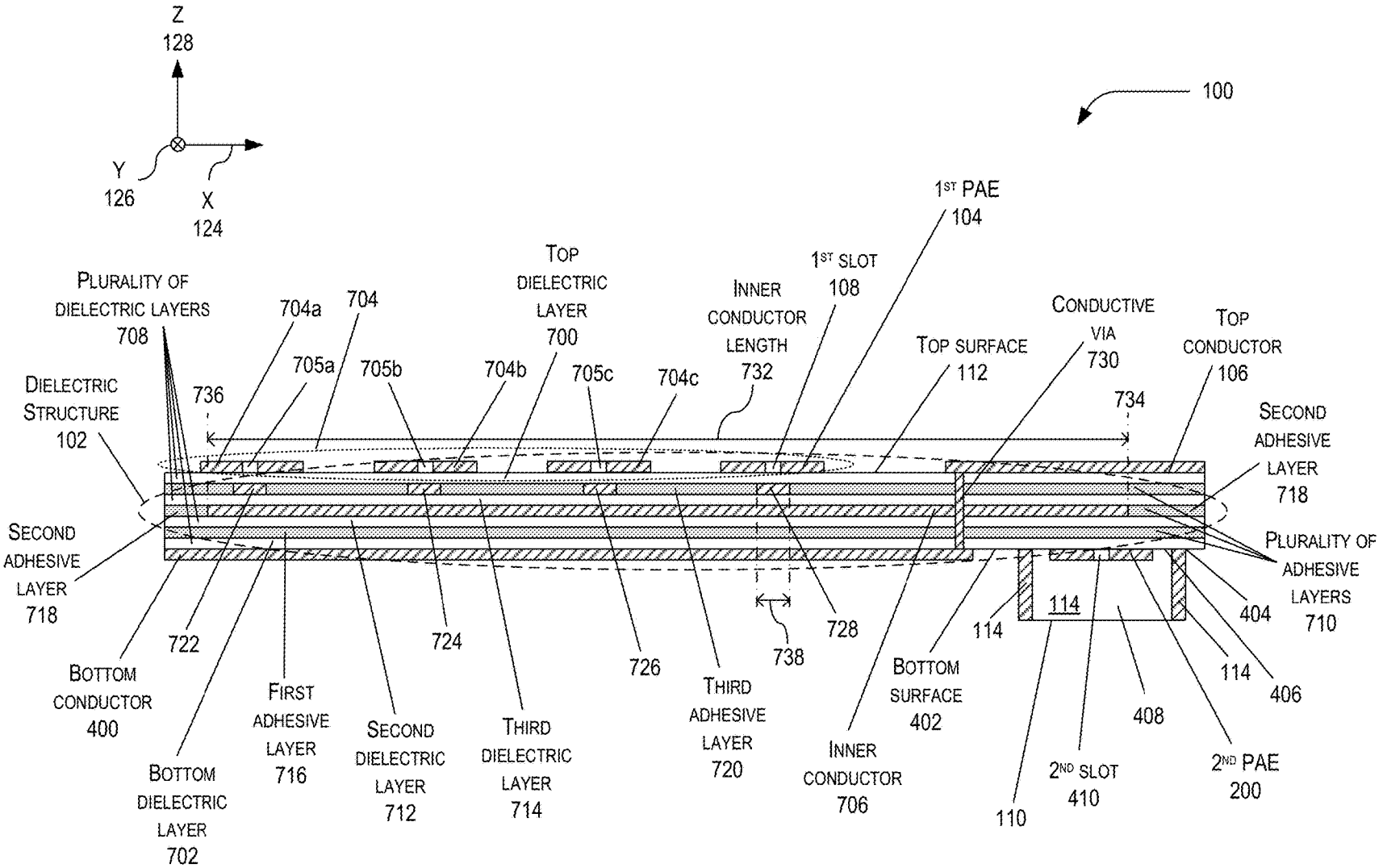
FIG. 7 is a side sectional view of the WFAECP (shown in FIGS. 1-4, and 6) along a first cutting plane A-A' (shown in FIGS. 2-5) in accordance with the present disclosure.

In FIG. 7, a side sectional view of the WFAECP 100 is shown in accordance with the present disclosure. In this view, the dielectric structure 102, top conductor 106, bottom conductor 400, top surface 112 of the top dielectric layer 700, bottom surface 402 of the bottom dielectric layer 702, waveguide 110, waveguide wall 114, waveguide backend 404, waveguide backend surface 406, and waveguide cavity 408 are shown. Additionally, the second PAE 200 with the second antenna slot 410 and a plurality of PAEs 704 (including the first PAE 104) on the top surface 112 are also shown. The first antenna slot 108 is shown cut into the first PAE 104 and each PAE 704*a*, 704*b*, and 704*c*, of the plurality of PAEs 704, is showing have an antenna slot (705*a*, 705*b*, and 705*c*, respectively) cut into it. Moreover, within the dielectric structure 102, an inner conductor 706 and a plurality of dielectric layers 708 and a plurality of adhesive layers 710 are shown. In this example, each dielectric layer of the plurality of dielectric layers 708 is a dielectric laminate material.

In this example, the plurality of dielectric layers 708 includes the top dielectric layer 700 and the bottom dielectric layer 702, and a second dielectric layer 712 and a third dielectric layer 714. The plurality of adhesive layers 710 includes a first adhesive layer 716, second adhesive layer 718, and third adhesive layer 720. The WFAECP 100 may also include an optional first CE 722, optional second CE 724, optional third CE 726, and optional fourth CE 728. Furthermore, the WFAECP 100 includes a conductive via 730 in signal communication with the bottom conductor 400 and the top conductor 106. The inner conductor 706 has an inner conductor length 732 that extends along the X-axis 124 from a first position 734 above the second PAE 200 (i.e., below with respect to the second PAE 200) to a second position 736 below the last PAE 704*a* of the plurality of PAEs 704. Additionally, the CEs each have a CE width that for purpose of simplicity of illustration are assumed to be the same. For example, the fourth CE 728 has a CE width 738. Each CE 722, 724, 726, and 728 has a CE length that is orthogonal to the inner conductor length 732.

In this example, the WFAECP 100 may include a combination of an additional dielectric layer (not shown) and additional adhesive layer (not shown) below the second dielectric layer 712 and above the bottom dielectric layer 702 so as to include another CE (not shown) below the inner conductor 706 and above the second PAE 200. In this example, it is appreciated by those of ordinary skill in the art that the actual ends (i.e., 734 and 736) of the inner conductor length 732 are predetermined by the design of the WFAECP 100.

It is appreciated that the present example describes the WFAECP 100 utilizing dielectric laminate materials for the plurality of dielectric layers 708, where the WFAECP 100 have been fabricated utilizing a laminate stack-up process with the dielectric laminate materials and the plurality of adhesive layers 710. As an example, the dielectric laminate material may be constructed of Pyralux® flexible circuit materials produced by E. I. du Pont de Nemours and Company of Wilmington, Del., where each dielectric layer may be a 10 mil Pyralux®. Moreover, each of these dielectric layers may be laminated to each other with an adhesive layer, of the plurality of adhesive layers, where each adhesive layer may be an adhesive film, tape or bonding film. However, the WFAECP 100 may also be fabricated utilizing a 3-D printing process that would only include four dielectric layers that would be directly printed on top of each other to produce the stack-up of the plurality of dielectric layers 708 without the need for the plurality of adhesive layers 710. In this alternative fabrication process, the dielectric layers of the plurality of dielectric layers 708 would be constructed of printed dielectric material not dielectric laminate material.

Figure 8:
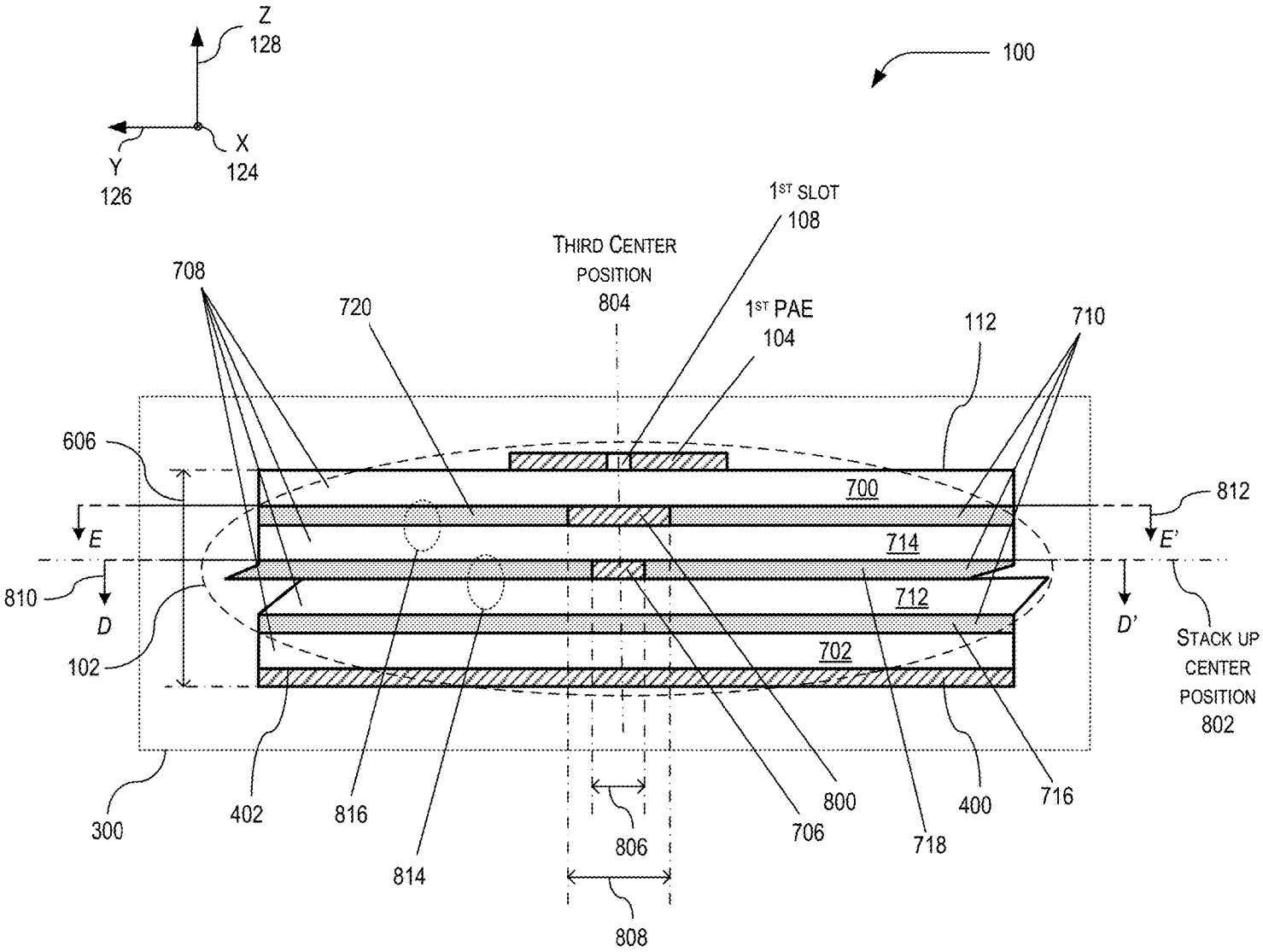
FIG. 8 is an expanded sectional view (shown in FIG. 3) of an example of an implementation of the WFAECP along a second cutting plane B-B' (shown in FIGS. 2-3) in accordance with the present disclosure.

Turning to FIG. 8, the expanded sectional view 300 (shown in FIG. 3) of an example of an implementation of the WFAECP 100 along the second cutting plane B-B' 204 is shown in accordance with the present disclosure. It is appreciated that for the purposes of ease of illustration, FIG. 8 is not drawn to scale. In this view, the dielectric structure 102, plurality of dielectric layers 708, plurality of adhesive layers 710, stack-up height 606, top dielectric layer 700, bottom dielectric layer 702, top surface 112 of the top dielectric layer 700, bottom surface 402 of the bottom dielectric layer 702, inner conductor 706, bottom conductor 400, the first PAE 104, and the first antenna slot 108 are shown. In this example, it is assumed that a CE 800 is present below the first PAE 104 and above the inner conductor 706.

In this example, each of the dielectric layers of the plurality of dielectric layers 708 are RF dielectrics. Additionally, the WFAECP 100 is shown to have a stack-up center position 802 that may be located at approximately half of the stack-up height 606 and a third center position 804 that is located approximately at a center position of the first PAE 104 and first antenna slot 108. Assuming that the WFAECP 100 is not a 4×4 planar antenna array but is instead 1×N planar antenna array (i.e., a linear array with N number of PAEs in the linear array), the third center position 804 may be at a position approximately equal to half of the dielectric structure width 210.

It is appreciated by those of ordinary skill in the art that while only four (4) dielectric layers (i.e., bottom dielectric layer 702, second dielectric layer 712, third dielectric layer 714, and top dielectric layer 700) are shown in the plurality of dielectric layers 708, any number greater than three (3) may be utilized for the number of dielectric layers of the plurality of dielectric layers 708 if the CE 800 is present. If the CE 800 is not present, any number greater than two (2) may be utilized for the number of dielectric layers of the plurality of dielectric layers 708.

The inner conductor 706 is also shown to have an inner conductor width 806 that is approximately centered about the third center position 804 and the CE 800 is shown to also be centered about the third center position 804 with a CE length 808 that is centered about third center position 804 and extends outward from the third center position 804.

In this example, the inner conductor 706 is an RF microstrip or stripline located below the CE 800 and the first PAE 104 with the first antenna slot 108 acting as an electrically coupled antenna feed configured to couple energy to the first PAE 104. In general, the inner conductor width 806, the CE length 808, and their respective position below (i.e., the stack-up center position 802) the first PAE 104 are predetermined by the design of the WFAECP 100 to approximately match the impedance between the inner conductor 706, CE 800, and the first PAE 104 with the first antenna slot 108.

As such, while the stack-up center position 802 is shown in FIG. 8 to be approximately in the center of the stack-up height 606, it is appreciated by those of ordinary skill in the art that this is an approximation that may vary because the actual stack-up center position 802 may be predetermined from the design of the WFAECP 100. However, for purposes of illustration, the predetermined position is assumed to be generally close to the stack-up center position 802 of the stack-up height 606 but it is appreciated that this may vary based on the actual design of the WFAECP 100. Additionally, while not shown in this view, the first antenna slot 108 within the first PAE 104 increases the bandwidth of the first PAE 104 and also has a predetermined angle along the first PAE 104 with respect to the inner conductor 706 to provide circular polarization from the first PAE 104 and a predetermined slot width to match the impedance between the inner conductor 706, CE 800, and the first PAE 104. In general, the bandwidth of the first PAE 104 is enhanced by utilizing the electrically coupled feed line from the inner conductor 706 through first antenna slot 108 as compared to coupling the inner conductor 706 to the first PAE 104 without the presence of the first antenna slot 108. Additionally, the bandwidth is further enhanced by also utilizing the CE 800 in combination with the first PAE 104 and first antenna slot 108 where both the CE 800 and the combination of the first PAE 104 and first antenna slot 108 are separated from a mutual reference ground plane (i.e., bottom conductor 400). The addition of the CE 800 in the WFAECP 100 decreases the axial ratio and increases the circular polarization bandwidth without increasing the size of an antenna array utilizing the WFAECP 100.

In this example, a fourth cutting plane D-D' 810 and a fifth cutting plane E-E' 812 are shown looking into the WFAECP 100. In this view, the first antenna slot 108 is only partially visible because it is located within the first PAE 104 that is, therefore, partially blocked by other parts of the first PAE 104 shown in this view. Moreover, the inner conductor 706 is located in a middle dielectric layer 814 and the CE 800 is located within a CE dielectric layer 816. Specifically, the inner conductor 706 is located within or on the middle dielectric layer 814 and the CE 800 is located between the inner conductor 706 and the combination of the first PAE 104 with the first antenna slot 108 within or on the CE dielectric layer 816 below the top dielectric layer 700 and above the middle dielectric layer 814.

Based on the fabrication method utilized in producing the WFAECP 100, the middle dielectric layer 814 may be a dielectric layer from the plurality of dielectric layers 708 or a dielectric layer formed from an adhesive layer of a plurality of adhesive layers 710, or a combination of both. Specifically, in the example shown in FIG. 8, the inner conductor 706 is shown as being located within the third adhesive layer 720 (of the plurality of adhesive layers 710) on top of the third dielectric layer 714. In general, if the second dielectric layer 712 is on top of the combination of the bottom dielectric layer 702 and first adhesive layer 716 from the plurality of adhesive layers 710. In this example, assuming that the inner conductor 706 is exclusively located within the second adhesive layer 718 and on top of the second dielectric layer 712, the middle dielectric layer 814 would correspond to the second adhesive layer 718. If, instead, the inner conductor 706 were exclusively located within the second dielectric layer 712, the middle dielectric layer 814 would correspond to the second dielectric layer 712. Alternatively, if the inner conductor 706 were located partially with the second adhesive layer 718 and the second dielectric layer 712, the middle dielectric layer 814 would correspond to a combination of the second adhesive layer 718 and the second dielectric layer 712.

Similarly, based on the fabrication method utilized in producing the WFAECP 100, the CE dielectric layer 816 may be a dielectric layer from the plurality of dielectric layers 708 or a dielectric layer formed from an adhesive layer of a plurality of adhesive layers 710, or a combination of both. Specifically, in the example shown in FIG. 8, the CE 800 is shown as being located with the third adhesive layer 720 (of the plurality of adhesive layers 710) on top of the third dielectric layer 714. The third dielectric layer 714 is on top of the combination of the second dielectric layer 712 and first adhesive layer 716. In this example, assuming that the CE 800 is exclusively located within the third adhesive layer 720 and on top of the third dielectric layer 714, the CE dielectric layer 816 would correspond to the third adhesive layer 720. If, instead, the CE 800 were exclusively located within the third dielectric layer 714, the CE dielectric layer 816 would correspond to the third dielectric layer 714. Alternatively, if the CE 800 were located partially with the third adhesive layer 720 and the third dielectric layer 714, the CE dielectric layer 816 would correspond to a combination of the third adhesive layer 720 and the third dielectric layer 714.

As discussed earlier, in this example, each dielectric layer, of the plurality of dielectric layers 708, may be an RF dielectric material and the inner conductor 706 may be a RF microstrip conductor or stripline conductor. It is appreciated that in this example, each of the first, second, and third adhesive layers 716, 718, and 720 act as a dielectric with different dielectric properties than the other dielectric layers in plurality of dielectric layers 708.

The CE 800 may be conductive element such as notch that extends outward from the inner conductor 706. The inner conductor 706 may be located at a predetermined center position within the dielectric structure 102 (e.g., at the stack-up center position 802 and third center position 804). Again, in this example, the stack-up center position 802 is equal to approximately half of a stack-up height 606 along a Z-axis 128. Moreover, the inner conductor 706 may also have an inner conductor center that is located at a position within the dielectric structure 102 that is approximately at the third center position 804.

Furthermore, the CE 800 may be an approximately rectangular like conductive strip that is located below the combination of the first PAE 104 and first antenna slot 108 and top dielectric layer 700, and above the inner conductor 706 in or on the CE dielectric layer 816. The CE 800 has the CE length 808 that may extend outward from the inner conductor width 806. In this example, the fifth cutting plane E-E' 812 is shown cutting through the dielectric structure 102 at the location of the CE 800 and looking into the WFAECP 100.

Figure 9:
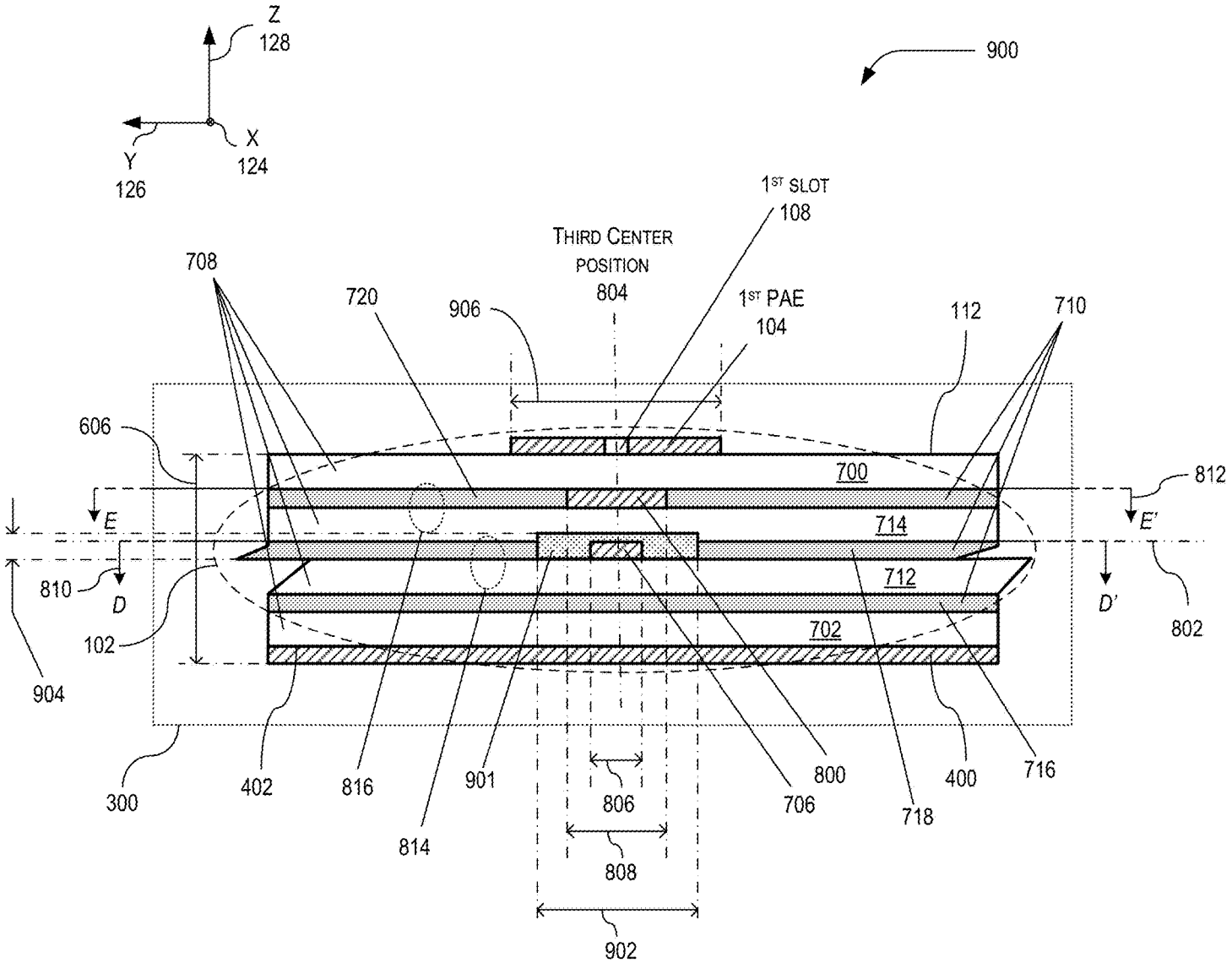
FIG. 9 is the expanded sectional view (shown in FIG. 3) of another example implementation of the WFAECP along the second cutting plane B-B' 204 (shown in FIGS. 2-3) in accordance with the present disclosure.

In FIG. 9, the expanded sectional view 300 (shown in FIG. 3) of another example implementation of the WFAECP 900 along the second cutting plane B-B' 204 is shown in accordance with the present disclosure.

Similar to the example described in relation to FIG. 8, in this view, the plurality of dielectric layers 708, top dielectric layer 700, dielectric structure 102, inner conductor 706, top surface 112, bottom conductor 400, CE 800, the first PAE 104, and first antenna slot 108 are shown. In this example, as described earlier, each of the dielectric layers of the plurality of dielectric layers 708 are RF dielectrics.

In this example, the WFAECP 900 is again shown to have the stack-up center position 802 that may be located at approximately half of the stack-up height 606 and the third center position 804 that is located at approximately the center of the first PAE 104 and first antenna slot 108. The difference between this example and the one described in relation to FIG. 8 is that in this example the WFAECP 900 includes a cavity 901 within the WFAECP 900 to improve the electromagnetic performance of the WFAECP 900. In this example, the cavity 901 may be located within the dielectric structure 102 between the inner conductor 706 and the first PAE 104 at the middle dielectric layer 814 centered about the inner conductor 706 with a cavity width 902, which is greater than the inner conductor width 806. The cavity 901 may also have a cavity height 904 that is greater than or approximately equal to the height of the inner conductor 706. The cavity 901, for example, may be filled with air.

In this example, cavity 901 may have a circular perimeter such that the cavity width 902 may be approximately equal to the width of the first PAE 104, which is equal to a PAE diameter 906. Alternatively, the diameter of the cavity may be more or less than the PAE diameter. In general, the cavity width 902 and cavity height 904 are predetermined values that are based on the design of the WFAECP 900 such as to enhance and approximately optimize the gain and bandwidth of the CE 800 and first PAE 104 with the first antenna slot 108.

Figure 10:
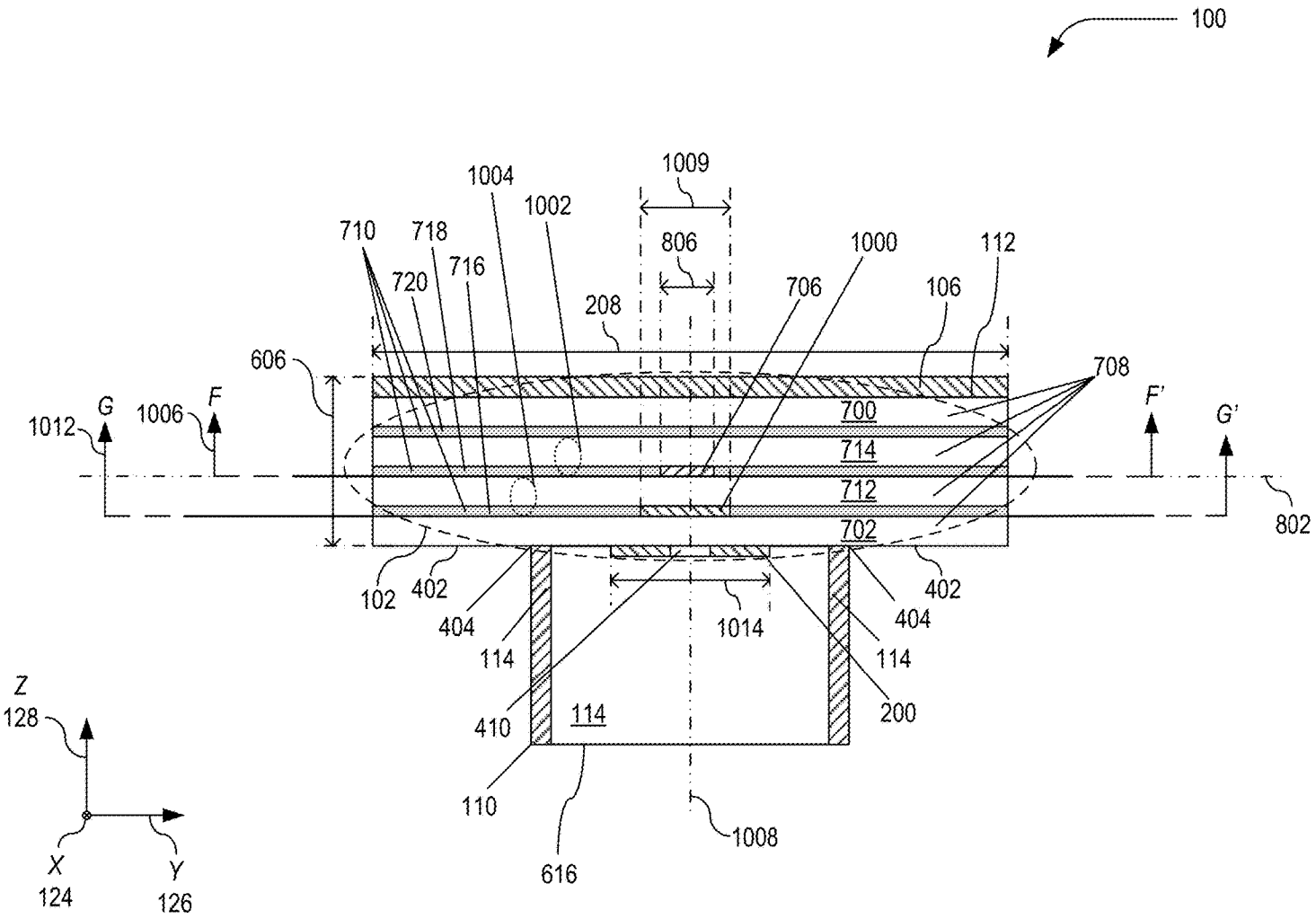
FIG. 10 is a section view of an example of an implementation of the WFAECP along the third cutting plane C-C' (shown in FIGS. 2-3) in accordance with the present disclosure.

Turning to FIG. 10, a section view of an example of an implementation of the WFAECP 100 along the third cutting plane C-C' 206 is shown in accordance with the present disclosure. In this view, the dielectric structure 102 is shown looking in the X-axis direction 124 towards the waveguide 110. In this example, the WFAECP 100 includes an optional CE 1000. The inner conductor 706 is located within or on a second middle dielectric layer 1002 and the optional CE 1000 is located between the inner conductor 706 and the combination of the second PAE 200 with the second antenna slot 410 within or below a second CE dielectric layer 1004 above the bottom dielectric layer 702 and below the second middle dielectric layer 1002. Based on the fabrication method utilized in producing the WFAECP 100, the second middle dielectric layer 1002 may be a dielectric layer from the plurality of dielectric layers 708 or a dielectric layer formed from an adhesive layer of a plurality of adhesive layers 710, or a combination of both.

Specifically, in this example, the inner conductor 706 is shown as being located with the second adhesive layer 718 below the third dielectric layer 714. The third dielectric layer 714 is below the combination of the top dielectric layer 700 and the third adhesive layer 720. In this example, assuming that the inner conductor 706 is exclusively located within the second adhesive layer 718 and below the third dielectric layer 714, the second middle dielectric layer 1002 would correspond to the second adhesive layer 718. If, instead, the inner conductor 706 is exclusively located within the third dielectric layer 714, the second middle dielectric layer 1002 would correspond to the third dielectric layer 714. Alternatively, if the inner conductor 706 is located partially with the second adhesive layer 718 and the third dielectric layer 714, the second middle dielectric layer 1002 would correspond to a combination of the second adhesive layer 718 and the third dielectric layer 714. In this example, a sixth cutting plane F-F' 1006 is shown cutting through the dielectric structure 102 at the location of the inner conductor 706 and looking into the WFAECP 100 along the X-axis 124.

Similarly, based on the fabrication method utilized in producing the WFAECP 100, the second CE dielectric layer 1004 may be a dielectric layer from the plurality of dielectric layers 708 or a dielectric layer formed from an adhesive layer of a plurality of adhesive layers 710, or a combination of both. Specifically, in this example, the CE 1000 is shown as located within the first adhesive layer 716 below the second dielectric layer 712. The second dielectric layer 712 is below the combination of the third dielectric layer 714 and the second adhesive layer 718. In this example, assuming that the CE 1000 is exclusively located within the first adhesive layer 716 and below the second dielectric layer 712, the second CE dielectric layer 1004 would correspond to the first adhesive layer 716. If, instead, the CE 1000 is exclusively located within the second dielectric layer 712, the second CE dielectric layer 1004 would correspond to the second dielectric layer 712. Alternatively, if the CE 1000 is located partially within the first adhesive layer 716 and the second dielectric layer 712, the second CE dielectric layer 1004 would correspond to a combination of the first adhesive layer 716 and the second dielectric layer 712.

As discussed earlier with regards to CE 800, the CE 1000 may be conductive element such as a notch that extends outward from the inner conductor 706 having a CE width 1009. The inner conductor 706 may be located at a predetermined center position within the dielectric structure 102 (e.g., at the stack-up center position 802 and a fourth center position 1008). Again, in this example, the stack-up center position 802 is equal to approximately half of a stack-up height 606 along a Z-axis 128. Moreover, the inner conductor 706 may also have an inner conductor center that is located at a position within the dielectric structure 102 that is approximately at a fourth center position 1008 that is equal to approximately half of a dielectric structure width 210 of the dielectric structure 102 along a Y-axis 126.

Furthermore, the CE 1000 may be an approximately rectangular like conductive strip that is located above the combination of the second PAE 200 and second antenna slot 410 and bottom dielectric layer 702, and below the inner conductor 706 in or below the second CE dielectric layer 1004. The CE 1000 has a CE length 1010 that may extend outward from the inner conductor width 806. In this example, a seventh cutting plane G-G' 1012 is shown cutting through the dielectric structure 102 at the location of the CE 1000 and looking into the WFAECP 100 along the X-axis 124. In this example, the addition of the CE 1000 in the WFAECP 100 decreases the axial ratio and increases the circular polarization bandwidth.

It is appreciated by those of ordinary skill in the art that a cavity (such as the cavity 901 shown in FIG. 9) may be added to the this example so as to surround the inner conductor 706 about the second middle dielectric layer 1002 in the same fashion as was shown in FIG. 9 with regards to inner conductor 706 and middle dielectric layer 814.

As discussed previously, in this example, the cavity may be located within the dielectric structure 102 between the inner conductor 706 and the second PAE 200 at the second middle dielectric layer 1002 centered about the inner conductor 706 with a cavity width, which is greater than the inner conductor width 806. The cavity may also have a cavity height that is greater than or approximately equal to the height of the inner conductor 706. The cavity, for example, may be filled with air.

In this example, the cavity may be circular such that the cavity width (or diameter) may be approximately equal to the width of the second PAE 200, which is equal to a second PAE diameter 1014. Alternatively, the diameter of the cavity may be more or less than the PAE diameter. In general, the cavity width and cavity height are predetermined values that are based on the design of the WFAECP 100 such as to enhance and approximately optimize the gain and bandwidth of the CE 1000 and second PAE 200 with the second antenna slot 410.

Figure 11:
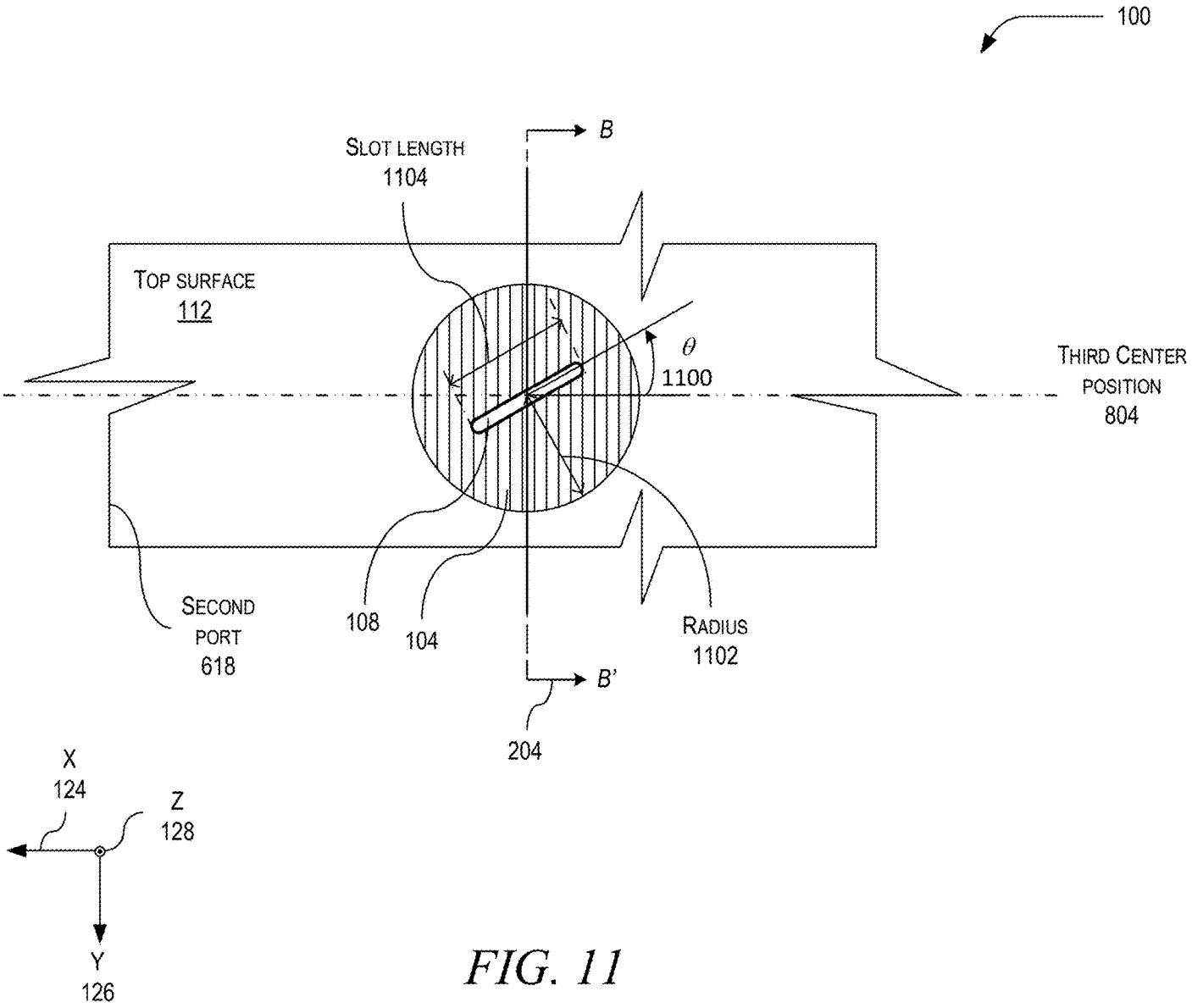
FIG. 11 is an expanded top view of the sectional view (shown in FIG. 3) of an example implementation of a first patch antenna element ("PAE") (shown in FIGS. 1-3 and 6-9) in accordance with the present disclosure.

FIG. 11 is an expanded top view of the sectional view 300 (shown in FIG. 3) of an example implementation of the first PAE 104 and first antenna slot 108 shown in FIGS. 1-3 and 6-9 in accordance with the present disclosure. In this example, the first antenna slot 108 is shown within the first PAE 104 at an angle θ 1100 along the first PAE 104 with respect to the inner conductor 706 along the third center position 804. In this example, the first antenna slot 108 is shown to be centered about the third center position 804. The angle θ 1100 may be negative or positive. In this example, the first PAE 104 is shown to have a circular shape with a radius 1102 (i.e., equal to half of the PAE diameter 906). As discussed earlier, the geometry (or shape), dimensions (e.g., radius, thickness), and position of the first PAE 104 along the top surface 112 and the geometry and dimensions of the first antenna slot 108 within the first PAE 104 determine the electromagnetic characteristics of a radiated or received signal from the first PAE 104. Moreover, in this example, the first PAE 104 is circular with the radius 1102 and the first antenna slot 108 has a slot length 1104. In general, the radius 1102 of the first PAE 104 and the slot length 1104 are predetermined to enhance and approximately optimize/maximize the radiated or received signal produced by the first PAE 104 (with the first antenna slot 108) at a predetermined operating frequency. It is appreciated by those of ordinary skill in the art that other geometries may also be utilized in the present disclosure without departing from the spirit or principles disclosed herein. In this example, the second cutting plane B-B' 204 along the Y-axis 126 is shown looking into the WFAECP 100 along a negative direction along the X-axis 124. The view into the second cutting plane B-B' 204 corresponds to the expanded sectional view of the WFAECP 100 and 900 shown in FIGS. 8 and 9.

Figure 12:
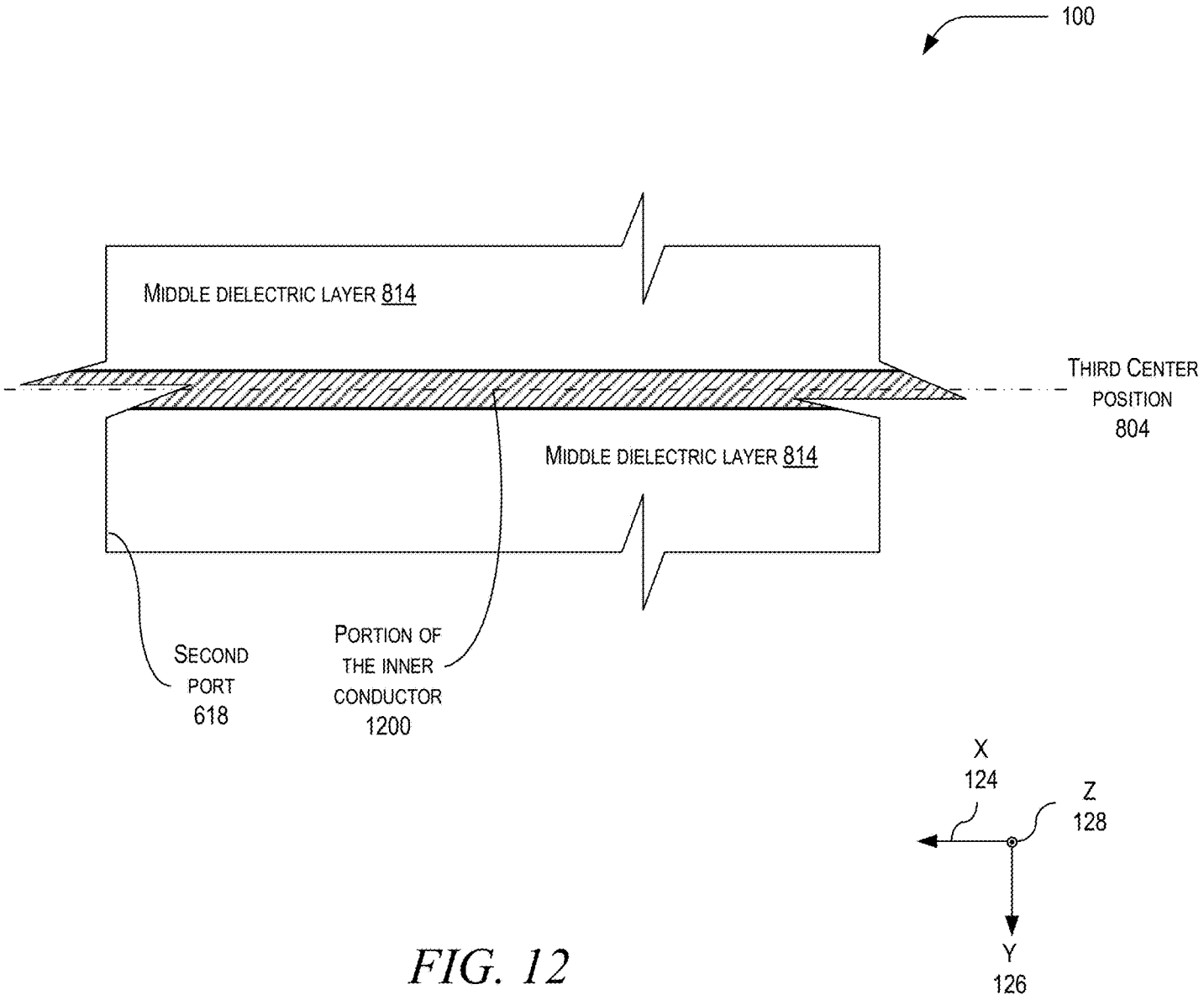
FIG. 12 is an expanded sectional view along the fourth cutting plane D-D' (shown in FIGS. 8 and 9) showing an inner conductor running along an inner conductor length in accordance with the present disclosure.

FIG. 12 is an expanded sectional view along the fourth cutting plane D-D' 810 showing a portion 1200 of the inner conductor 706 running along the inner conductor length 732 (along the X-axis 124) in accordance with the present disclosure. In this example, the inner conductor 706 is shown to be within the plurality of dielectric layers 708 above the bottom conductor 400 in the middle dielectric layer 814 of the laminated dielectric structure 102 between two other dielectric layers (not shown).

Figure 13:
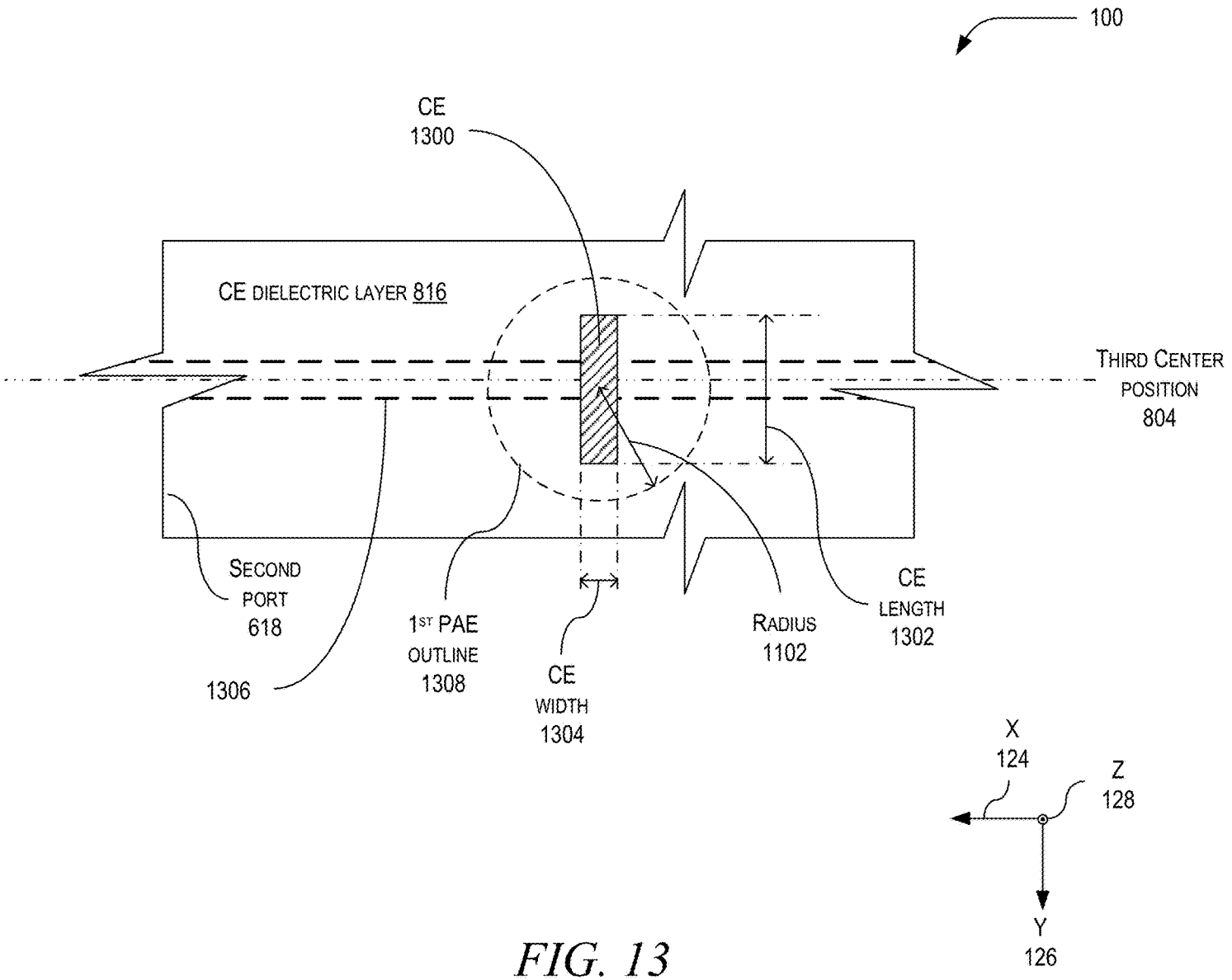
FIG. 13 is an expanded sectional view along the fifth cutting plane E-E' (shown in FIGS. 8 and 9) showing a CE in accordance with the present disclosure.

FIG. 13 is an expanded sectional view along the fifth cutting plane E-E' 812 showing a CE 1300 in accordance with the present disclosure. In this example, the CE 1300 is shown as a stub that has a CE length 1302 that is approximately orthogonal to a length of the inner conductor 706 and CE width 1304. In this view, the portion 1200 of the inner conductor 706 is located within the plurality of dielectric layers 708 above the bottom conductor 400 and below the CE dielectric layer 816. The portion 1200 of the inner conductor 706 is located below the CE 1300 and is not visible. Moreover, the first PAE 104 and first antenna slot 108 are located above the CE 1300 and top dielectric layer 700 and are not visible. As such, in this view, an inner conductor outline 1306 of the portion 1200 of the inner conductor 706 and a first PAE outline 1308 of the first PAE 104 are shown for purposes of illustration. The inner conductor outline 1306 is centered about the third center position 804. In this example, the CE 1300 is located below the first PAE 104 within the first PAE outline 1308 where the CE length 1302 is less than or equal to the diameter (i.e., twice the radius 1102) of the first PAE outline 1308 and extends approximately orthogonally from the inner conductor outline 1306. In general, the CE length 1302 and CE width 1304 are predetermined to enhance and approximately optimize a radiated signal of the combined first PAE 104 and first antenna slot 108 at a predetermined operating frequency.

In this disclosure, the inner conductor 706, CE 1300, and first PAE 104 are designed to be electrically coupled to one another at a predetermined operating frequency. The TEM signal inserted from the second port 618 travels down the portion 1200 of the inner conductor 706, then electrically couples through the dielectric structure 102 to the CE 1300 where the current of the signal is rotated due to the orientation of CE 1300 with respect to the inner conductor 706. The signal then electrically couples from CE 1300 through the dielectric structure 102 to the first PAE 104 where the current of the signal further rotates due to the orientation of first PAE 104 with respect to CE 1300. The circularly polarized radiated signal is then radiated from the combination first PAE 104 and first antenna slot 108 through free-space.

Figure 14:
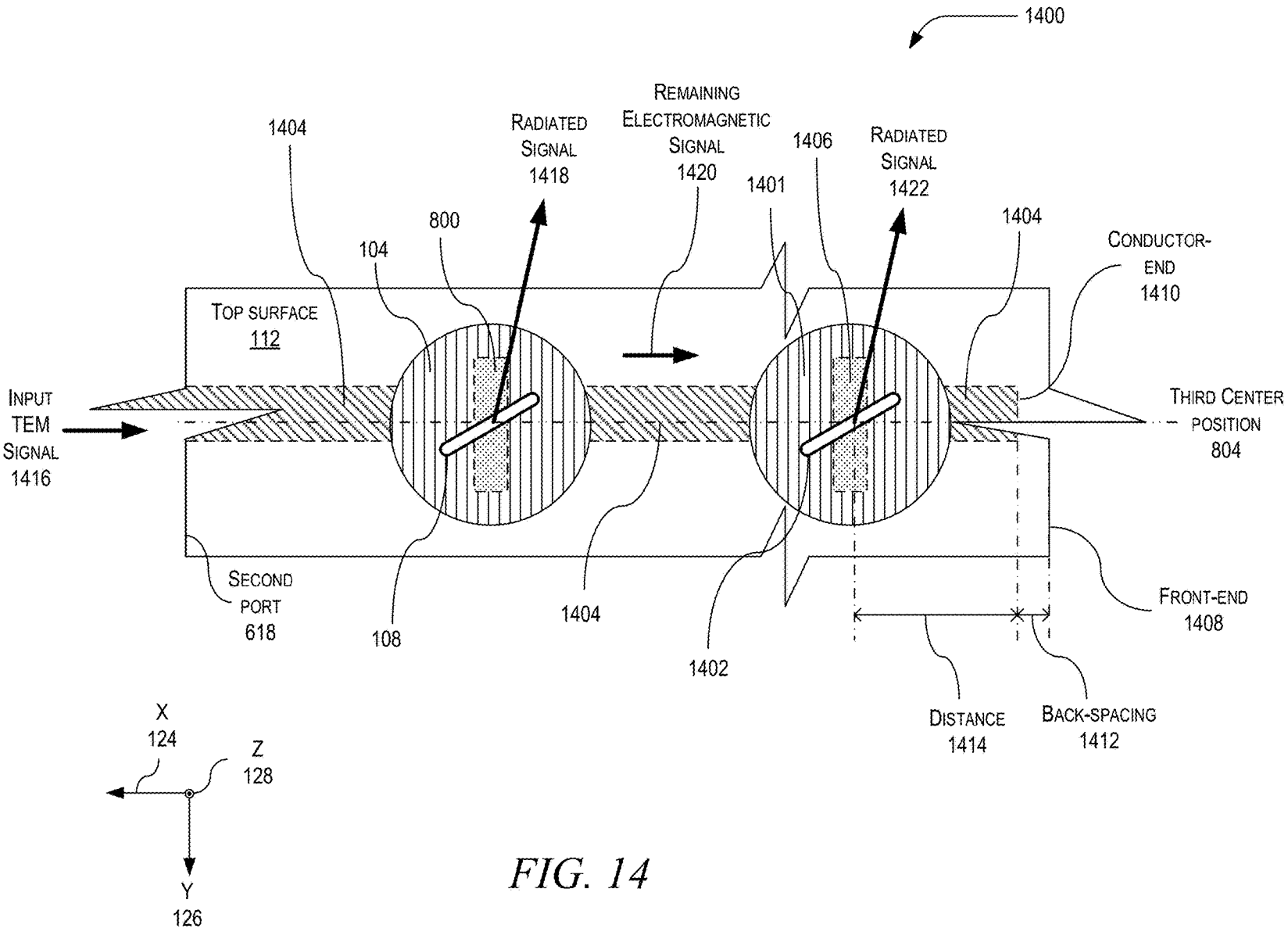
FIG. 14 is a top view of an example of another implementation of the WFAECP in accordance with the present disclosure.

In FIG. 14, a top view of an example of another implementation of the WFAECP 1400 is shown in accordance with the present disclosure. In this example, unlike the WFAECP 100, in this example, the WFAECP 1400 is a serially fed 1×2 array that includes a third PAE 1401 on the top surface 112 with a third antenna slot 1402 within the third PAE 1401. In this example, the a portion 1404 of the inner conductor 706 (that is hidden below the top surface 112) is shown through the top surface 112 to illustrate the example location/position of the first PAE 104 with the first antenna slot 108 and the third PAE 1401 with the third antenna slot 1402 in relation to the position of the inner conductor 706 along the third center position 804. Moreover, the hidden first CE 800 is located under the first PAE 104 and above the inner conductor 706. Similarly, a hidden third CE 1406 is located under the third PAE 1401 and above the inner conductor 706. It is appreciated by those of ordinary skill that the WFAECP 1400 illustrated is not drawn to scale.

In general, the inner conductor 706 extends from the second port 618 along part of the length of the WFAECP 1400 to a front-end 1408 of the WFAECP 1400, where the inner conductor 706 has a conductor-end 1410 that may optionally extend to the front-end 1408 or at a back-spacing distance 1412 from the front-end 1408 that is pre-determined by the design of the WFAECP 1400 to enhance and approximately optimize the electrical performance of the WFAECP 1400. Moreover, the conductor-end 1410 may be positioned within the WFAECP 1400 at a pre-determined distance 1414 from the center of the third PAE 1401 to enhance and approximately optimize the amount of energy coupled from the microstrip or stripline to the first PAE 104 and third PAE 1401. As an example, the conductor-end 1410 may be located below the third PAE 1401 near or approximately at the center of the third PAE 1401.

In an example of operation, an input TEM signal 1416 is transmitted from the second port 618 and propagates along the length of the portion 1404 of the inner conductor 706. When the input TEM signal 1416 reaches the first CE 800 and the first PAE 104 with the first antenna slot 108, a portion of the electromagnetic signal produces a first radiated signal 1418. The remaining electromagnetic signal 1420 then propagates towards the third CE 1406 and the third PAE 1401 with the third antenna slot 1402. When the remaining electromagnetic signal 1420 reaches the third CE 1406 and third PAE 1401 with the third antenna slot 1402, a portion of the electromagnetic signal 1420 produces a second radiated signal 1422. If this example is modified to a 1×4 array, the WFAECP 1400 may be an example of the implementation of the second column of PAEs 118 of the WFAECP 100 shown in FIGS. 1-3. Alternatively, this example is a simplified illustration of the 4×4 planar antenna array of WFAECP 100 only showing two PAEs (i.e., first PAE 104 and third PAE 1401, where the second PAE 200 is in the waveguide 110) for purposes of illustration.

Figure 15:
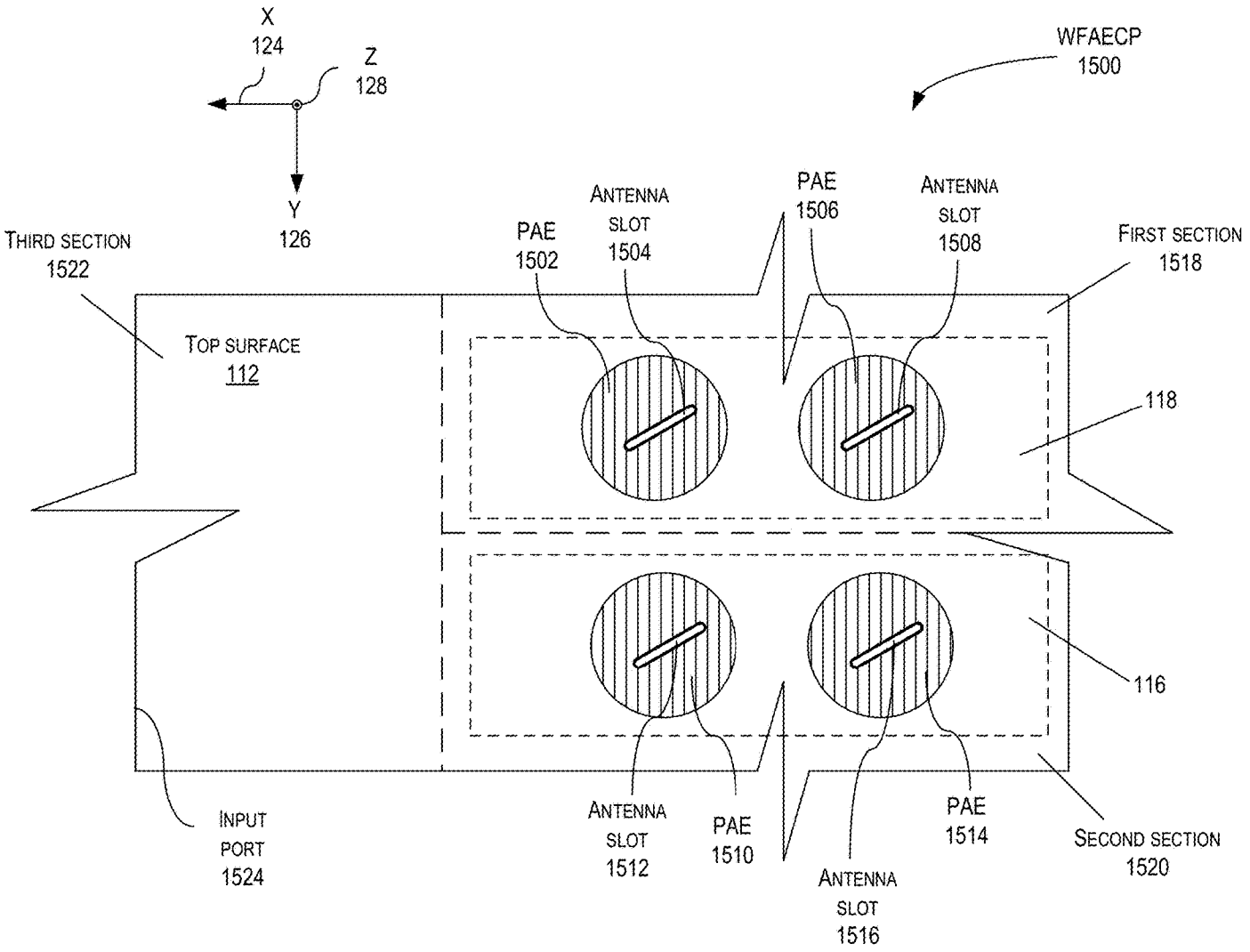
FIG. 15 is a top view of an example of yet another implementation of the WFAECP in accordance with the present disclosure.

In FIG. 15, a top view of an example of yet another implementation of the WFAECP 1500 is shown in accordance with the present disclosure. In this example, the WFAECP 1500 is a parallel and serially fed combination 2×2 array that includes a first PAE 1502 with a first antenna slot 1504, a second PAE 1506 with a second antenna slot 1508, a third PAE 1510 with a third antenna slot 1512, and a fourth PAE 1514 with a fourth antenna slot 1516. It is appreciated that this example may be a simplified illustration of the 4×4 planar antenna array shown in the WFAECP 100 shown FIGS. 1-3 that shows only two PAEs of the four PAEs for two of the four columns of PAEs 116, 118, 120, and 122. In this example, it is assumed that the two columns are first column 116 and second column 118. Moreover, in this example, the first PAE 1502 with a first antenna slot 1504 may be the first PAE 104 and first antenna slot 108 described earlier.

The WFAECP 1500 also includes a first CE, second CE, third CE, and fourth CE that are not shown in this view because they are under the corresponding combinations of PAE and antenna slot. Specifically, the first CE is located under the first PAE 1502 with the first antenna slot 1504, the second CE is located under the second PAE 1506 with the second antenna slot 1508, the third CE is located under the third PAE 1510 with the third antenna slot 1512, and the fourth CE is located under the fourth PAE 1514 with the fourth antenna slot 1516.

In this example, as described earlier, the first PAE 1502, second PAE 1506, third PAE 1510, and fourth PAE 1514 are located on the top surface 112 of the top dielectric layer of the dielectric structure 102. Additionally, the first antenna slot 1504 is located within the first PAE 1502, the second antenna slot 1508 is located within the second PAE 1506, the third antenna slot 1512 is located within the third PAE 1510, and the fourth antenna slot 1516 is located within the fourth PAE 1514. Moreover, in this example, the top surface 112 is shown divided into three sections that include a first section 1518, second section 1520, and third section 1522. The first PAE 1502 with the first antenna slot 1504 and the second PAE 1506 with the second antenna slot 1508 are located within the first section 1518 (that correspond to the second column 118) along with the first CE, second CE, and a first microstrip or stripline (not shown) that are covered by the top surface 112. The third PAE 1510 with the third antenna slot 1512 and the fourth PAE 1514 with the fourth antenna slot 1516 are located within the second section 1520 (that correspond to the first column 116) along with the third CE, fourth CE, and a second microstrip or stripline (not shown) that are also covered by the top surface 112.

In this example, the first and second microstrips are each composed of the inner conductor and bottom conductor (e.g., inner conductor 706 and bottom conductor 400 shown in FIGS. 4-9). In the third section 1522, the WFAECP 1500 includes a power divider (not shown) that is also covered by the top surface 112. The power divider is electrically connected to an input port 1524 that may be the second port 618 or a port for a power divider (not shown) located after the second port 618. In this example, the inner conductors of the first and second microstrips are electrically connected to the power divider and the bottom conductor 400 is a reference ground plane conductor that extends the entire dielectric structure width 210 and the entire WFAECP length 602 of the dielectric structure 102.

Figure 16:
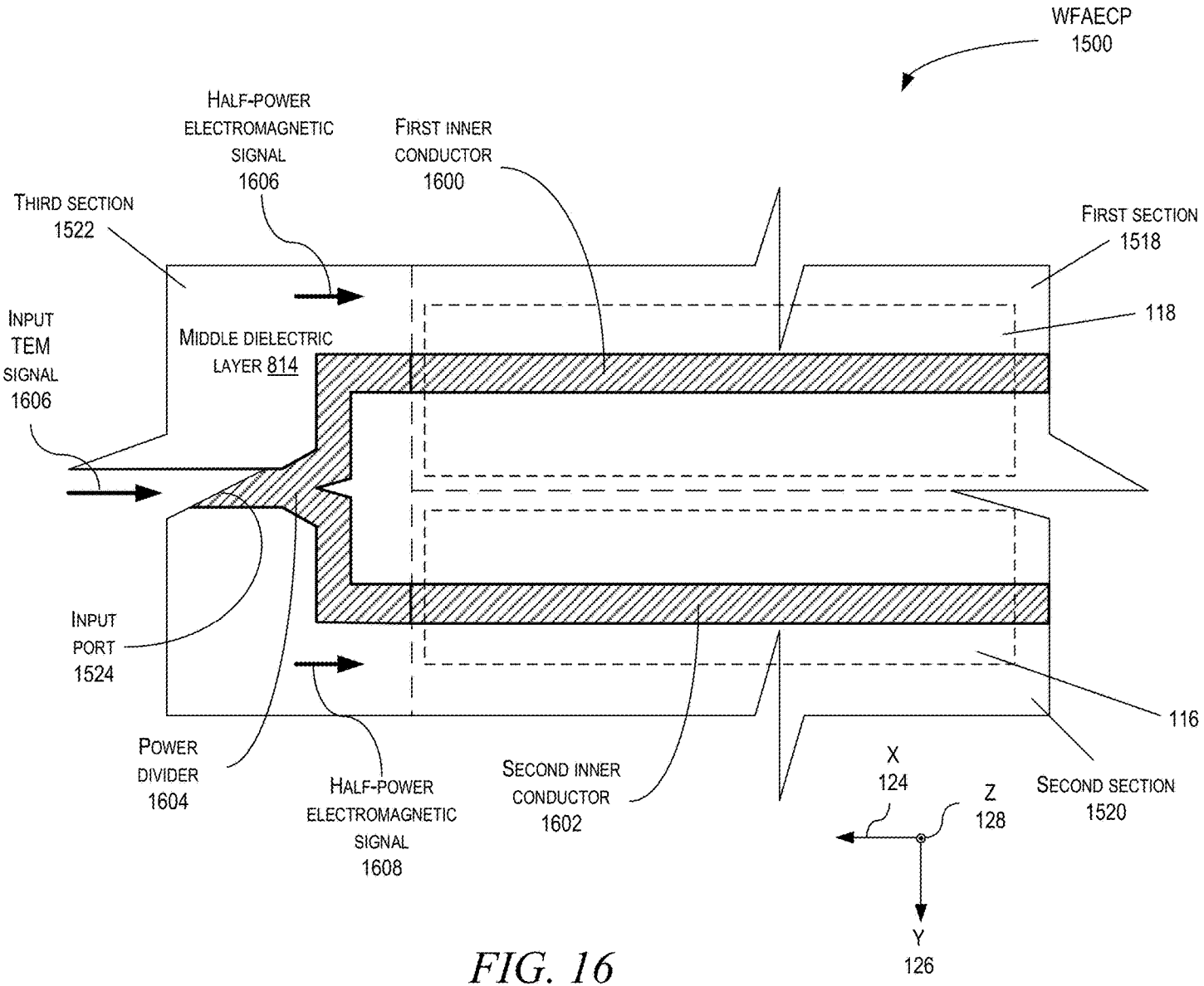
FIG. 16 is a sectional view of the WFAECP along the fourth cutting plane D-D' (shown in FIGS. 8 and 9) of an example of an implementation of a first inner conductor, a second inner conductor, and a power divider in accordance with the present disclosure.

FIG. 16 is a sectional view of the WFAECP along the fourth cutting plane D-D' 810 (shown in FIGS. 8 and 9) of an example of an implementation of a first inner conductor, a second inner conductor, and a power divider in accordance with the present disclosure.

In FIG. 16, a sectional view of the WFAECP 1500 of an example of an implementation of a first inner conductor 1600, a second inner conductor 1602, and a power divider 1604 is shown in accordance with the present disclosure. In this example, the power divider 1604 may be a stripline or microstrip type of power divider that divides an input TEM signal 1606 at the input port 1524 into two equal half-power input electromagnetic signals 1606 and 1608 that are injected into the first inner conductor 1600 and second inner conductor 1602, respectively.

Figure 17:
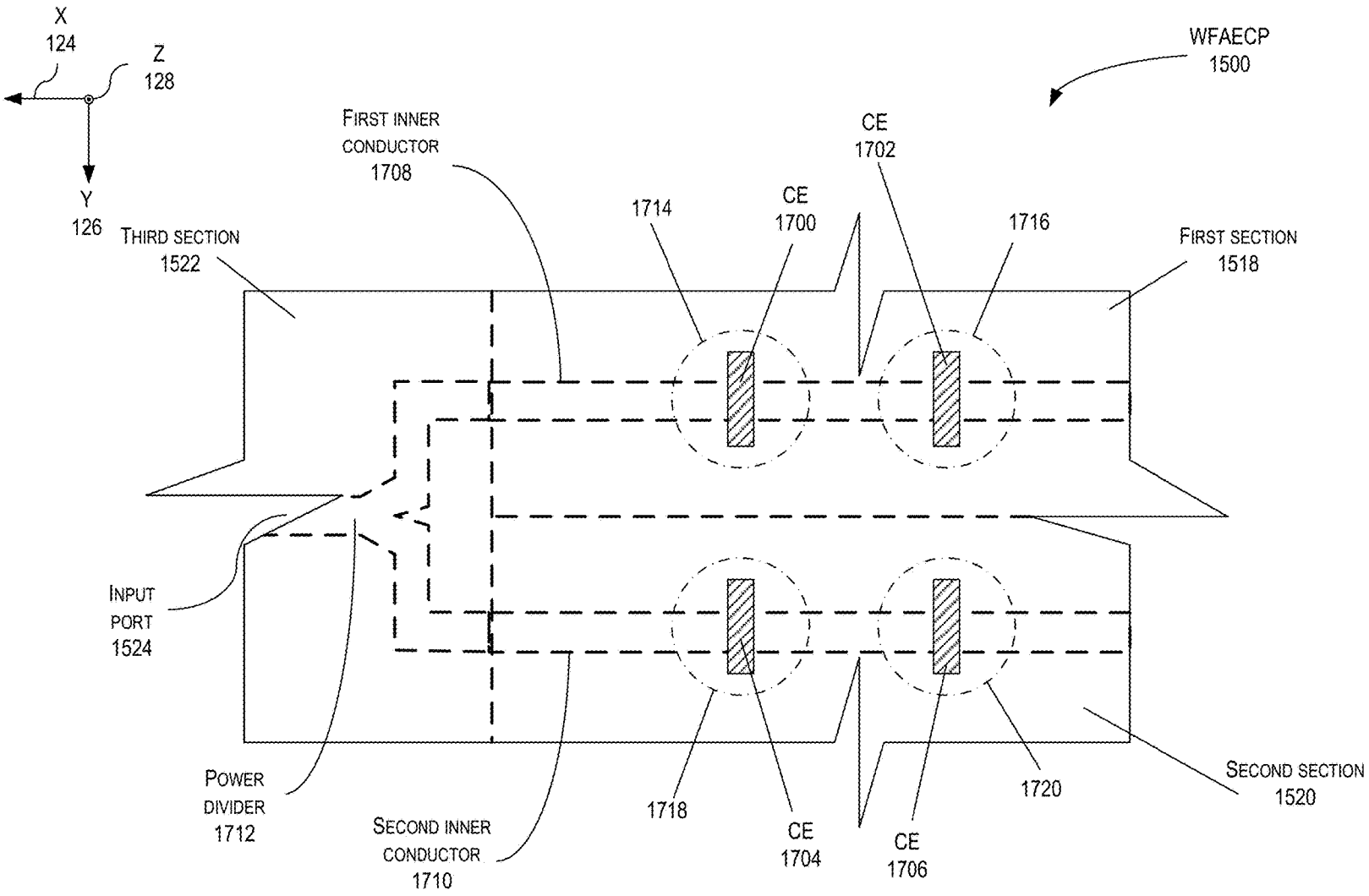
FIG. 17 is a sectional view of the WFAECP (shown in FIGS. 15 and 16) along the fifth cutting plane E-E' (shown in FIGS. 8 and 9) of an example of an implementation of a first CE, a second CE, a third CE, and a fourth CE in accordance with the present disclosure.

FIG. 17 is a sectional view of the WFAECP (shown in FIGS. 15 and 16) along the fifth cutting plane E-E' 812 (shown in FIGS. 8 and 9) of an example of an implementation of a first CE 1700, a second CE 1702, a third CE 1704, and a fourth CE 1706 in accordance with the present disclosure.

In this view an outline 1708 of the hidden first inner conductor 1600, outline 1710 of the hidden second inner conductor 1602, and outline 1712 of the hidden power divider 1604 are shown for purpose of reference position to the first CE 1700, second CE 1702, third CE 1704, and fourth CE 1706.

The first CE 1700 and second CE 1702 are located above the first inner conductor 1600 and the third CE 1704 and fourth CE 1706 are located above the second inner conductor 1602, respectively. An outline 1714 of the first PAE 1502 and outline 1716 of the second PAE 1506 are shown in the first section 1518 above the first CE 1700 and second CE 1702, respectively. Similarly, an outline 1718 of the third PAE 1510 and outline 1720 of the fourth PAE 1514 are shown in the second section 1520 above the third CE 1704 and fourth CE 1706, respectively.

Figure 18:
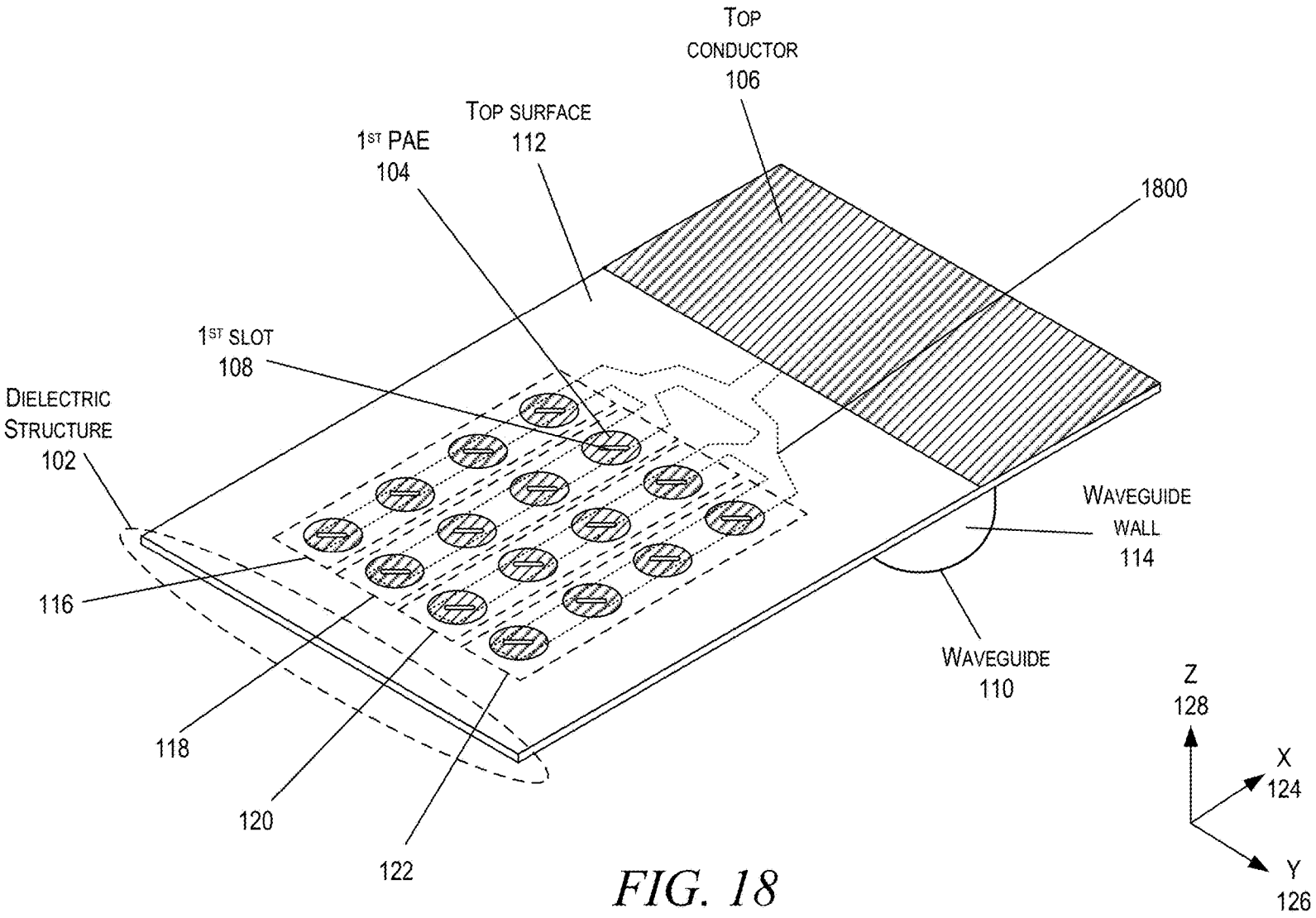
FIG. 18 is a perspective top view of the WFAECP (shown in FIG. 1) with more detail in accordance with the present disclosure.

FIG. 18 is the perspective top view of the WFAECP 100 (shown in FIG. 1) with more detail in accordance with the present disclosure. In this example, the 4×4 planar antenna array is shown with an outline 1800 of a power distribution network for feeding the plurality of PAEs and antenna slots in the four columns 116, 118, 120, and 122. In this example, below each combination of PAE and antenna slot is a corresponding CE (not shown) and below each CE and combination of PAE and antenna slot is an inner conductor as part of the power distribution network. In this example there are 16 CEs, 16 PAEs, 16 antenna slots, and four (4) inner conductors. Each column 116, 118, 120, and 122 has a corresponding inner conductor of the four inner conductors.

Figure 19:
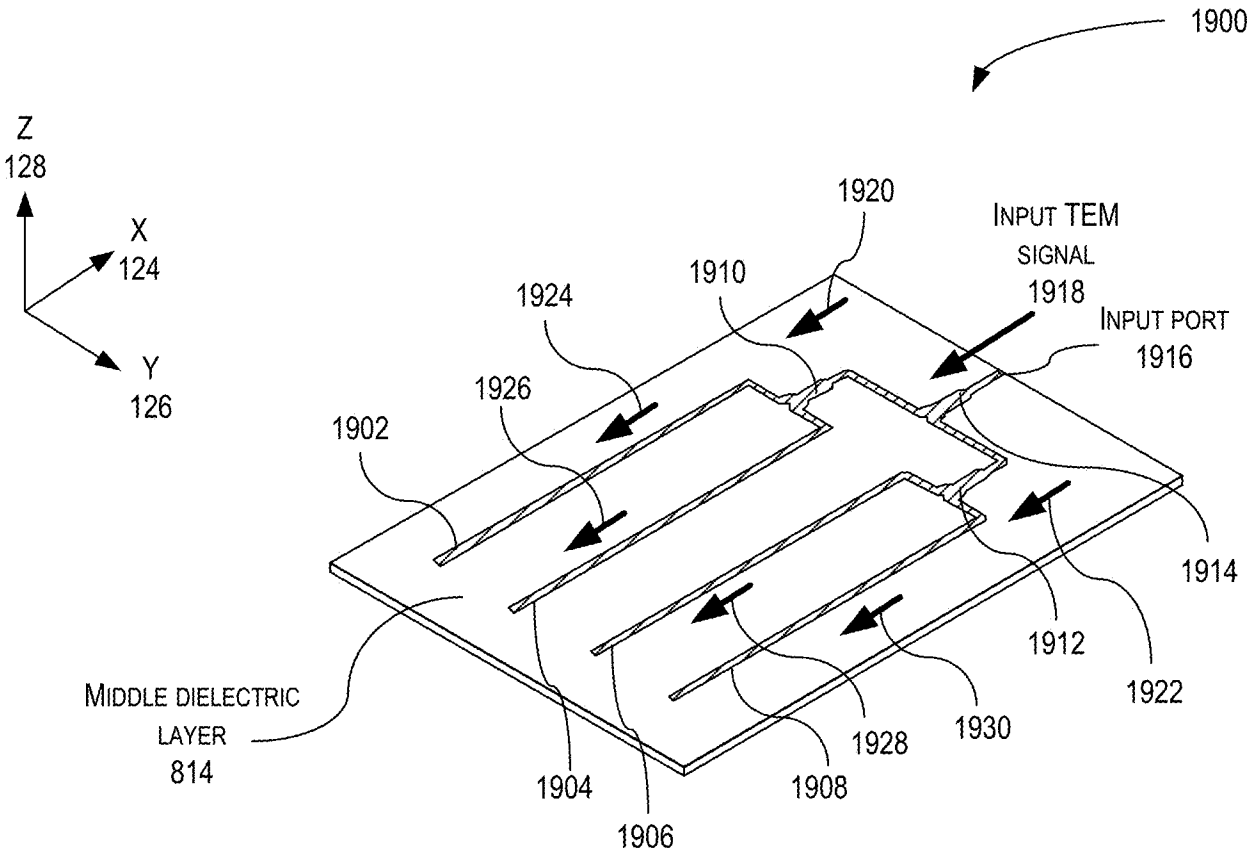
FIG. 19 is a perspective cross-sectional view of a portion of the WFAECP (shown in FIG. 18) in accordance with the present disclosure.

Turning to FIG. 19, a perspective cross-sectional view of a portion 1900 the WFAECP 100 (shown in FIG. 18) is shown in accordance with the present disclosure. In this example, four inner conductors 1902, 1904, 1906, and 1908 are shown. The first inner conductor 1902 is located under the first column 116 of PAEs, antenna slots, and CEs. The second inner conductor 1904 is located under the second column 118 of PAEs, antenna slots, and CEs. The third inner conductor 1906 is located under the third column 120 of PAEs, antenna slots, and CEs. The fourth inner conductor 1908 is located under the fourth column 122 of PAEs, antenna slots, and CEs. The first inner conductor 1902 and second inner conductor 1904 are in signal communication via a first power divider 1910 and the third inner conductor 1906 and fourth inner conductor 1908 are in signal communication via a second power divider 1912. The first power divider 1910 and second power divider 1912 are in signal communication via a third power divider 1914 that is in signal communication with an input port 1916. The combined first inner conductor 1902, second inner conductor 1904, third inner conductor 1906, fourth inner conductor 1908, first power divider 1910, second power divider 1912, and third power divider 1914 are the power distribution network for the 4×4 planar antenna array.

In this example, the third power divider 1914 may be a stripline or microstrip type of power divider that divides an input TEM signal 1918 at the input port 1916 into two equal half-power input electromagnetic signals 1920 and 1922 that are injected into the first power divider 1910 and second power divider 1912, respectively. The first half-power input electromagnetic signal 1920 is divided into two equal quarter-power equivalent input electromagnetic signals 1924 and 1926 (with respect to input TEM signal 1918) and the second half-power input electromagnetic signal 1922 is divided into two equal quarter-power equivalent input electromagnetic signals 1928 and 1930 (with respect to input TEM signal 1918).

In this example, the first quarter-power input electromagnetic signal 1924 travels along the first inner conductor 1902 and excites each of the four combinations of the CEs, PAEs, and antenna slots along the first column 116 and the second quarter-power input electromagnetic signal 1926 travels along the second inner conductor 1904 and excites each of the four combinations of the CEs, PAEs, and antenna slots along the second column 118.

The third quarter-power input electromagnetic signal 1928 travels along the third inner conductor 1906 and excites each of the four combinations of the CEs, PAEs, and antenna slots along the third column 120 and the fourth quarter-power input electromagnetic signal 1930 travels along the fourth inner conductor 1908 and excites each of the four combinations of the CEs, PAEs, and antenna slots along the fourth column 122.

The resulting excitations of each of the combination of the CE, PAE, and antenna slot produce a corresponding radiated signal for each combination of the CE, PAE, and antenna slot. In this example, the first, second, third, and fourth inner conductors 1902, 1904, 1906, and 1908 and the first, second, and third power dividers 1910, 1912, and 1914 may be located within the middle dielectric layer 814.

Figure 20:
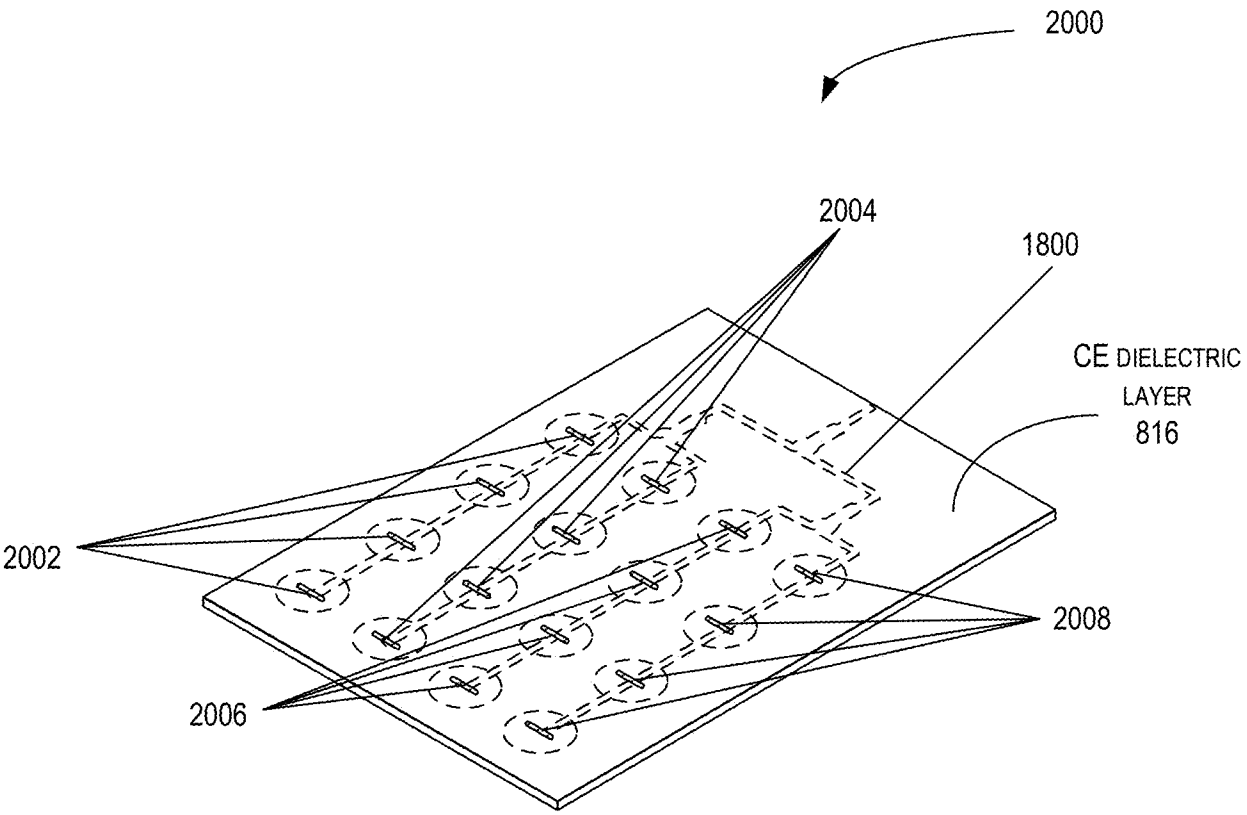
FIG. 20 is another perspective sectional view of a portion of the WFAECP (shown in FIGS. 18 and 19) in accordance with the present disclosure.

In FIG. 20, another perspective sectional view of a portion 2000 of the WFAECP 100 (shown in FIGS. 18 and 19) is shown in accordance with the present disclosure. In this example, four sets 2002, 2004, 2006, and 2008 of CEs are shown where the first set 2002 of CEs correspond to the first column 116 of PAEs and antenna slots, the second set 2004 of CEs correspond to the second column 118 of PAEs and antenna slots, third set 2006 of CEs correspond to the third column 120 of PAEs and antenna slots, and fourth set 2008 of CEs correspond to the fourth column 122 of PAEs and antenna slots.

In this example, the CEs of the four sets 2002, 2004, 2006, and 2008 of CEs are shown in the CE dielectric layer 816 that is the dielectric layer above the middle dielectric layer 814 shown in FIG. 19. For purposes of illustration the outline 1800 of the power distribution network first is shown in relation to the four sets 2002, 2004, 2006, and 2008 of CEs. Additionally, outlines of the PAEs of first, second, third, and fourth columns 116, 118, 120, and 122 of the combination PAE and antenna slot are also shown in relation to the four sets 2002, 2004, 2006, and 2008 of CEs.

Figure 21:
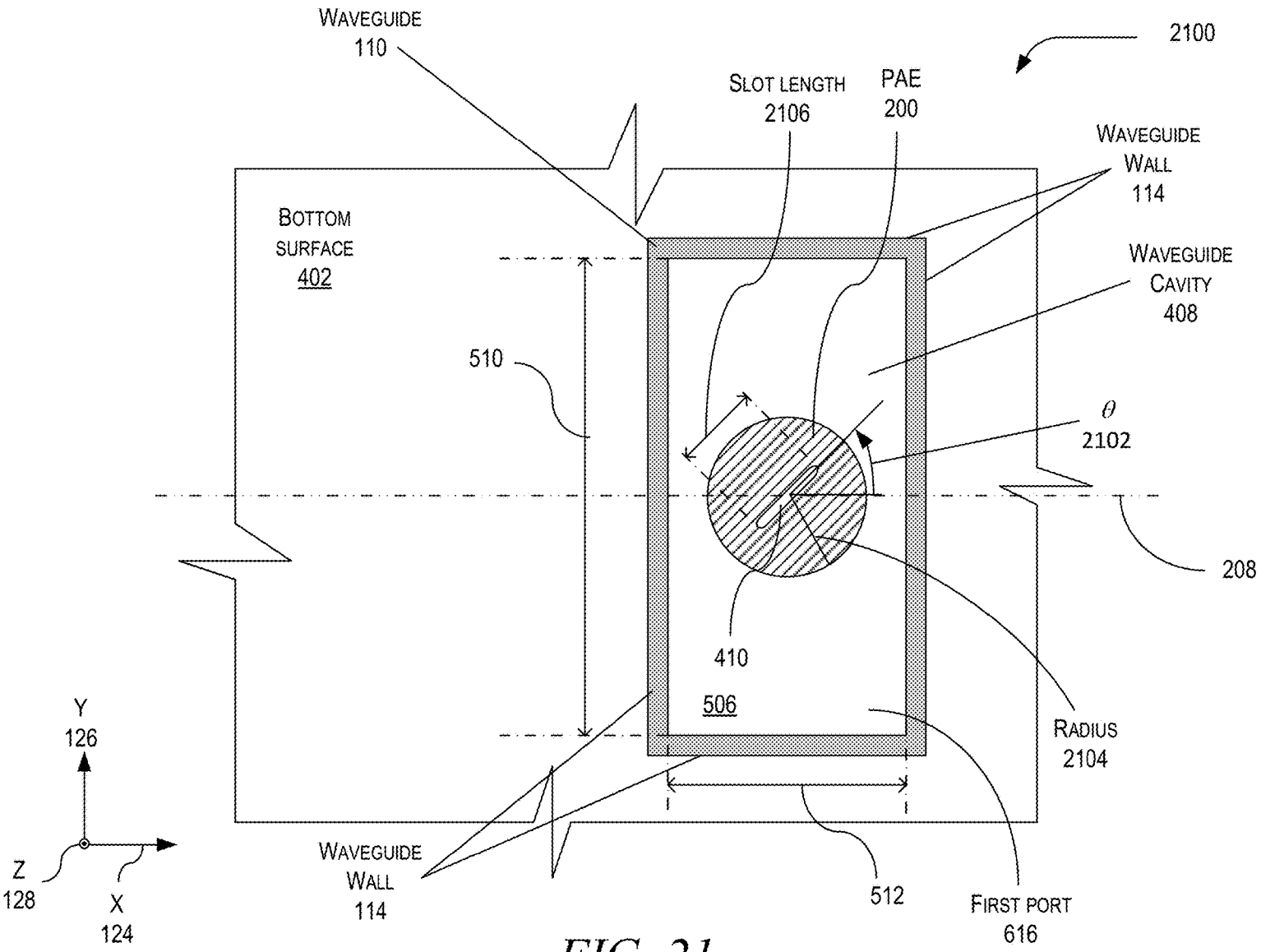
FIG. 21 is a zoomed-in view of a portion the second PAE and second antenna slot within the WFAECP in accordance with the present disclosure.

Turning to FIG. 21, a zoomed-in view of a portion 2100 the second PAE 200 and second antenna slot 410 within the WFAECP 100 are shown in accordance with the present disclosure. In this example, the second antenna slot 410 is shown within the PAE 200 at an angle θ 2102 with respect to the inner conductor 706 along the first center position 208. In this example, the second antenna slot 410 is shown to be centered about the first center position 208. The angle θ 2102 may be negative or positive. In this example, the PAE 200 is shown to have a circular shape with a PAE radius 2104. As discussed earlier, the geometry (or shape), dimensions (e.g., radius, thickness), and position of the PAE 200 along the bottom surface 402 and the geometry and dimensions of the second antenna slot 410 within the PAE 200 determine the electromagnetic characteristics of a radiated output signal 624 or received input signal 610. Moreover, in this example, the PAE 200 is circular with the radius 2104 and the second antenna slot 410 has a slot length 2106. In general, the radius 2104 of the PAE 200 and the slot length 2106 are predetermined to enhance and approximately optimize/maximize the either the radiated output signal 624 or the received input signal 610 produced by the optional CE 800 and PAE 200 (with the second antenna slot 410) at a predetermined operating frequency. It is appreciated by those of ordinary skill in the art that other geometries may also be utilized in the present disclosure without departing from the spirit or principles disclosed herein.

Figure 22:
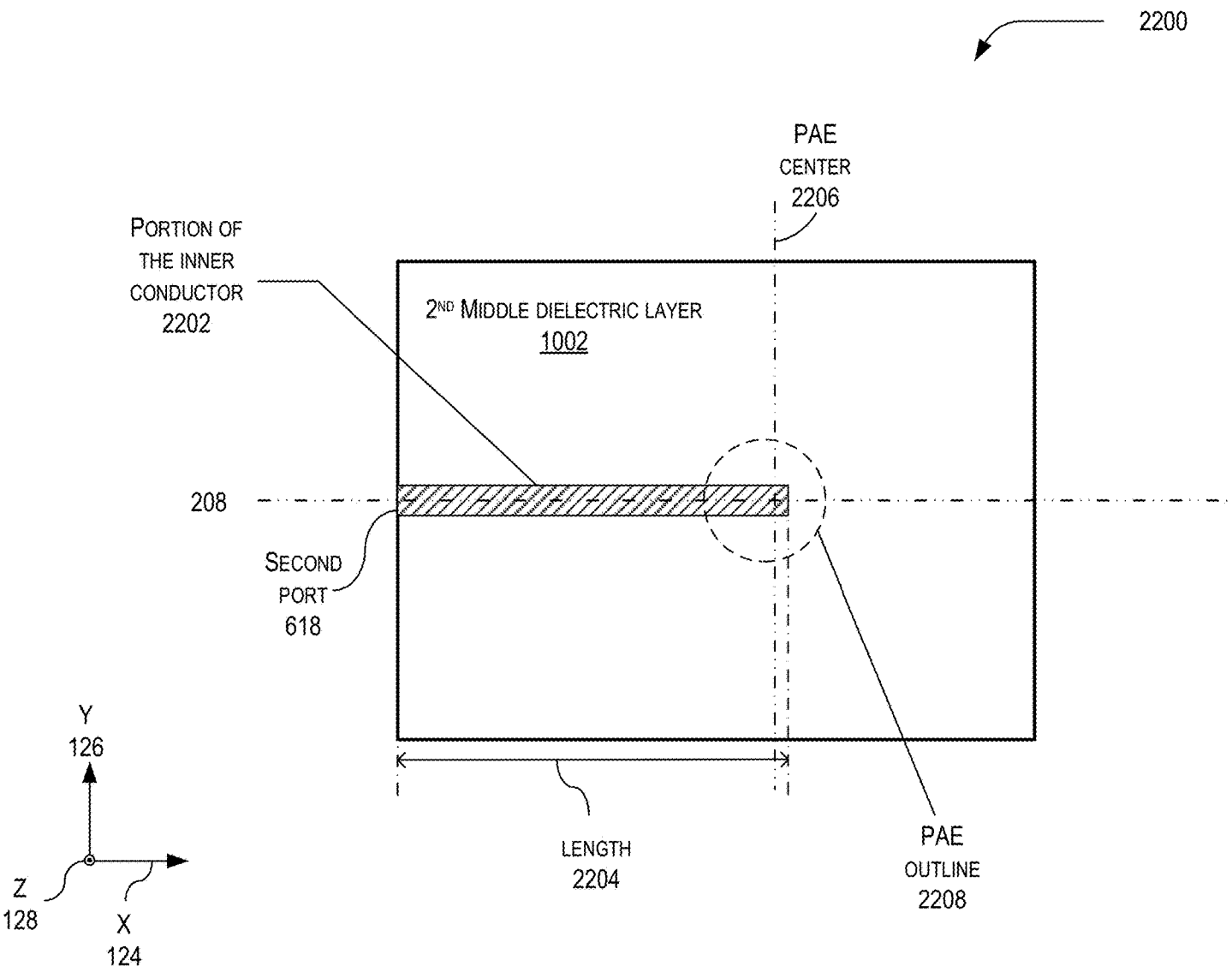
FIG. 22 is a sectional view of a portion of the WFAECP cut along the sixth cutting plane F-F' (shown in FIG. 10) showing a portion of the inner conductor running in the direction of the X-axis in accordance with the present disclosure.

FIG. 22 is a sectional view of a portion 2200 of the WFAECP 100 cut along the sixth cutting plane F-F' 1006 showing a portion 2202 of the inner conductor 706 running in the direction of the X-axis 124 in accordance with the present disclosure. In this example, the portion 2202 of the inner conductor 706 is shown to be within the plurality of dielectric layers 708 in the second middle dielectric layer 1002 of the dielectric structure 102 between two other dielectric layers (not shown). A length 2204 of portion 2202 of the inner conductor 706 extends from the second port 618 to a location under the PAE 200 that may be approximately at or near a PAE center 2206. In this example, a PAE outline 2208 of the PAE 200 is shown for reference.

Figure 23:
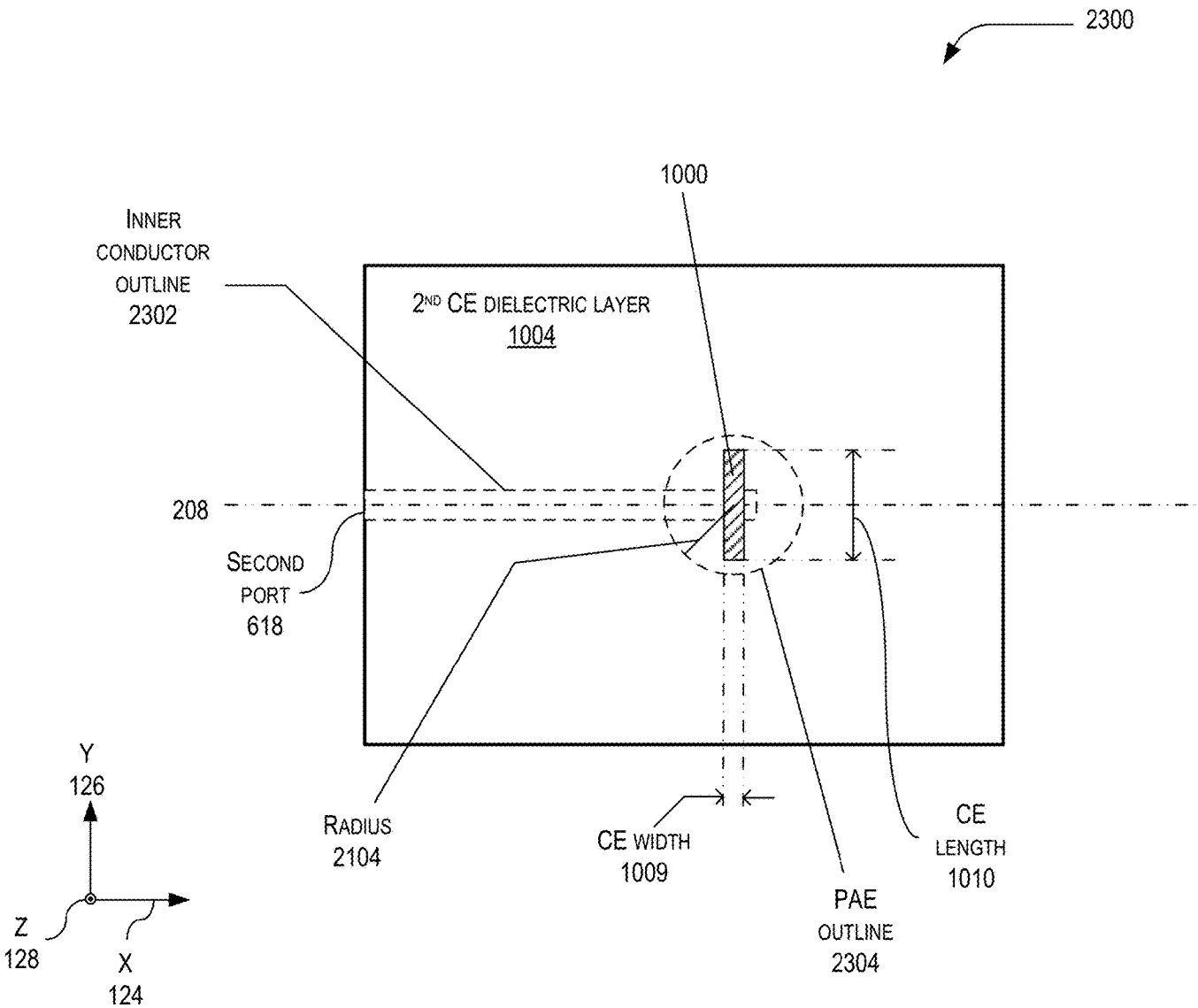
FIG. 23 is a sectional view of a portion of the WFAECP along the seventh cutting plane G-G' (shown in FIG. 10) showing the CE in accordance with the present disclosure.

FIG. 23 is a sectional view of a portion 2300 of the WFAECP 100 along the seventh cutting plane G-G' 1012 showing the CE 1000 in accordance with the present disclosure. In this example, the CE 1000 is shown as a stub that has the CE length 1010 that is approximately orthogonal to the inner conductor length 732 of the inner conductor 706 and CE width 1009. In this view, the inner conductor 706 is located within the plurality of dielectric layers 708 above the second CE dielectric layer 1004. The inner conductor 706 is located above the CE 1000 and is not visible. Moreover, the second PAE 200 and antenna slot 410 are located below the CE 1000 and bottom dielectric layer 702 and are also not visible. As such, in this view, an inner conductor outline 2302 of the inner conductor 706 and the second PAE outline 2304 of the second PAE 200 are shown for purposes of illustration. The inner conductor outline 2302 is centered about the first center position 208. In this example, the CE 1000 is located above the PAE 200 within the PAE outline 2304 where the CE length 1010 is less than or equal to the second PAE diameter 1014 (i.e., twice the radius 2104) of the PAE outline 2304 and extends approximately orthogonally from the inner conductor outline 2302. In general, the CE length 1010 and CE width 1009 are predetermined to enhance and approximately optimize the radiated or received signals (i.e., output signal 624 or input signal 610) of the combined second PAE 200 and second antenna slot 410 at a predetermined operating frequency.

In this disclosure, the inner conductor 706, CE 1000, and second PAE 200 are designed to be electrically coupled to one another at a predetermined operating frequency. In an example of operation, in one direction, the output TEM signal inserted from the second port 618 travels down the combination of the inner conductor 706 and top conductor 106, then electrically couples through the dielectric structure 102 to the CE 1000 where the current of the signal is rotated due to the orientation of CE 1000 with respect to the inner conductor 706. The signal then electrically couples from CE 1000 through the dielectric structure 102 to the second PAE 200 where the current of the signal further rotates due to the orientation of second PAE 200 with respect to CE 1000. The circularly polarized radiated signal is then radiated into the waveguide cavity 408 and propagated along the waveguide 110 as the output signal 624. In the opposite direction, the input signal 610 injected into the first port 616 travels along the waveguide length 612 until it reaches the combined second PAE 200 and second antenna slot 410. The input signal 610 induces coupling between the combined second PAE 200 and second antenna slot 410 and inner conductor 706 though the CE 1000. The resulting coupled signal is rotated in the opposite direction and transmitted along the combination of the inner conductor 706 and top conductor 106 towards the second port 618 as an input TEM signal.

Figure 24:
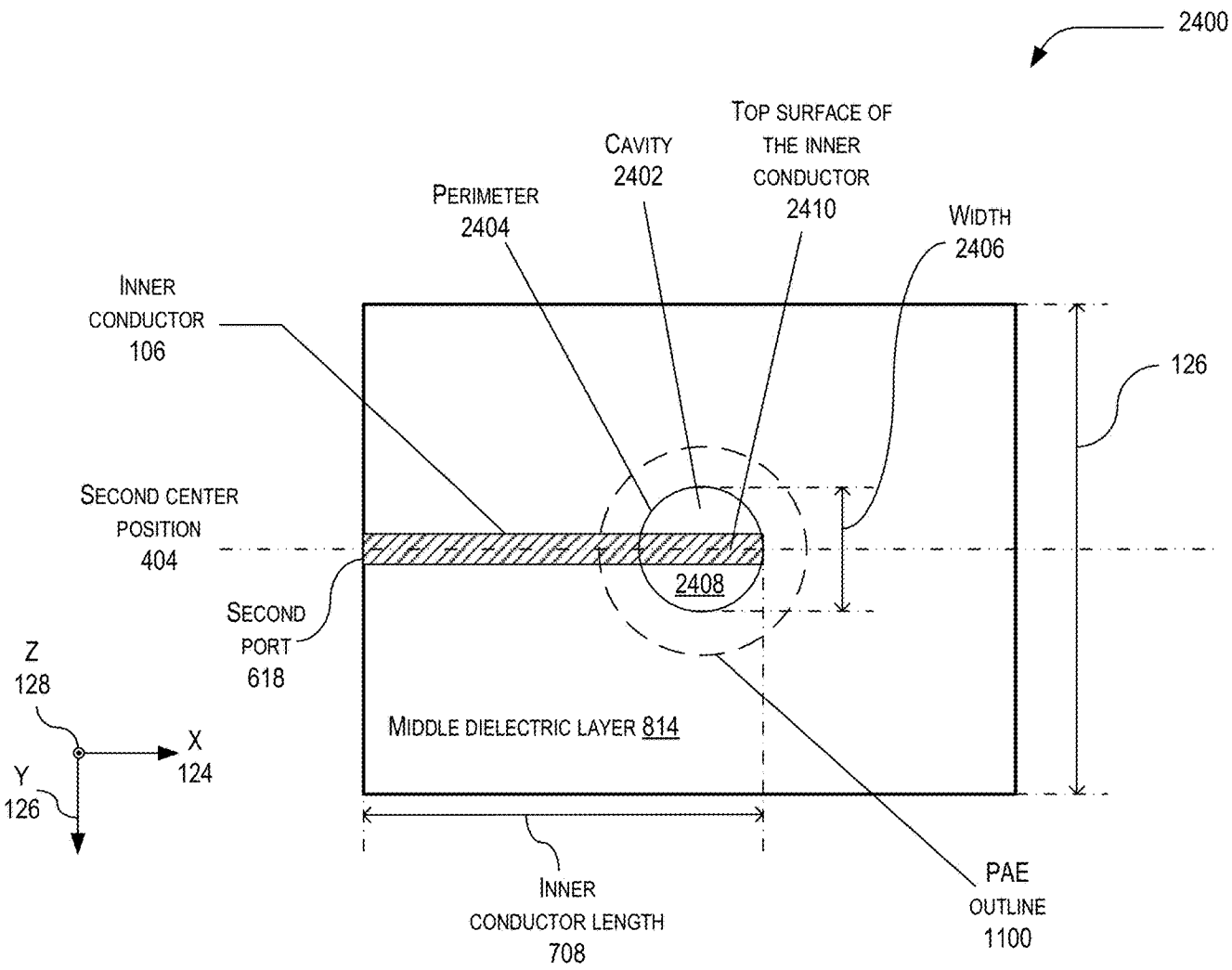
FIG. 24 is a sectional view of a portion of the WFAECP cut along the fourth cutting plane D-D' (shown in FIG. 9) showing an example of an implementation of the single cavity in accordance with the present disclosure.

FIG. 24 is a sectional view of a portion 2400 of the WFAECP 100 cut along the fourth cutting plane D-D' 810 showing an example of an implementation of the single cavity 2402 in accordance with the present disclosure. In this example, the inner conductor 706 is shown to be in the middle dielectric layer 814 of the dielectric structure 102. The cavity 2402 is also shown within the dielectric structure 102 around and above the inner conductor 706. The cavity 2402 has a perimeter 2404 that is circular with a diameter equal to the cavity width 2406. In this example, the cavity 2402 is shown to cut through the middle dielectric layer 814 exposing a bottom surface 2408 of the dielectric layer below the middle dielectric layer 814. The cavity 2402 is located below the first PAE 104 and the CE 800 and around and above the inner conductor 706. The cavity width 2406 is approximately equal to or less than the PAE diameter 906. In this example, the cavity 2402 is air filled and has a cavity width 2406 and a height 810 occupying the space around the inner conductor 706 and above a top surface 2410 of the inner conductor 706. The cavity 2402 may be adjacent to the sides of a portion of the inner conductor 706. In general, the cavity width 2406 is a predetermined value that is based on the design of the WFAECP 100 such as to enhance and approximately optimize the gain and bandwidth of the CE 800 and first PAE 104 with the first antenna slot 108. While only a single cavity 2402 is shown in this example, it is appreciated that in other examples may include multiple cavities within the middle dielectric layer 814.

Figure 25:
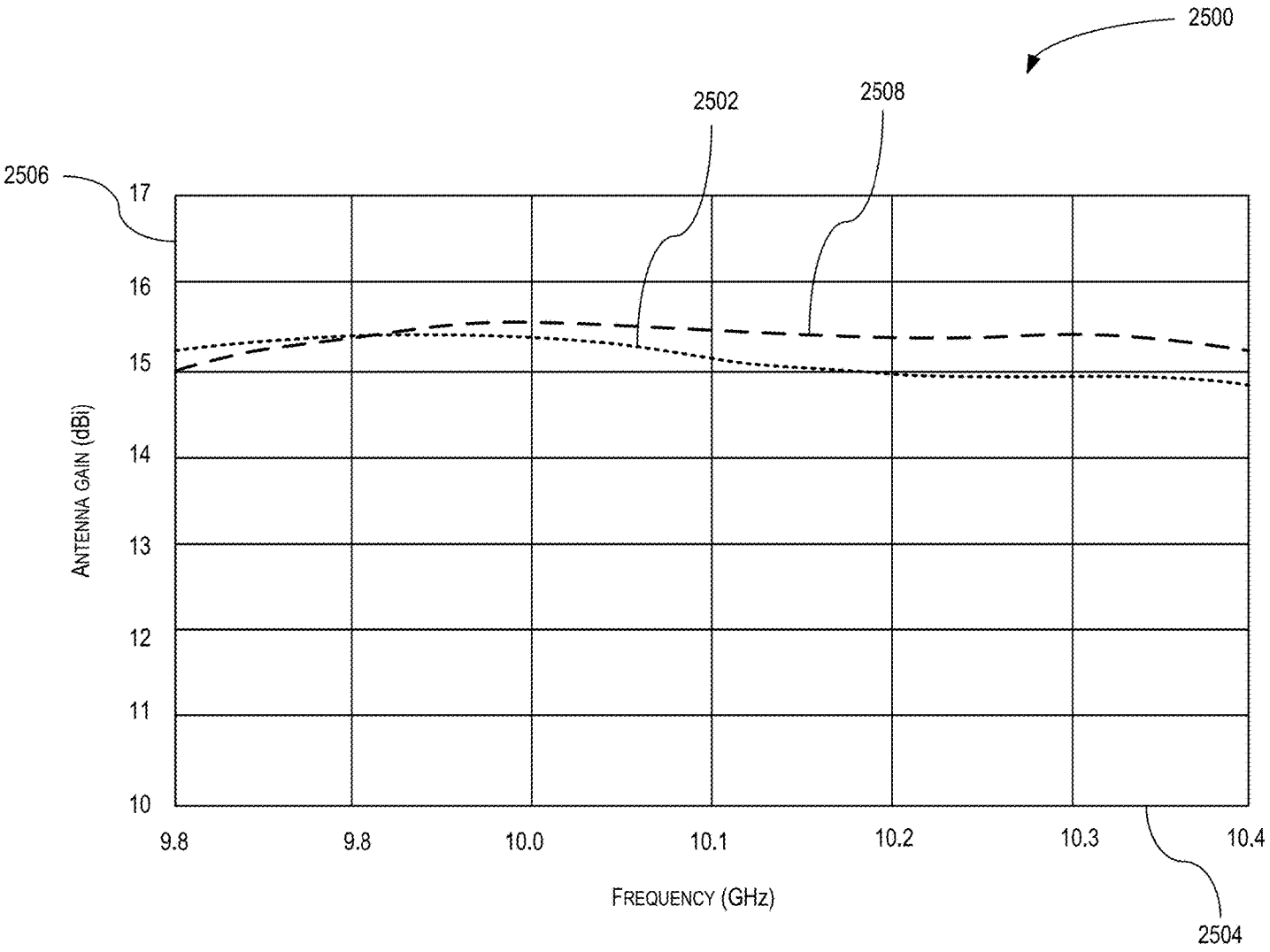
FIG. 25 is a graph of a plot of an example of an antenna gain of the WFAECP as a function of frequency in accordance with the present disclosure.

As an example of operation, in FIG. 25, a graph 2500 of a plot 2502 is shown of an example of an antenna gain of the WFAECP 100 as a function of frequency in accordance with the present disclosure. In this example, the horizontal axis 2504 represents the frequency in gigahertz ("GHz") and the vertical axis 2506 represents the antenna gain in decibels relative to an isotropic radiator ("dBi"). The horizontal axis 2504 varies from 9.8 to 10.4 GHz and the vertical axis 2506 varies from 10 to 17 dBi. In this example, the WFAECP 100 is the 4×4 antenna array designed to operate at approximately 10 GHz and the surface dimensions of the 4×4 antenna array are approximately 129 mm by 76 mm and the dielectric structure has four (4) dielectric layers totaling approximately 40 mil Pyralux®. For purposes of comparison, a second plot 2508 of the antenna gain of a similar 4×4 antenna array without CEs is also shown.

Figure 26:
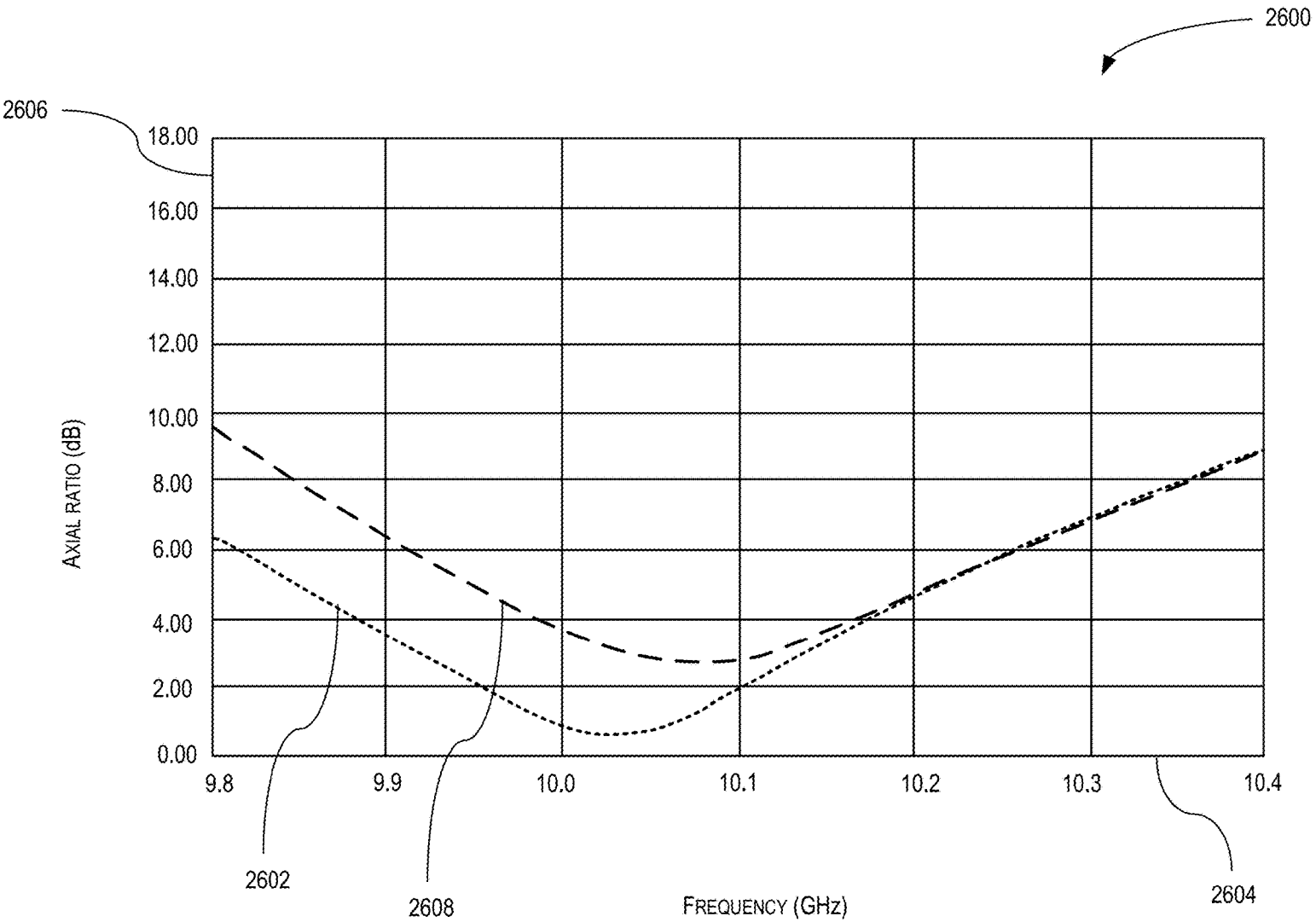
FIG. 26 is a graph of a plot of an example of an axial ratio of the WFAECP as a function of frequency in accordance with the present disclosure.

In FIG. 26, a graph 2600 of a plot 2602 is shown of an example of an axial ratio of the WFAECP 100 as a function of frequency in accordance with the present disclosure. Similar to FIG. 25, in this example, the horizontal axis 2604 represents the frequency in GHz and the vertical axis 2606 represents the axial ratio in decibels ("dB"). The horizontal axis 2604 varies from 9.8 to 10.4 GHz and the vertical axis 2606 varies from 0 to 18 dB.

In this example, the WFAECP 100 is again the 4×4 antenna array designed to operate at approximately 10 GHz. Again, the surface dimensions of the 4×4 antenna array are approximately 129 mm by 76 mm and the dielectric structure has four (4) dielectric layers totaling approximately 40 mil Pyralux®. For purposes of comparison, a second plot 2608 of the axial ratio of a similar 4×4 antenna array without CEs is also shown. From the comparison, it is appreciated that the presence of the CEs shows improvement in the axial ratio with a 2:1 axial ratio bandwidth of greater than 200 MHz.

Figure 27A:
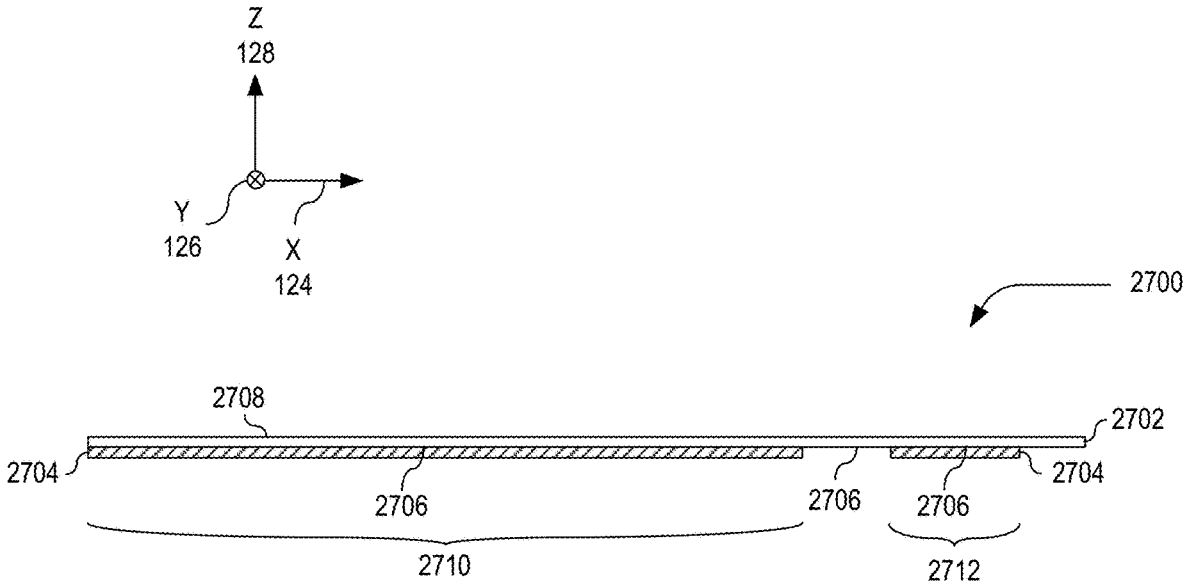
FIG. 27A is a sectional side-view of a first section of the WFAECP in accordance with the present disclosure.
Figure 27B:
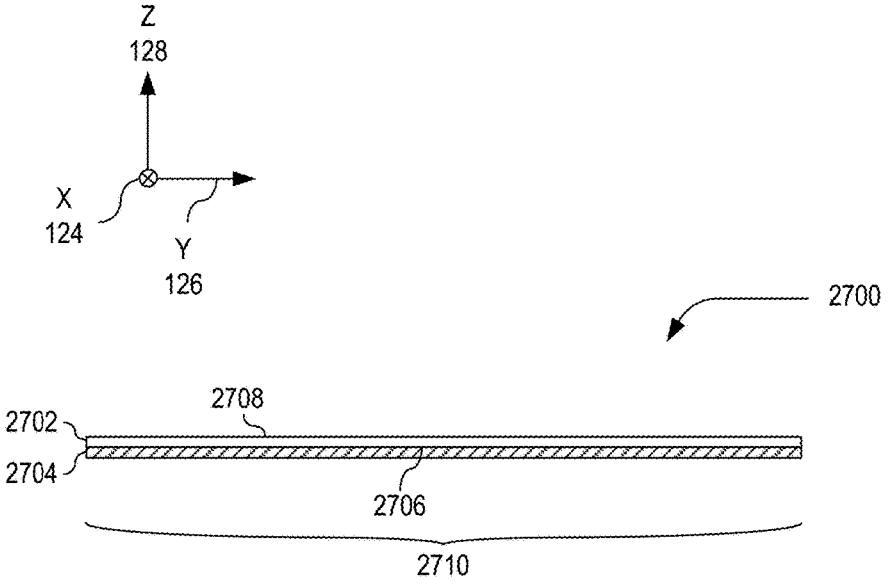
FIG. 27B is a corresponding sectional front-view of the first section of the WFAECP in accordance with the present disclosure.
Figure 27C:
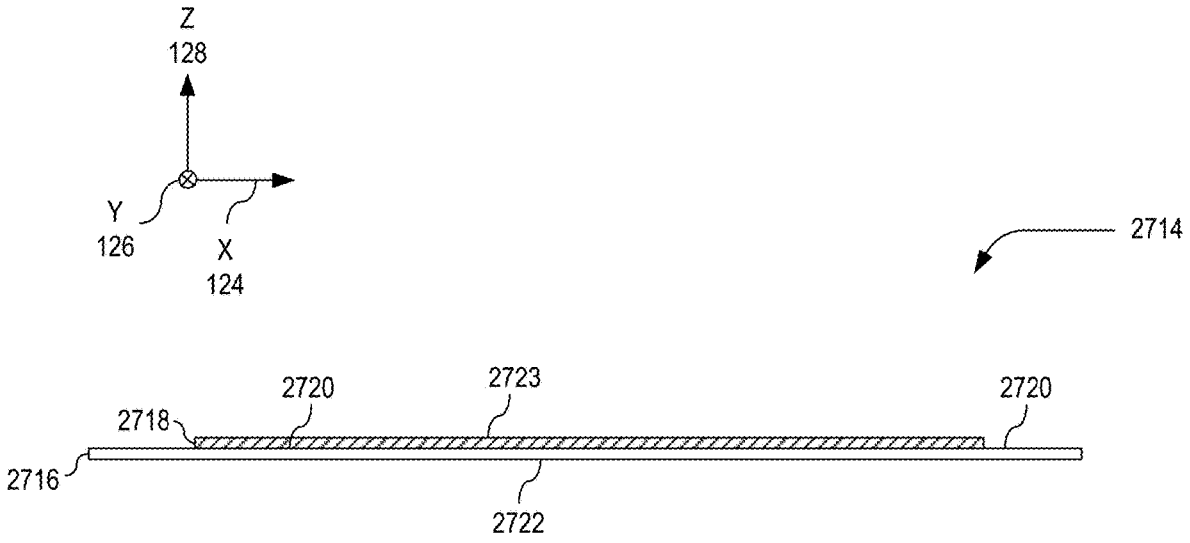
FIG. 27C is a sectional side-view of a second section of the WFAECP in accordance with the present disclosure.
Figure 27D:
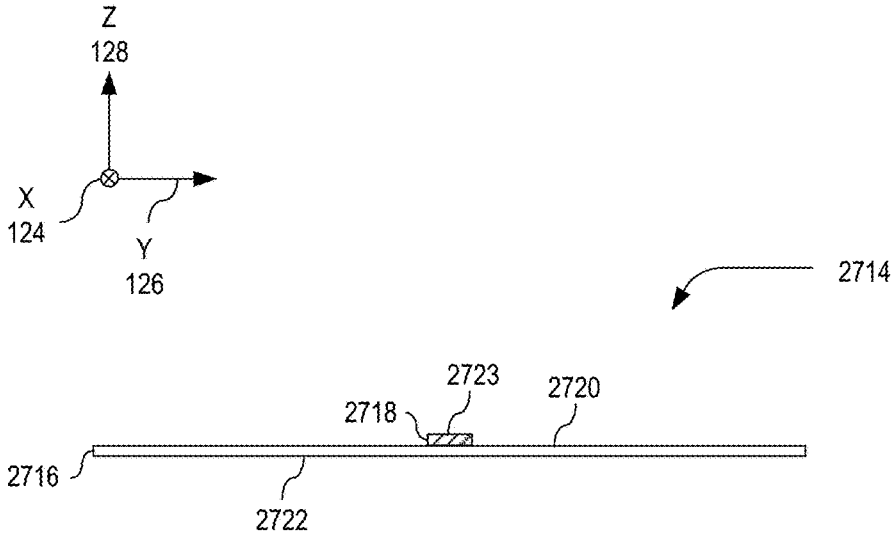
FIG. 27D is a corresponding sectional front-view of the second section of the WFAECP in accordance with the present disclosure.
Figure 27E:
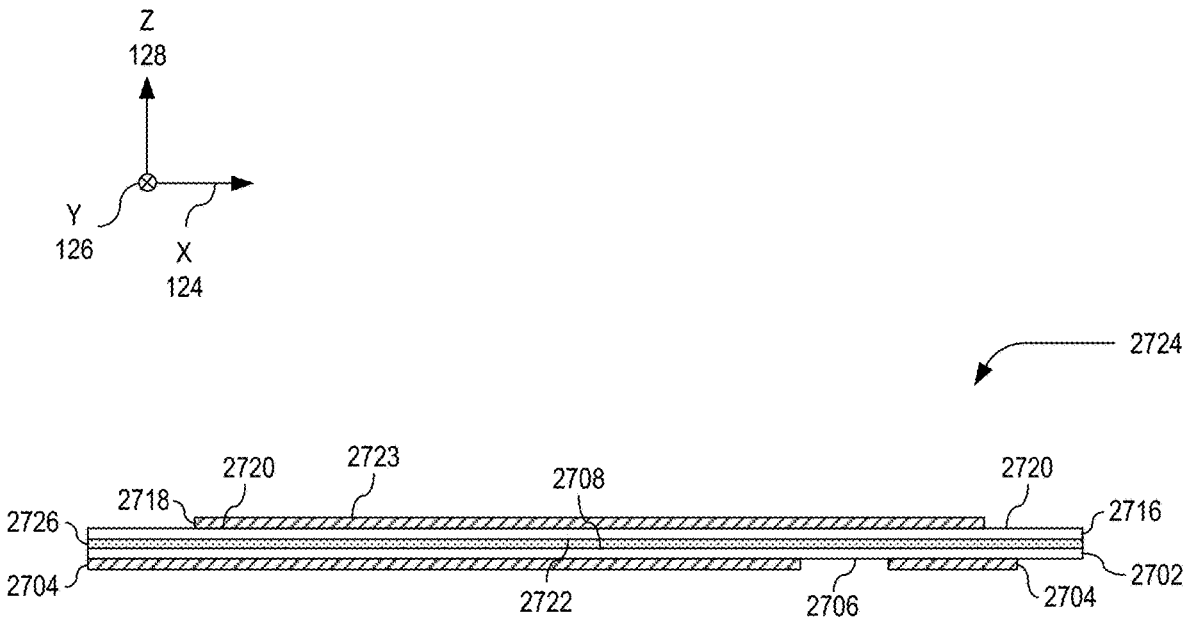
FIG. 27E is a sectional side-view of a first combination of the first section and the second section of the WFAECP in accordance with the present disclosure.
Figure 27F:
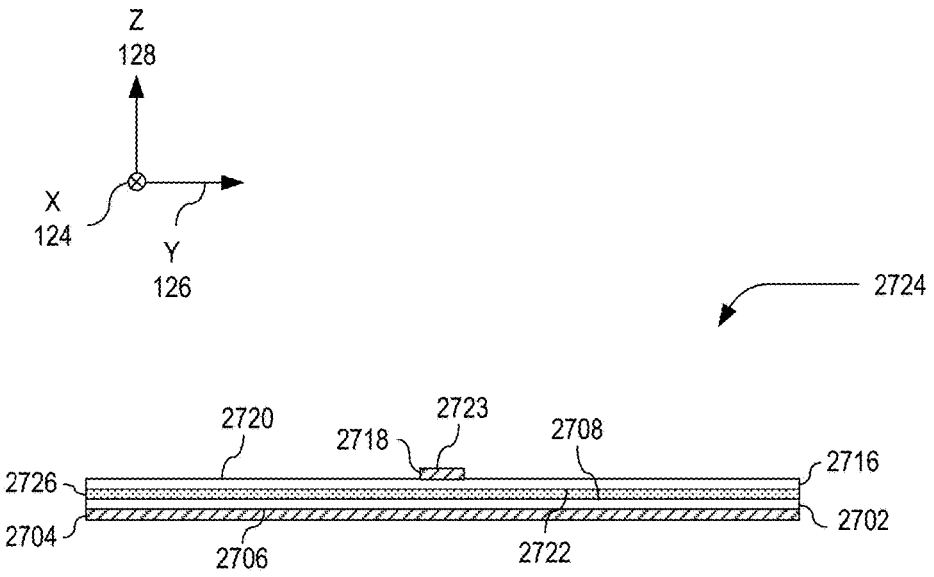
FIG. 27F is a corresponding sectional front-view of the first combination of the WFAECP in accordance with the present disclosure.
Figure 27G:
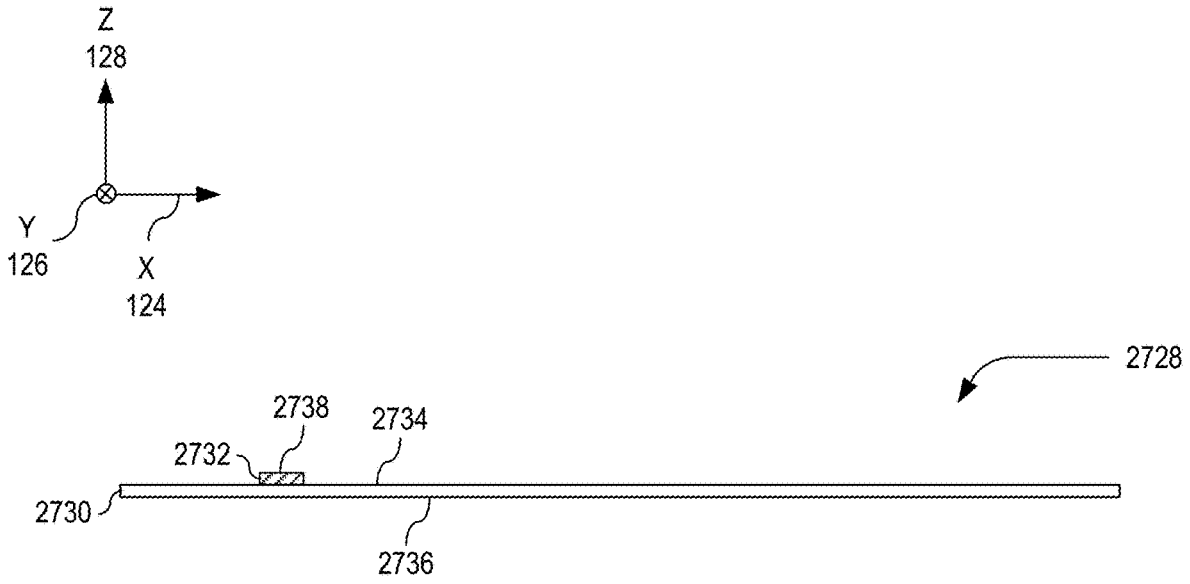
FIG. 27G is a sectional side-view of a third section of the WFAECP in accordance with the present disclosure.
Figure 27H:
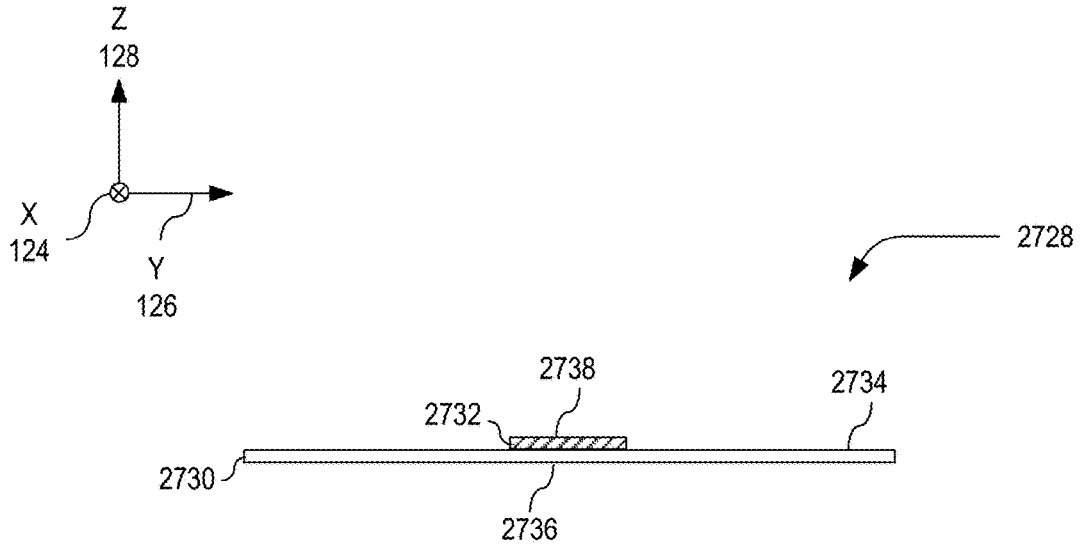
FIG. 27H is a corresponding sectional front-view of the third section of the WFAECP in accordance with the present disclosure.
Figure 27I:
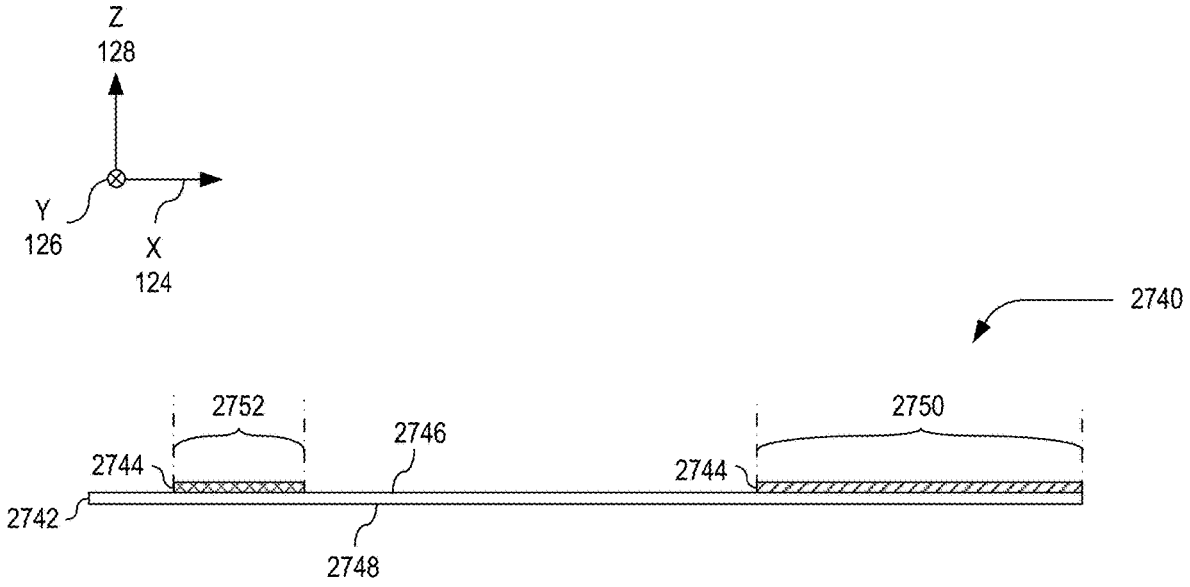
FIG. 27I is a sectional side-view of a fourth section of the WFAECP in accordance with the present disclosure.
Figure 27J:
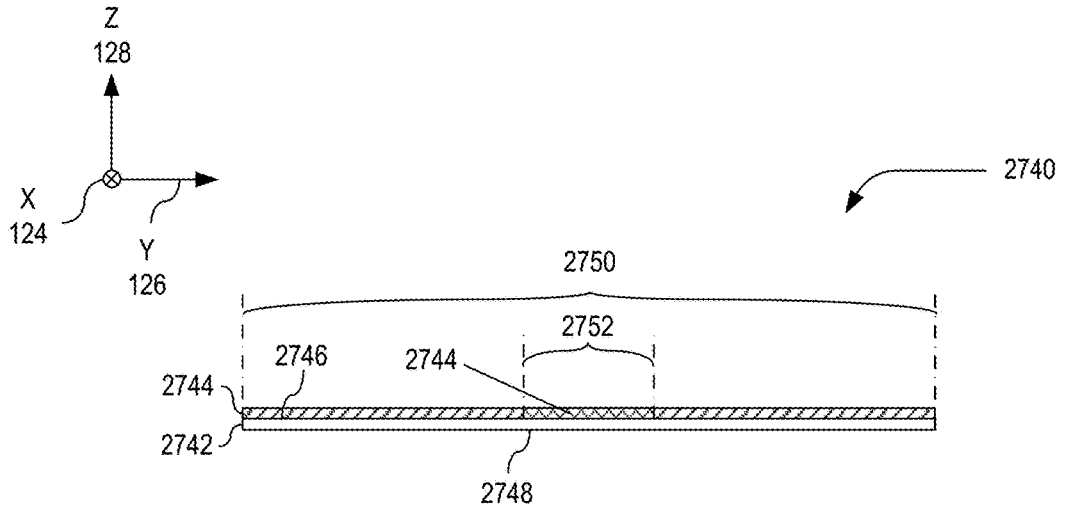
FIG. 27J is a corresponding sectional front-view of the fourth section of the WFAECP in accordance with the present disclosure.
Figure 27K:
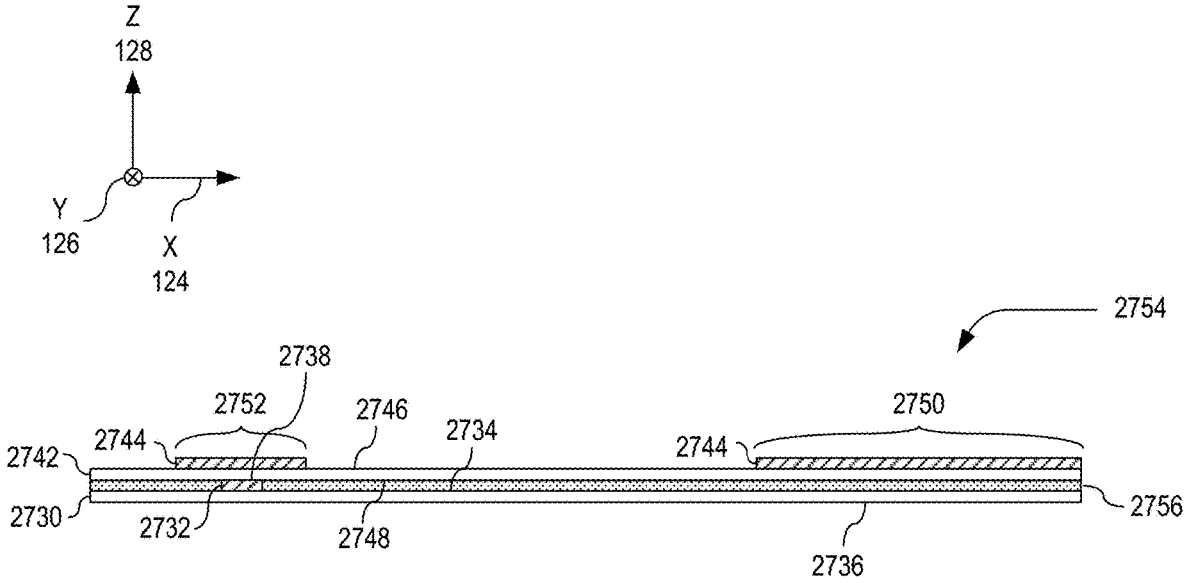
FIG. 27K is a sectional side-view of a second combination of the third section and the fourth section of the WFAECP is shown in accordance with the present disclosure.
Figure 27L:
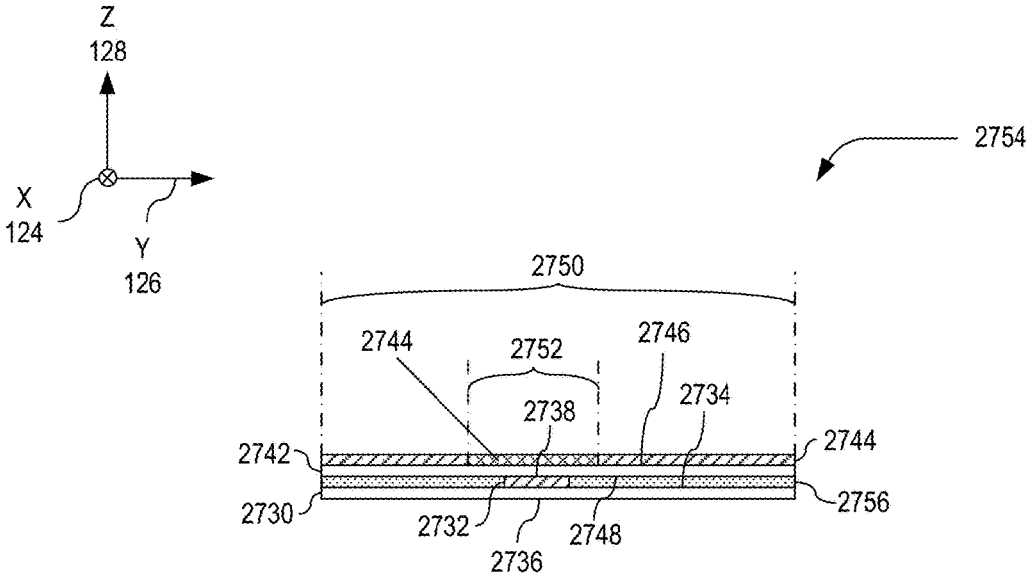
FIG. 27L is a corresponding sectional front-view of the second combination of the WFAECP in accordance with the present disclosure.
Figure 27M:
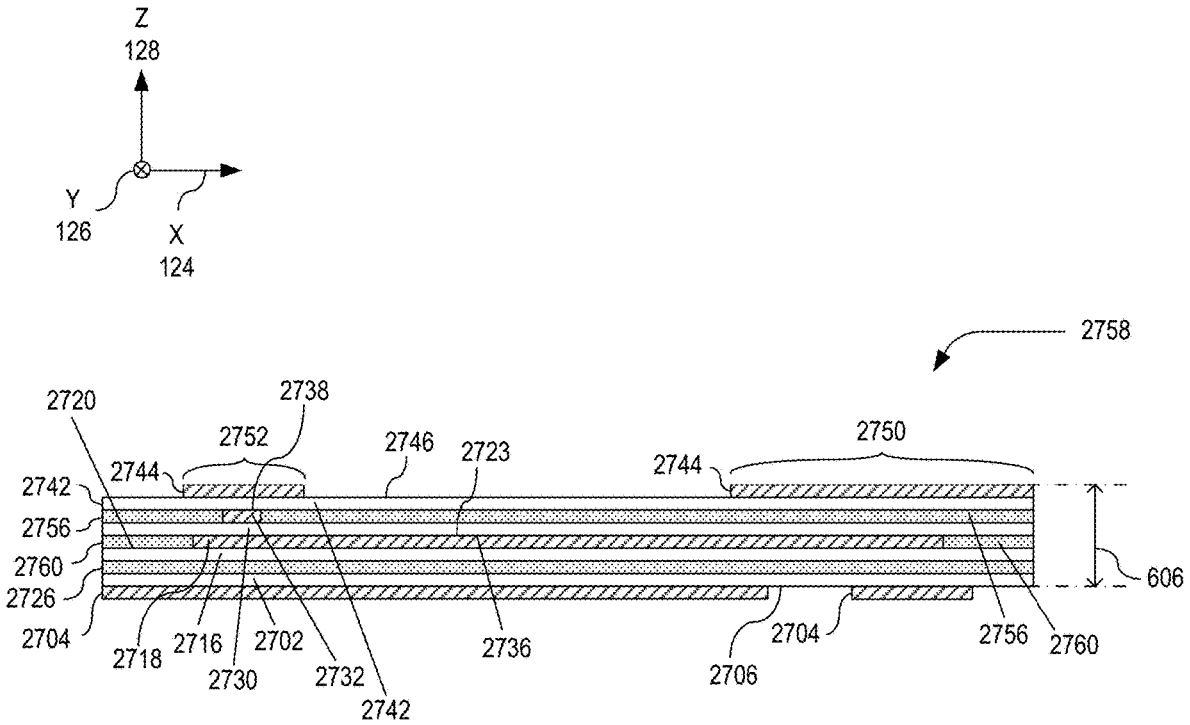
FIG. 27M is a sectional side-view of a third combination of the first combination and the second combination of the WFAECP in accordance with the present disclosure.
Figure 27N:
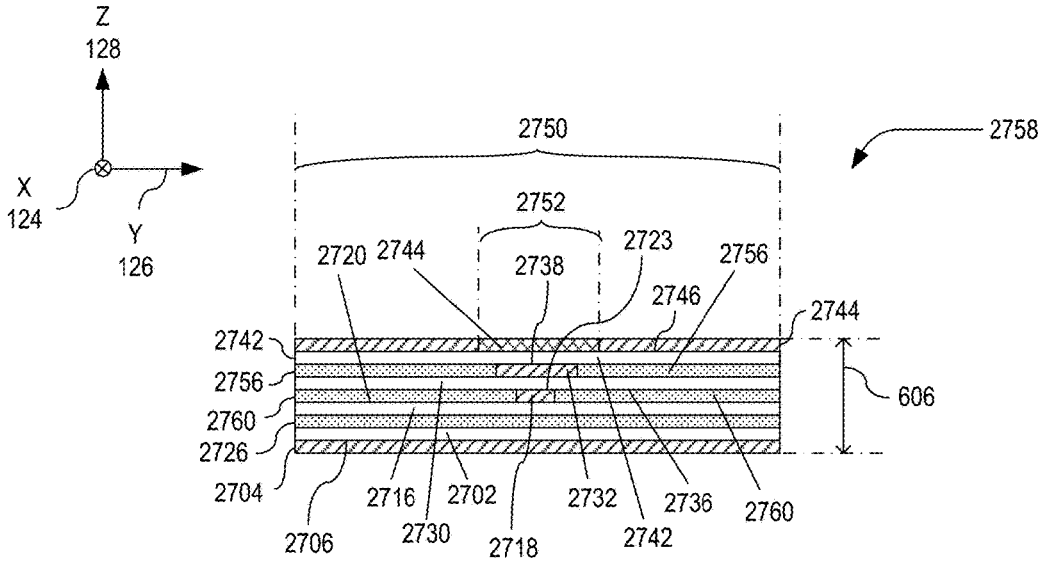
FIG. 27N is a corresponding sectional front-view of the third combination of the WFAECP in accordance with the present disclosure.
Figure 27O:
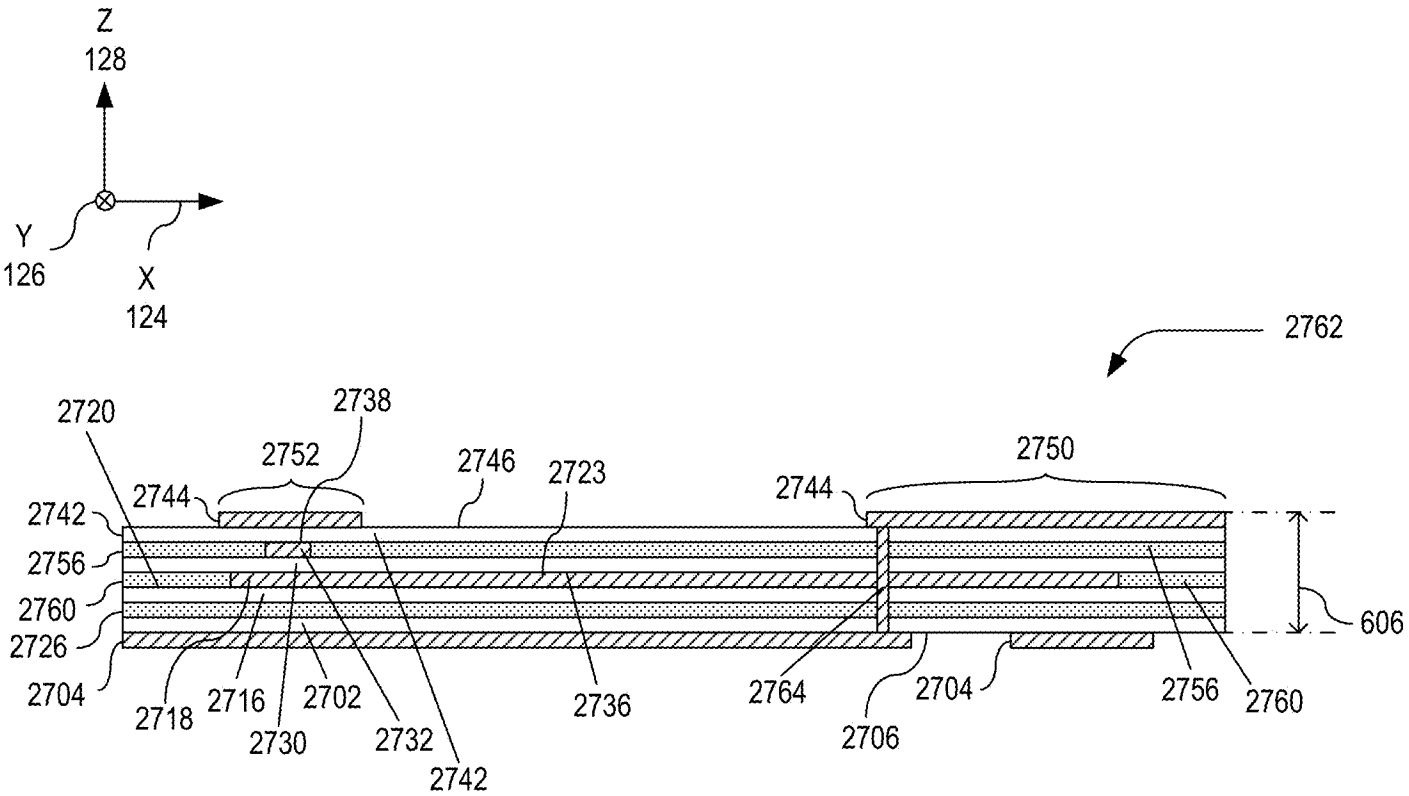
FIG. 27O is a sectional side-view of a composite laminated dielectric structure of the third combination of the WFAECP and at least one conductive via in accordance with the present disclosure.
Figure 27P:
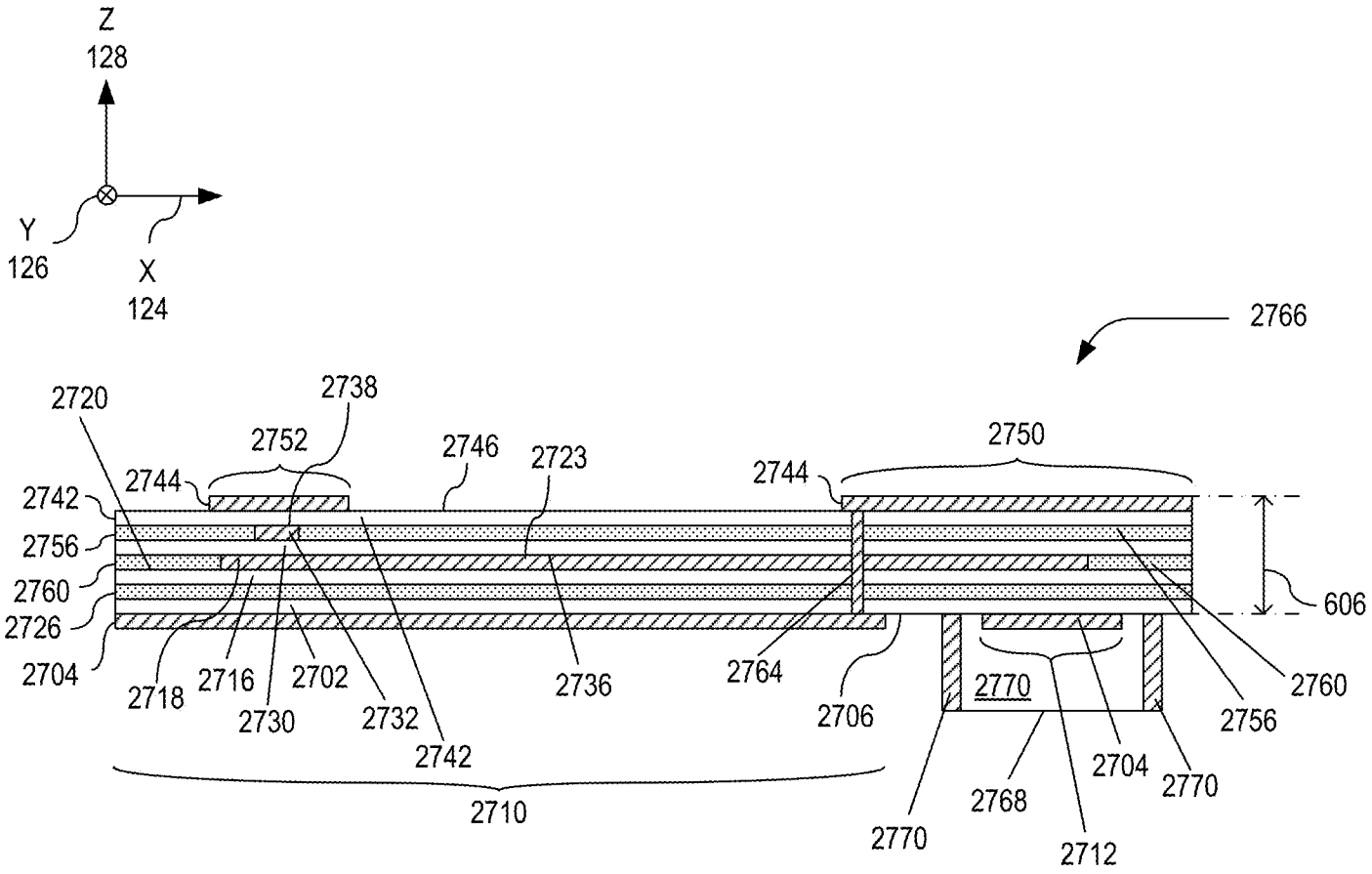
FIG. 27P is a sectional side-view of a laminated WFAECP in accordance with the present disclosure.

Turning to FIGS. 27A-27P, different views of a stack-up process are shown where the process is a method for fabricating the WFAECP utilizing a lamination process. In these views the stack-up process is shown along the Z-axis 128 looking into either the Y-axis 126 (similar to the sectional view shown in FIG. 7 along the first cutting plane A-A' 202) or the X-axis 124 (similar to the sectional view shown in FIG. 10 along the third cutting plane C-C' 206).

Specifically, in FIG. 27A, a sectional side-view of a first section 2700 of the WFAECP is shown in accordance with the present disclosure. The first section 2700 of the WFAECP includes a first dielectric layer 2702 with a first conductive layer 2704 patterned on a bottom surface 2706 of the first dielectric layer 2702, where the first dielectric layer 2702 also has a top surface 2708. In this example, the first conductive layer 2704 is both the bottom conductor (i.e., bottom conductor 400) and the second PAE 200, where a first portion 2712 of the first conductive layer 2704 corresponds to the second PAE 200 and a second portion 2710 of the first conductive layer 2704 corresponds to the bottom conductor 400. In this example, the first conductive layer 2704 may be constructed of a conductive metal such as, for example, electroplated copper or printed silver ink. In FIG. 27B, a corresponding sectional front-view of the first section 2700 of the WFAECP is shown in accordance with the present disclosure.

In FIG. 27C, a sectional view of a second section 2714 of the WFAECP is shown in accordance with the present disclosure. The second section 2714 of the WFAECP includes a second dielectric layer 2716 with a second conductive layer 2718 patterned on a top surface 2720 of the second dielectric layer 2716, where the second dielectric layer 2716 includes the top surface 2720 and a bottom surface 2722. In this example, the second conductive layer 2718 has a top surface 2723 and is an inner conductor (i.e., inner conductor 706) of the WFAECP. In this example, the second conductive layer 2718 may be constructed of a conductive metal such as, for example, electroplated copper or printed silver ink. In FIG. 27D, a corresponding sectional front-view of the second section 2714 of the WFAECP is shown in accordance with the present disclosure.

In FIG. 27E, a sectional view of a first combination 2724 of the first section 2700 and the second section 2714 of the WFAECP is shown in accordance with the present disclosure. The first combination 2724 is formed by laminating the bottom surface 2722 of the second dielectric layer 2716 to the top surface 2708 of the first dielectric layer 2702 with a first adhesive layer 2726 that may be an adhesive film. In FIG. 27F, a corresponding sectional front-view of the first combination 2724 of the WFAECP is shown in accordance with the present disclosure.

In FIG. 27G, a sectional view of a third section 2728 of the WFAECP is shown in accordance with the present disclosure. The third section 2728 of the WFAECP includes a third dielectric layer 2730 with a third conductive layer 2732 patterned on a top surface 2734 of the third dielectric layer 2730, where the third dielectric layer 2730 also includes a bottom surface 2736. The third conductive layer 2732 also has a top surface 2738. In FIG. 27H, a corresponding sectional front-view of the third section 2728 of the WFAECP is shown in accordance with the present disclosure.

In FIG. 27I, a sectional view of a fourth section 2740 of the WFAECP is shown in accordance with the present disclosure. The fourth section 2740 of the WFAECP includes a fourth dielectric layer 2742 with a fourth conductive layer 2744 patterned on a top surface 2746 of the fourth dielectric layer 2742, where the fourth dielectric layer 2742 also has a bottom surface 2748. In this example, the fourth conductive layer 2744 is both the top conductor (i.e., top conductor 106) and a PAE (i.e., the first PAE 104), where a first portion 2752 of the fourth conductive layer 2744 corresponds to the first PAE 104 and a second portion 2750 of the fourth conductive layer 2744 corresponds to the top conductor 106. In this example, the fourth conductive layer 2744 may be constructed of a conductive metal such as, for example, electroplated copper or printed silver ink. For purposes of ease of illustration, only a single PAE is shown corresponding to the first portion 2752 of the fourth conductive layer 2744; however, it is appreciated that there may be any plurality of PAEs formed on the top surface 2746 of the fourth dielectric 2742 based on the design of the WFAECP. In FIG. 27J, a corresponding sectional front-view of the fourth section 2740 of the WFAECP is shown in accordance with the present disclosure.

In FIG. 27K, a sectional view of a second combination 2754 of the third section 2728 and the fourth section 2740 of the WFAECP is shown in accordance with the present disclosure. The second combination 2754 is formed by laminating the bottom surface 2748 of the fourth dielectric layer 2742 to the top surface 2734 of the third dielectric layer 2730 and the top surface 2738 of the third conductive layer 2732 with a second adhesive layer 2756 that may be an adhesive film. In FIG. 27L, a corresponding sectional front-view of the second combination 2754 of the WFAECP is shown in accordance with the present disclosure.

In FIG. 27M, a sectional view of a third combination 2758 of the first combination 2724 and the second combination 2754 of the WFAECP is shown in accordance with the present disclosure. The third combination 2758 is formed by laminating the bottom surface 2736 of the third dielectric layer 2730 to the top surface 2720 of the second dielectric layer 2716 and the top surface 2723 of the second conductive layer 2718 with a third adhesive layer 2760 that may be an adhesive film. In FIG. 27N, a corresponding sectional front-view of the third combination 2758 of the WFAECP is shown in accordance with the present disclosure. In this example, the third dielectric layer 2730, the third adhesive layer 2760, or both may include at least one cavity filled with air that surrounds the second conductive layer 2718.

In FIG. 27O, a sectional side-view of a composite laminated dielectric structure 2762 of the third combination 2758 of the WFAECP and at least one conductive via 2764 are shown in accordance with the present disclosure. The at least one conductive via 2764 is in signal communication with both the second portion 2750 of the fourth conductive layer 2744 and the second portion 2710 of the first conductive layer 2704. The at least one conductive via 2764 may be pressed or drilled through the third combination 2758 of the WFAECP and filled with conductive metal, paste, or other material capable of electrically connecting the second portion 2750 of the fourth conductive layer 2744 and the second portion 2710 of the first conductive layer 2704 together such that they form a continuous reference ground plane. In this example, the composite laminated dielectric structure 2762 may be the dielectric structure 102.

In FIG. 27P, a sectional side-view of a laminated WFAECP 2766 is shown. The laminated WFAECP 2766 is a combination of the composite laminated dielectric structure 2762 with a waveguide 2768 that has waveguide walls 2770 that are mated to the composite laminated dielectric structure 2762. As an example, the waveguide 2768 may be mated directly to the bottom surface 2706 of the first dielectric layer 2702 with, for example, screws, or an optional additional rigid structure (not shown) may be attached to the bottom surface 2706 of the first dielectric layer 2702 and the waveguide may be mated to the rigid structure.

In these examples, the first dielectric layer 2702, second dielectric layer 2716, third dielectric layer 2730, and fourth dielectric layer 2742 may be constructed of an RF dielectric material such as, for example, 10 mil Pyralux®. Moreover, each of these dielectric layers 2702, 2716, 2730, and 2742 may be laminated to each other with first, second, and third adhesive layers 2726, 2756, and 2760, respectively, where each adhesive layer 2726, 2756, and 2760 may be an adhesive film, tape or bonding film.

Figure 28:
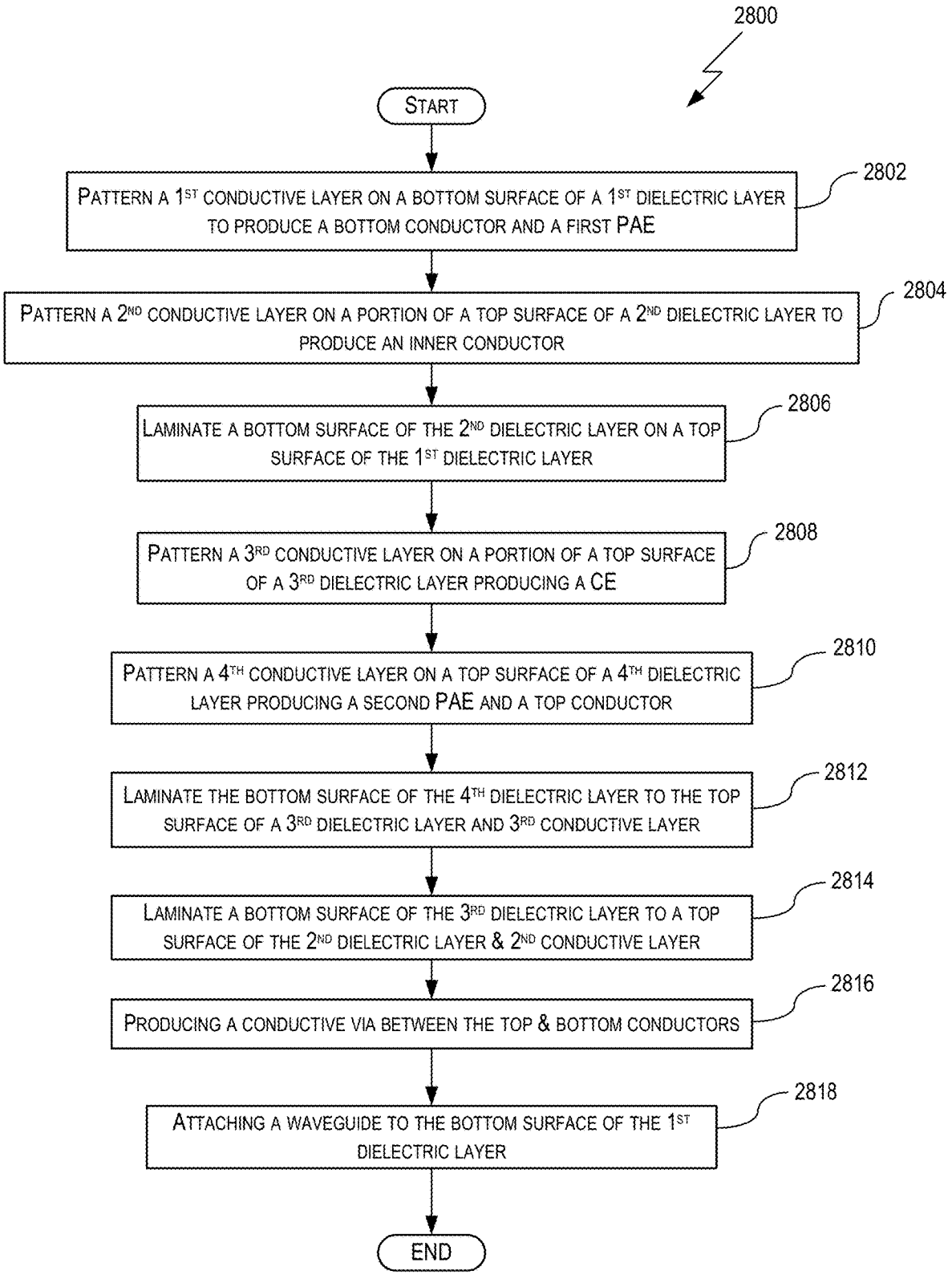
FIG. 28 is a flowchart of an example implementation of a method for fabricating the WFAECP utilizing a lamination process in accordance with the present disclosure.

In FIG. 28, a flowchart is shown of an example implementation of a method 2800 for fabricating the WFAECP utilizing a lamination process in accordance with the present disclosure. The method 2800 is related to the method for fabricating the WFAECP utilizing the lamination process described in FIGS. 27A-27P.

The method 2800 starts by patterning 2802 the first conductive layer 2704 on the bottom surface 2706 of the first dielectric layer 2702. The first conductive layer 2704 includes a first portion 2712 and a second portion 2710, where patterning the first portion 2712 of the first conductive layer 2704 produces a PAE (e.g., second PAE 200) with an antenna slot (e.g., second antenna slot 410) and where patterning the second portion 2710 of the first conductive layer 2704 produces a bottom conductor 400. The bottom conductor 400 acts a reference ground plane. The method 2800 additionally includes patterning 2804 the second conductive layer 2718 on a portion of the top surface 2720 of the second dielectric layer 2716 to produce the inner conductor 706. The method 2800 also includes laminating 2806 the bottom surface 2722 of the second dielectric layer 2716 to a top surface 2708 of the first dielectric layer 2702. The method 2800 also includes patterning 2808 a third conductive layer 2732 on a portion of the top surface 2734 of a third dielectric layer 2730 to produce a CE (e.g., CE 800), where the third dielectric layer 2730 includes a bottom surface 2736. The method 2800 additionally includes patterning 2810 a fourth conductive layer 2744 on a top surface 2746 of a fourth dielectric layer 2742, where the fourth conductive layer 2744 includes a first portion 2752 and a second portion 2750. In this example, patterning the first portion 2752 of the fourth conductive layer 2744 produces a second PAE (e.g., first PAE 104) with an antenna slot (e.g., first antenna slot 108) and patterning the second portion 2750 of the fourth conductive layer 2744 produces the top conductor 106. The method 2800 further includes laminating 2812 a bottom surface 2748 of the fourth dielectric layer 2742 to the top surface 2738 of the third conductive layer 2732 and the top surface 2734 of the third dielectric layer 2730; and laminating 2814 a bottom surface 2736 of the third dielectric layer 2730 to the top surface 2723 of the second conductive layer 2718 and the top surface 2720 of the second dielectric layer 2716. Moreover, the method 2800 includes producing 2816 at least one conductive via 2764 between the second portion 2750 (i.e., top conductor 106) of the fourth conductive layer 2744 and the second portion 2710 (e.g., bottom conductor 400) of the first conductive layer 2704. Furthermore, the method 2800 includes attaching 2818 a waveguide 2768 to the bottom surface 2706 of a first dielectric layer 2702, wherein the second PAE 200 is located within a cavity of the waveguide 2768. The waveguide 2768 may be attached by mating the waveguide 2768 with screws to the bottom surface 2706 of the first dielectric layer 2702 or an optional additional rigid structure (not shown) may be attached to the bottom surface 2706 of the first dielectric layer 2702 and the waveguide may be mated to the rigid structure. In this example, the method 2800 may utilize a sub-method where one or more of the first conductive layer 2704, second conductive layer 2718, third conductive layer 2732, and fourth conductive layer 2744 are formed by a subtractive method (e.g., wet etching, milling, or laser ablation) of electroplated or rolled metals or by an additive method (e.g., printing or deposition) of printed inks or deposited thin-films. The method 2800 then ends.

In this example, the method 2800 may further include patterning another conductive layer on the bottom surface 2722 of the second dielectric layer 2716 to produce a second CE (e.g., CE 1000).

Figure 29A:
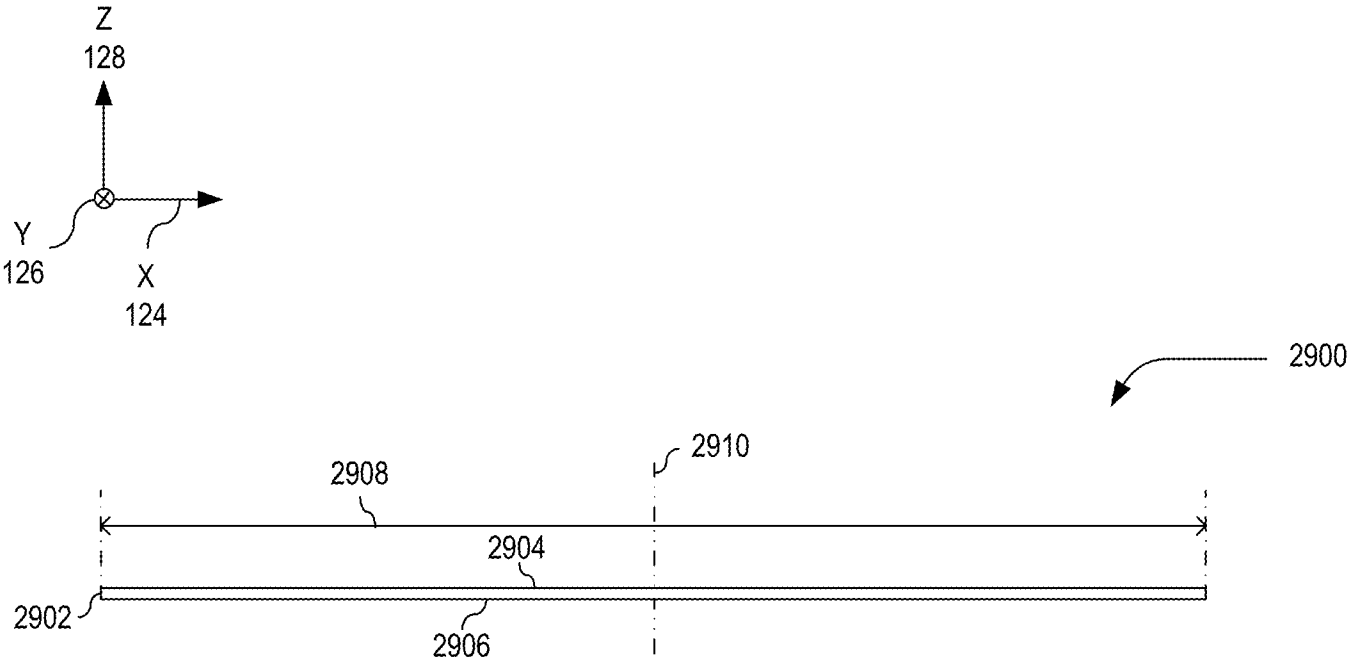
FIG. 29A is a sectional side-view of first section of the WFAECP in accordance with the present disclosure.
Figure 29B:
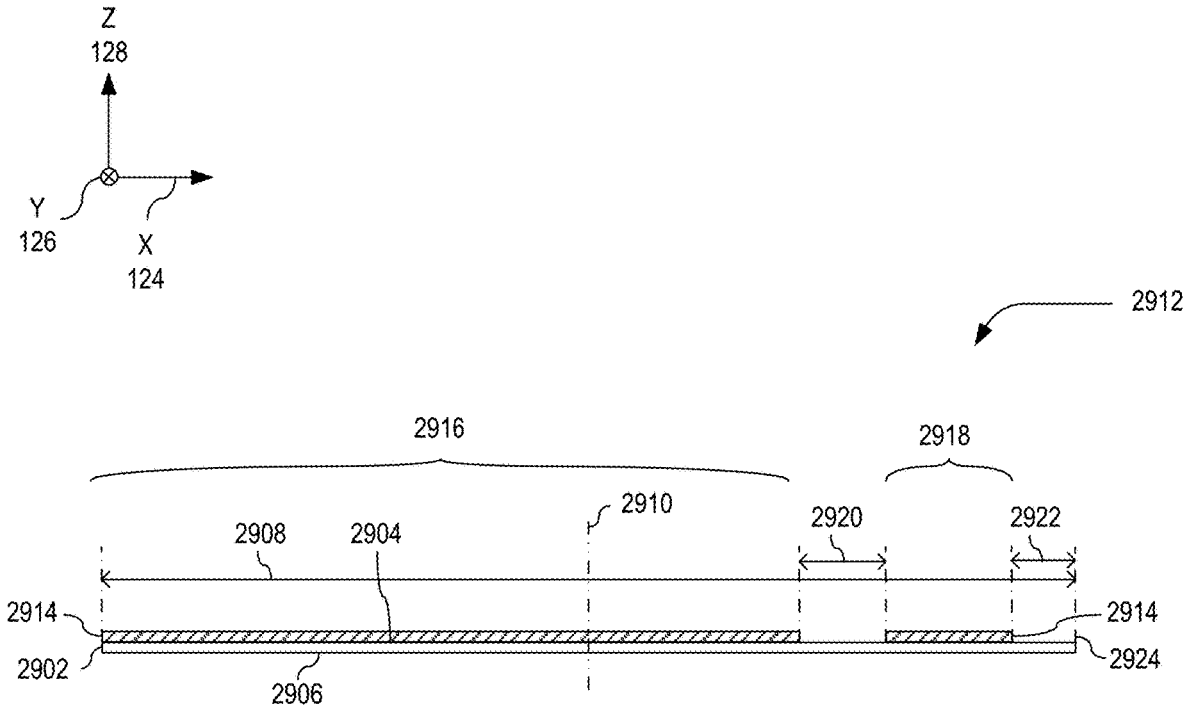
FIG. 29B is a sectional side-view of a first combination of the first section with a printed first conductive layer in accordance with the present disclosure.
Figure 29C:
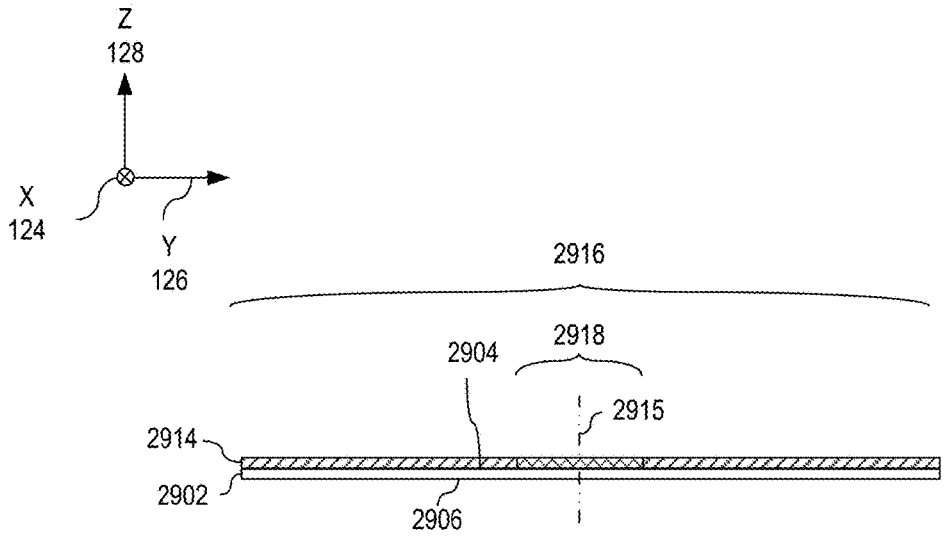
FIG. 29C is a corresponding sectional front-view of the first combination in accordance with the present disclosure.
Figure 29D:
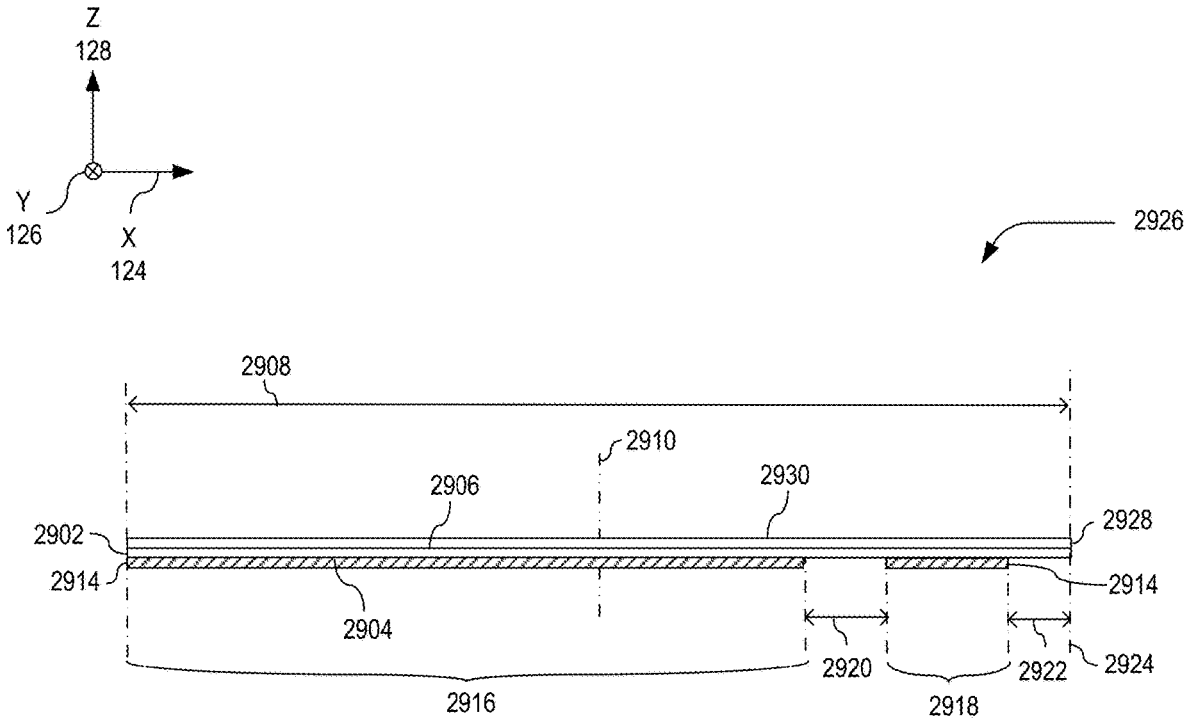
FIG. 29D is a sectional side-view of a second combination of the first combination and a second printed dielectric layer in accordance with the present disclosure.
Figure 29E:
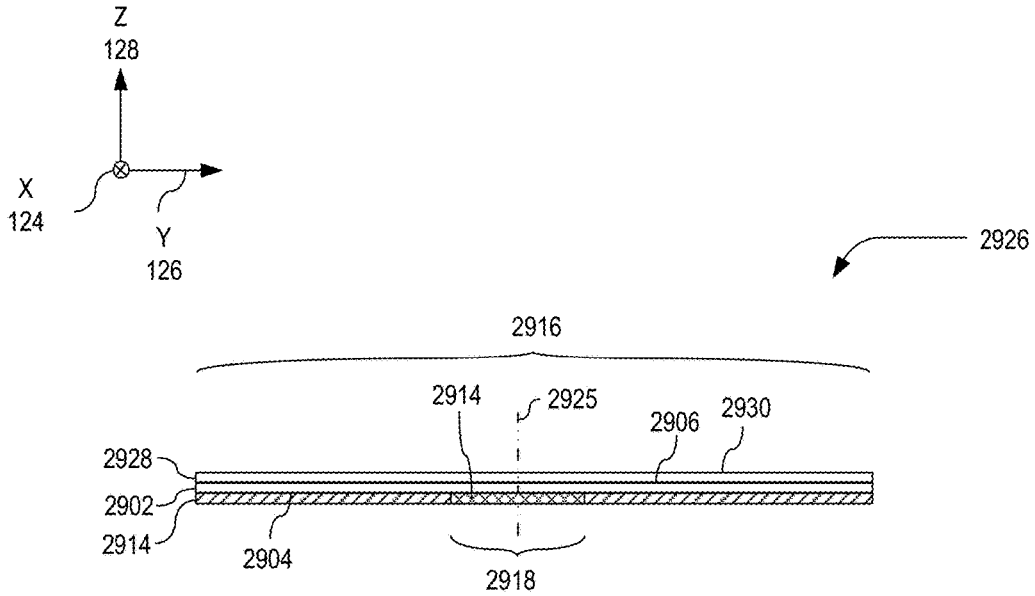
FIG. 29E is a corresponding sectional front-view of the second combination in accordance with the present disclosure.
Figure 29F:
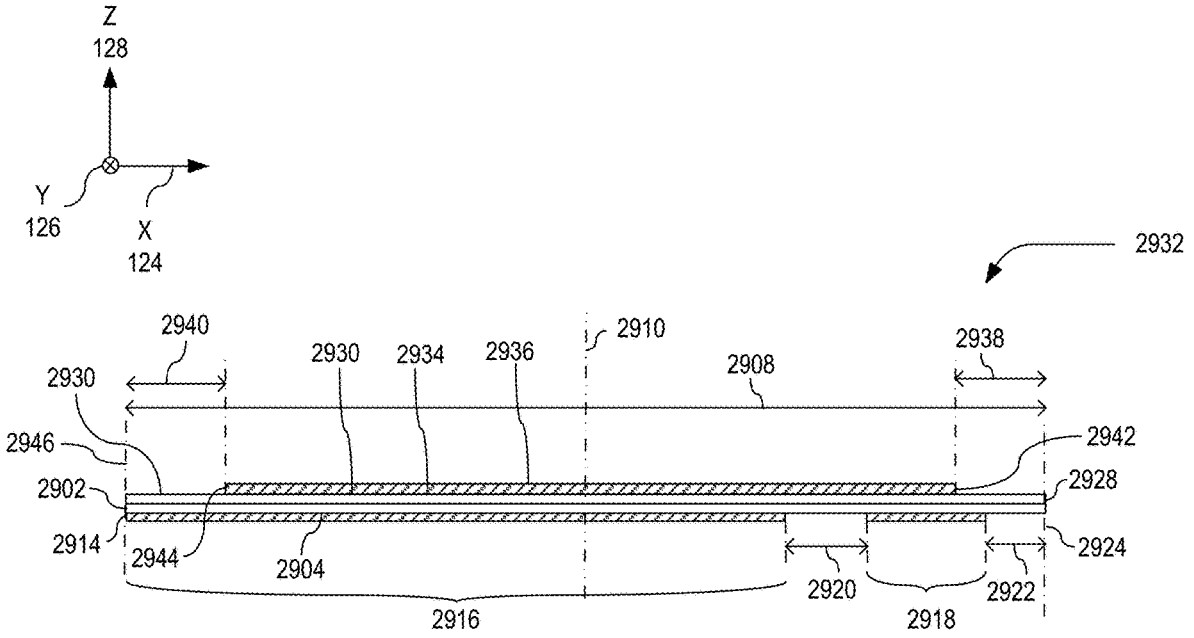
FIG. 29F is a sectional side-view of a third combination of the second combination with a printed second conductive layer in accordance with the present disclosure.
Figure 29G:
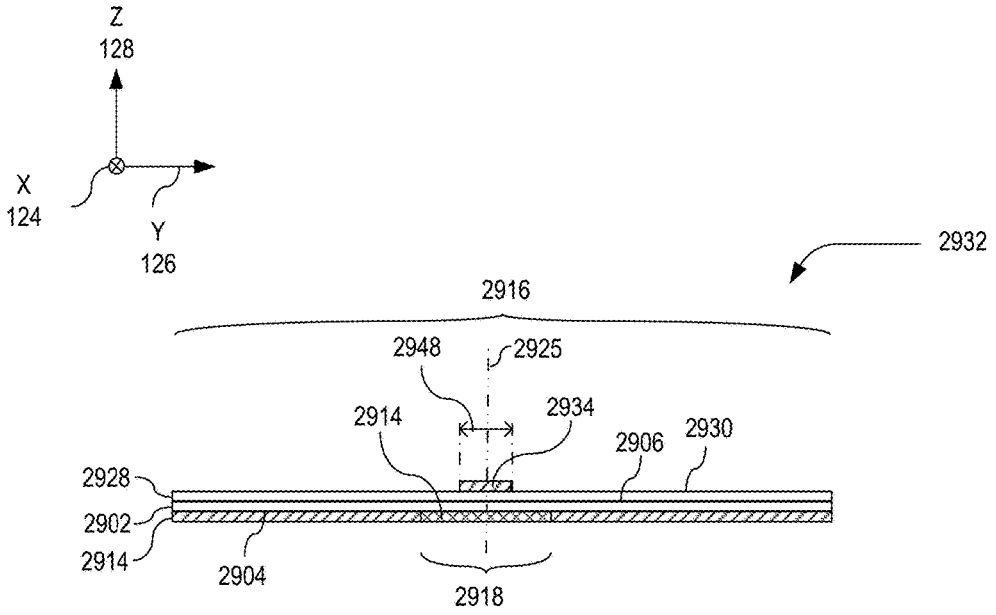
FIG. 29G is a corresponding sectional front-view of the third combination in accordance with the present disclosure.
Figure 29H:
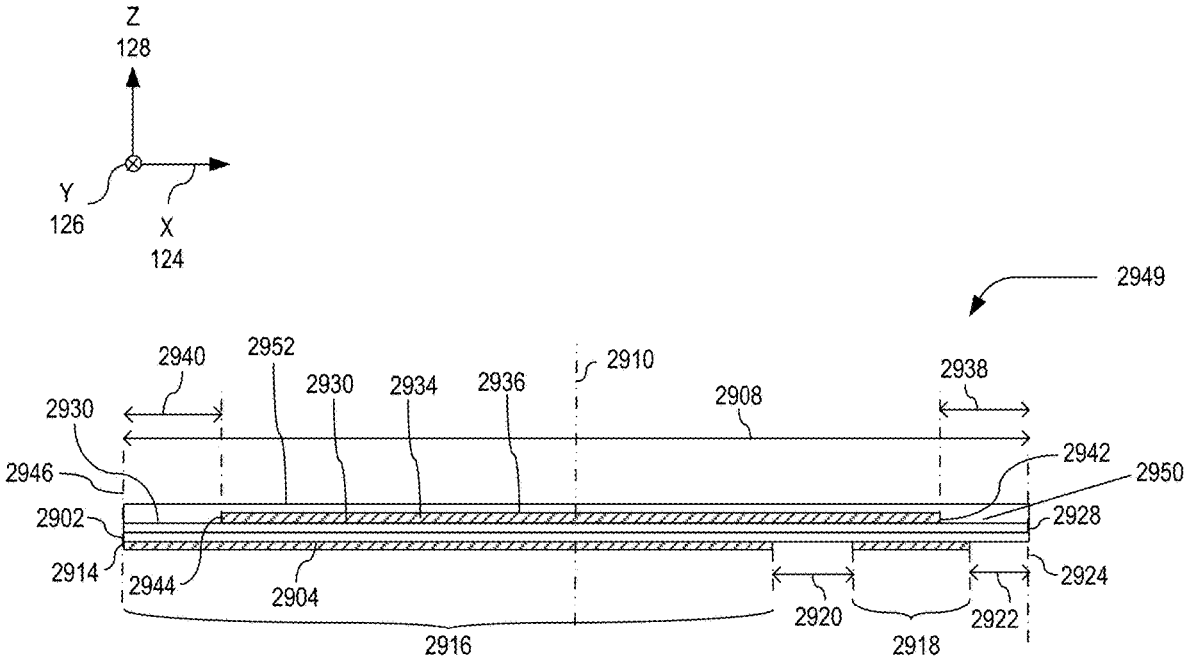
FIG. 29H is a sectional side-view of a fourth combination of the third combination with a printed third dielectric layer in accordance with the present disclosure.
Figure 29I:
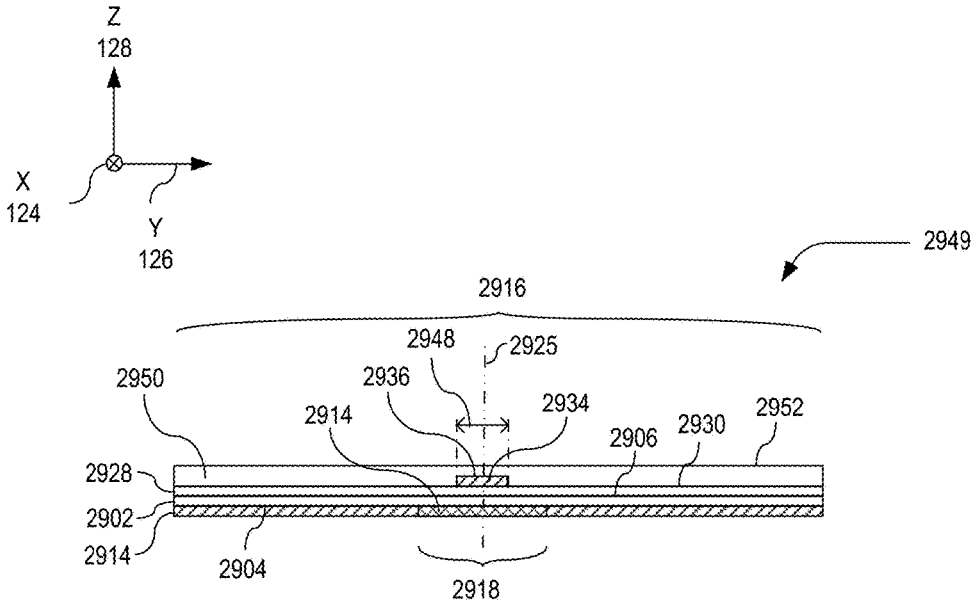
FIG. 29I is a corresponding sectional front-view of the fourth combination in accordance with the present disclosure.
Figure 29J:
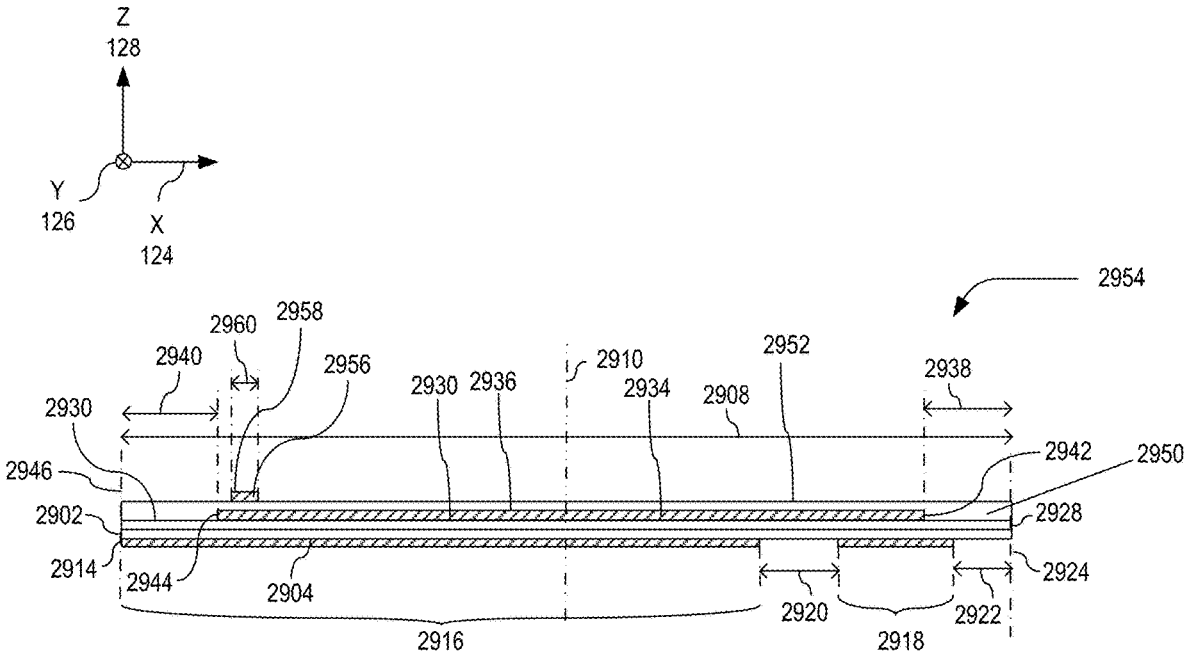
FIG. 29J is a sectional side-view of a fifth combination of the fourth combination with a printed third conductive layer in accordance with the present disclosure.
Figure 29K:
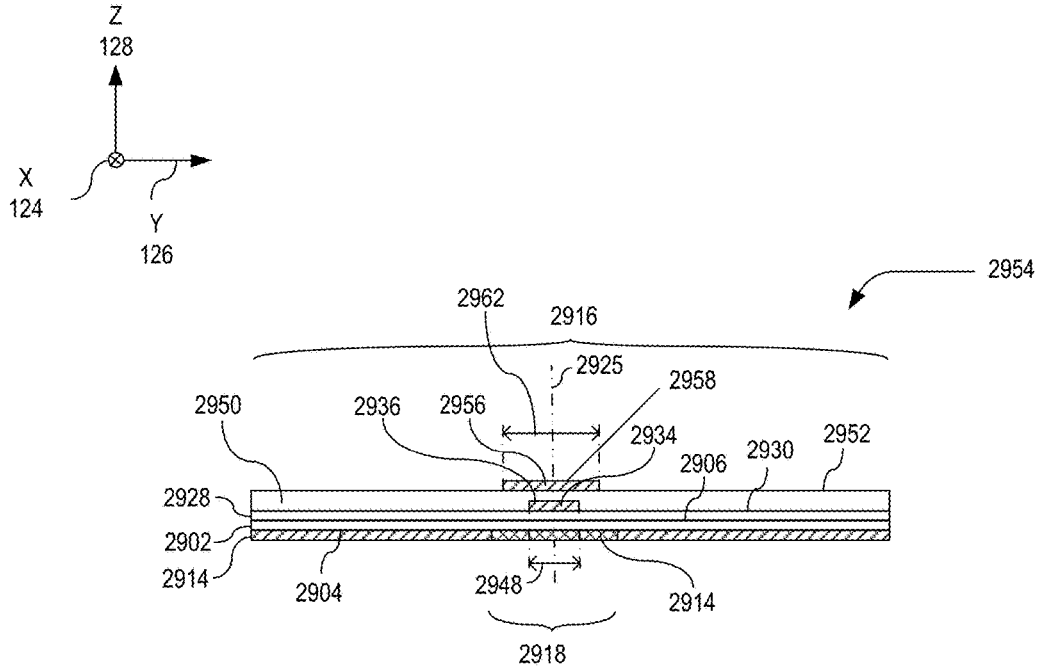
FIG. 29K is a corresponding sectional front-view of the fifth combination in accordance with the present disclosure.
Figure 29L:
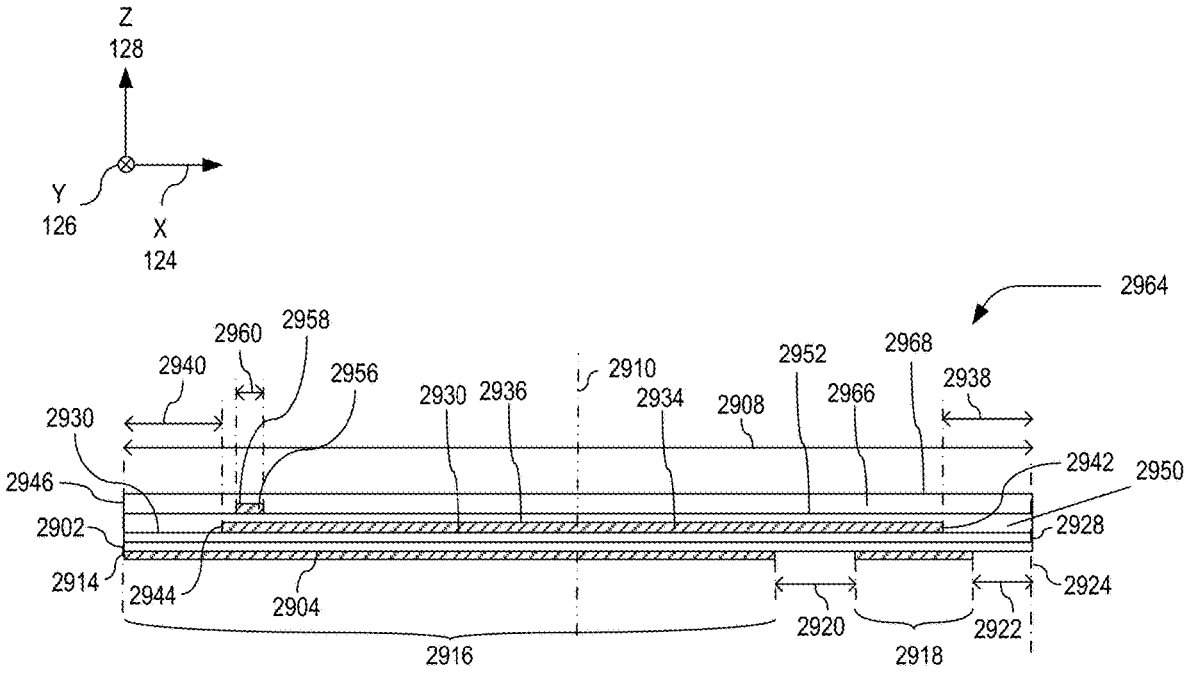
FIG. 29L is a sectional side-view of a sixth combination of the fifth combination with a printed fourth dielectric layer in accordance with the present disclosure.
Figure 29M:
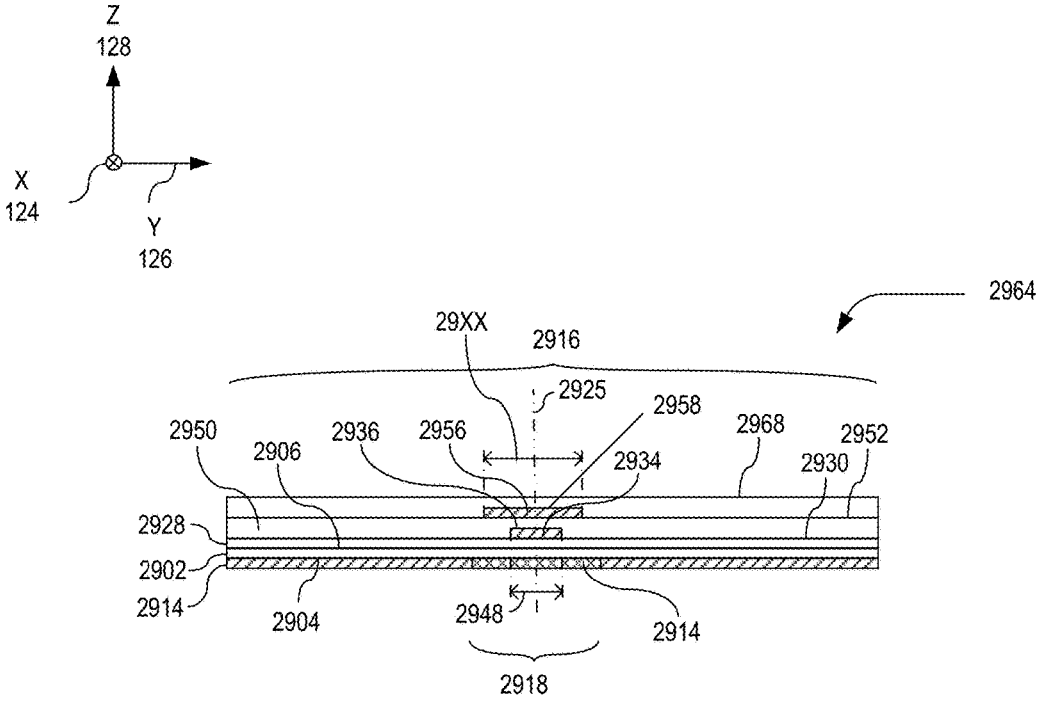
FIG. 29M is a corresponding sectional front-view of the sixth combination in accordance with the present disclosure.
Figure 29N:
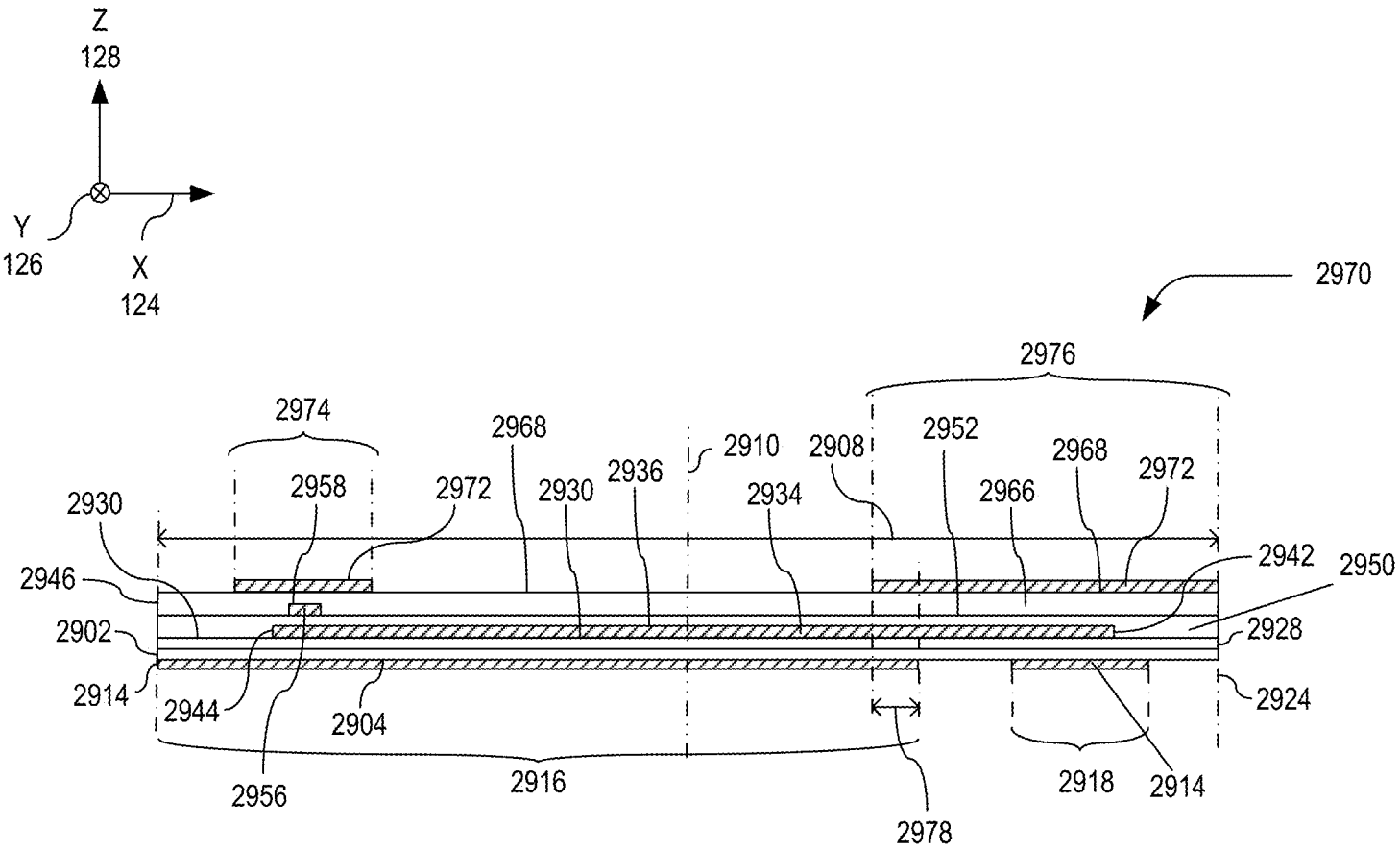
FIG. 29N is a sectional side-view of a seventh combination of the sixth combination with a printed fourth conductive layer in accordance with the present disclosure.
Figure 29O:
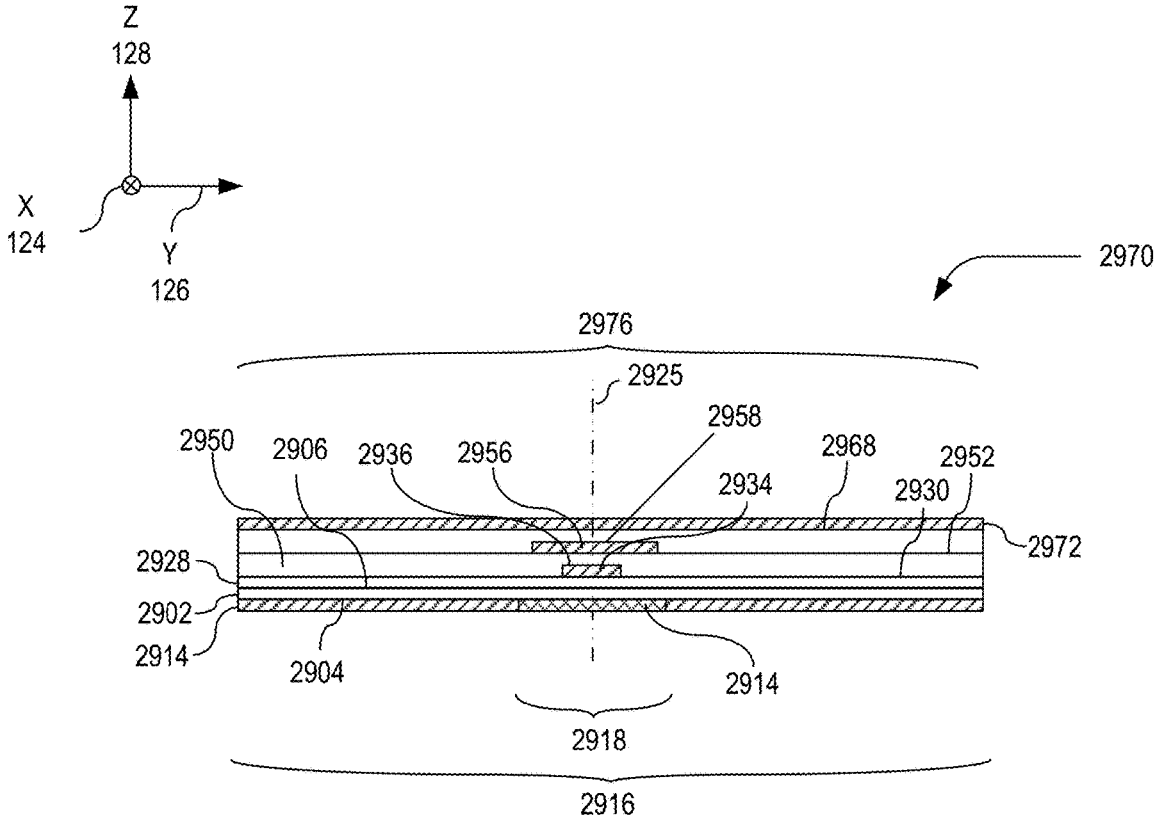
FIG. 29O is a corresponding sectional front-view of the seventh combination in accordance with the present disclosure.
Figure 29P:
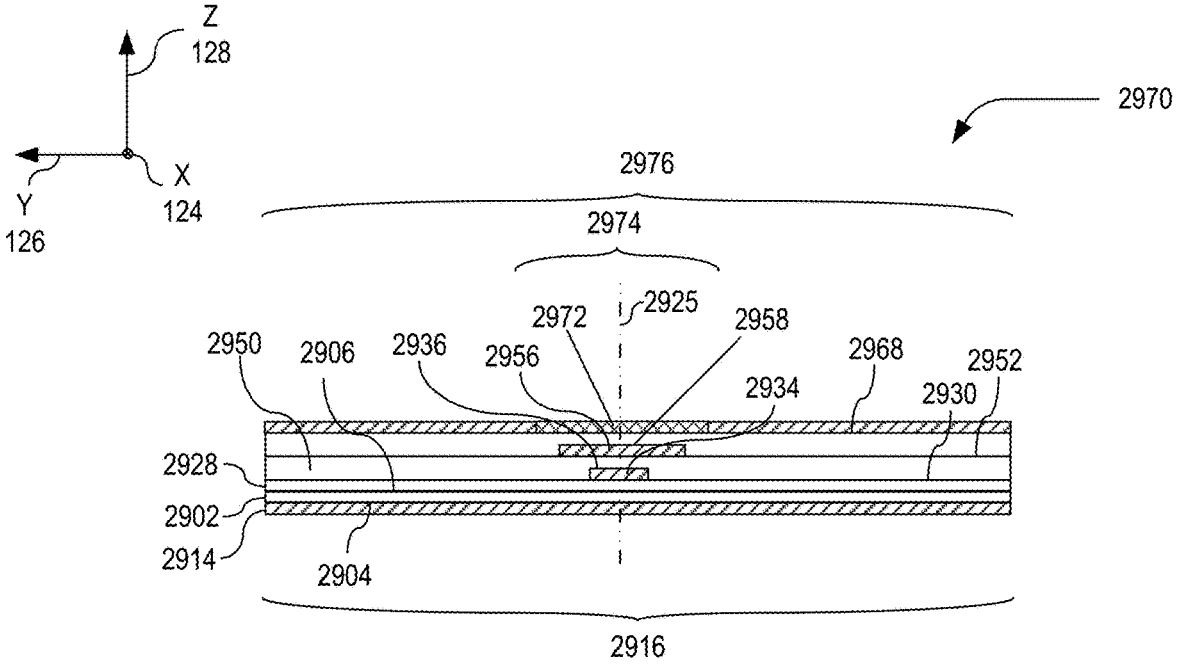
FIG. 29P is a corresponding sectional back-view of the seventh combination in accordance with the present disclosure.
Figure 29Q:
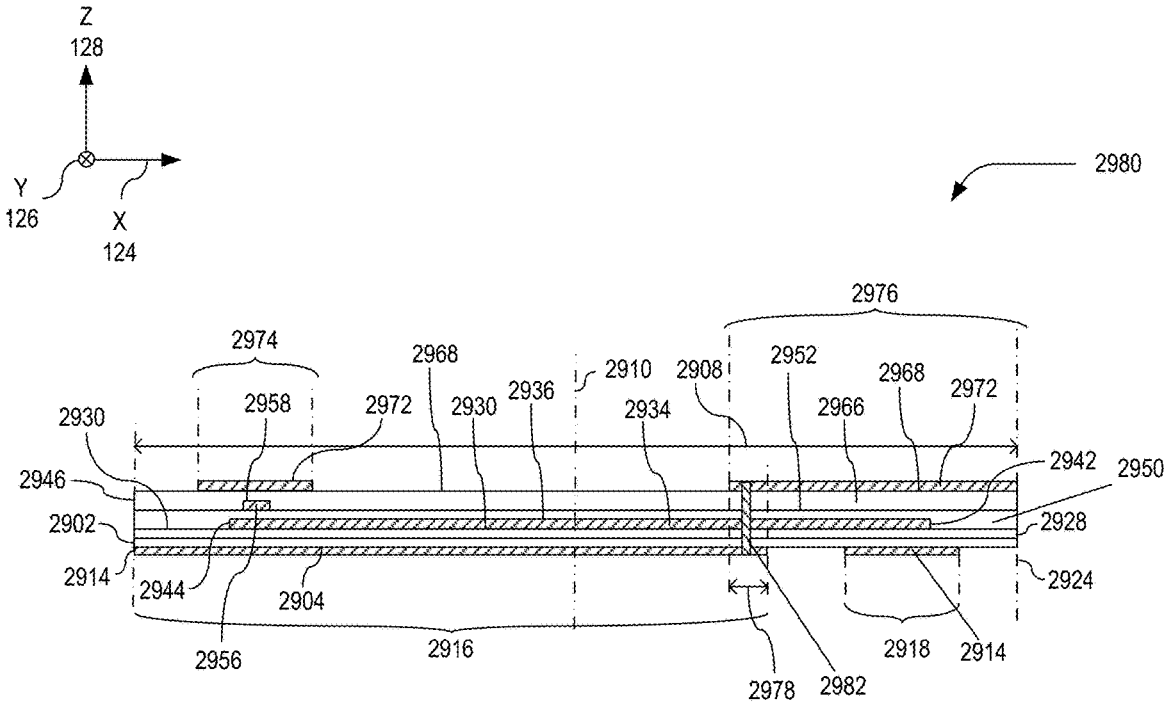
FIG. 29Q is a sectional side-view of an eighth combination of the seventh combination with at least one conductive via in accordance with the present disclosure.
Figure 29R:
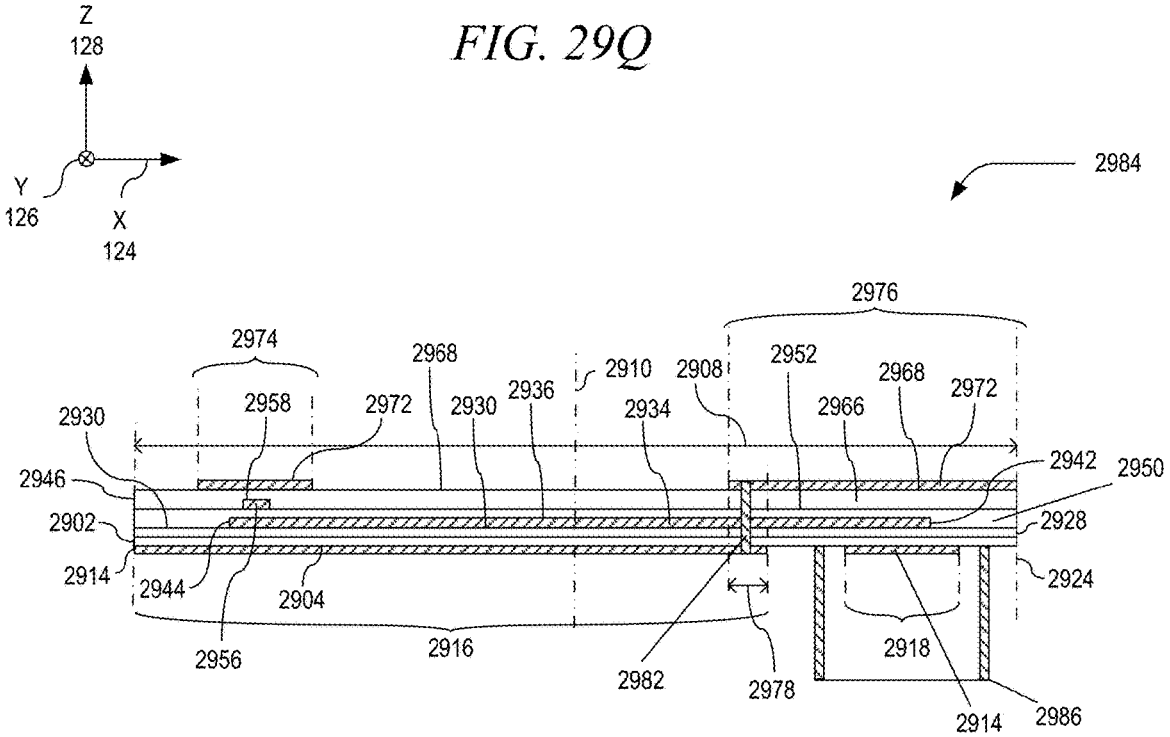
FIG. 29R is a sectional side-view of a WFAECP in accordance with the present disclosure.

In FIGS. 29A-29R, a method for fabricating the WFAECP utilizing an additive 3-D printing process is shown. Specifically, in FIG. 29A, a sectional side-view of first section 2900 of the WFAECP is shown in accordance with the present disclosure. The first section 2900 of the WFAECP includes a printed first dielectric layer 2902 with a top surface 2904, a bottom surface 2906, and a first width 2908, where the first width 2908 has a first center 2910.

In FIG. 29B, a sectional side-view of a first combination 2912 of the first section 2900 with a printed first conductive layer 2914 is shown in accordance with the present disclosure. In this example, the first printed conductive layer 2914 is both the bottom conductor (i.e., bottom conductor 400) and the second PAE 200, where a second portion 2916 of the first printed conductive layer 2914 corresponds to the bottom conductor 400 and a first portion 2918 of the first printed conductive layer 2914 corresponds to the second PAE 200. Furthermore, there is a first gap 2920 between the first portion 2918 and second portion 2916 of the first printed conductive layer 2914 and a second gap 2922 from end 2914 of the first portion 2918 and a first end 2924 of the first printed dielectric layer 2902. In FIG. 29C, a section front-view of the first combination 2912 is shown in accordance with the present disclosure. In this example, both the first portion 2918 and second portion 2916 of the first printed conductive layer 2914 is shown centered about a second center 2915. Moreover, in this example, the second portion 2916 of the first conductive layer 2914 is the bottom conductor 400 and the first portion 2918 of the first conductive layer 2914 is the second PAE 200.

In FIG. 29D, a sectional side-view of a second combination 2926 of the first combination 2912 and a second printed dielectric layer 2928 is shown in accordance with the present disclosure. In this example, first combination 2912 is flipped so that the second printed dielectric layer 2928 is on the bottom of the first combination 2912. The second printed dielectric layer 2928 is then printed on to the bottom surface 2906 of the first printed dielectric layer 2902. The second printed dielectric layer 2928 has a top surface 2930. In FIG. 29E, a section front-view of the second combination 2926 is shown in accordance with the present disclosure.

In FIG. 29F, a sectional side-view of a third combination 2932 of the second combination 2926 with a printed second conductive layer 2934 is shown in accordance with the present disclosure. In this example, the printed second conductive layer 2934 is printed on to the top surface 2930 of the second printed dielectric layer 2928. The printed second conductive layer 2934 has a top surface 2936, a third gap 2938, and a fourth gap 2940. The third gap 2938 is between a first end 2942 of the printed second conductive layer 2934 and the first end 2924 of the first printed dielectric layer 2902 and the fourth gap 2940 is between a second end 2944 of the printed second conductive layer 2934 and a second end 2946 of the first printed dielectric layer 2902. In this example, the printed second conductor 2934 is the inner conductor 706 that has a width 2948 that corresponds to the inner conductor width 806 (shown in FIGS. 8, 9, 10), which (as described earlier) is less than the PAE diameter of the second PAE 200. In FIG. 29G, a section front-view of the third combination 2932 is shown in accordance with the present disclosure.

In FIG. 29H, a sectional side-view of a fourth combination 2949 of the third combination 2932 with a printed third dielectric layer 2950 is shown in accordance with the present disclosure. Specifically, the printed third dielectric layer 2950 is printed on the top surface 2936 of the printed second conductive layer 2934 and the top surface 2930 of the printed second dielectric layer 2928. In this example, the printed third dielectric layer 2950 has a top surface 2952. Furthermore, in this example, the printed third dielectric layer 2950 may have a height that is greater than or equal to the height of the printed second conductive layer 2934. In FIG. 29I, a section front-view of the fourth combination 2949 is shown in accordance with the present disclosure.

It is appreciated by those of ordinary skill in the art that based on the design and thickness of the third printed dielectric layer 2950, an additional dielectric layer (not shown) may be printed on top of the third printed dielectric layer 2950. Specifically, the distance between the top surface 2936 of the printed second conductive layer 2934 and a soon to be printed third conductive layer (not shown) is a predetermined distance based on the design of the WFAECP.

In FIG. 29J, a sectional side-view of a fifth combination 2954 is shown in accordance with the present disclosure. The fifth combination 2954 is a combination of the fourth combination 2949 and a third printed conductive layer 2956. Specifically, the third printed conductive layer 2956 has a top surface 2958 and a third width 2960, and is printed on the top surface 2952 of the printed third dielectric layer 2950. In this example, the third printed conductive layer 2956 is a CE (e.g., CE 722 or CE 800) with a CE width (e.g., CE width 1009) and CE length (e.g., CE length 808). In FIG. 29K, a section front-view of the fifth combination 2954 is shown in accordance with the present disclosure. In this view, the third printed conductive layer 2956 is shown to have a first length 2962 that corresponds to the CE width (e.g., CE width 1009).

It is also appreciated by those of ordinary skill in the art that based on the design of the WFAECP, an additional printed conductor layer (not shown) may be printed on top of the first printed dielectric layer 2902 so as to act as a CE element above the first portion 2918 of the first printed conductive layer 2914 that corresponds to the second PAE 200. In this example, the distance between the printed second conductive layer 2934 and the optional printed third conductive layer (not shown) is a predetermined distance based on the design of the WFAECP.

In FIG. 29L, a sectional side-view of a sixth combination 2964 is shown in accordance with the present disclosure. The sixth combination 2964 is a combination of the fifth combination 2954 and a fourth printed dielectric layer 2966. Specifically, the fourth printed dielectric layer 2966 is printed on the top surface 2958 of the third printed conductive layer 2956 and the top surface 2952 of the third dielectric layer 2950. In this example, the printed fourth dielectric layer 2966 has a top surface 2968 may have a height that is greater than or equal to the height of the printed third conductive layer 2956. In FIG. 29M, a section front-view of the sixth combination 2964 is shown in accordance with the present disclosure.

It is appreciated by those of ordinary skill in the art that based on the design and thickness of the fourth printed dielectric layer 2966, an additional dielectric layer (not shown) may be printed on top of the fourth printed dielectric layer 2966. Specifically, the distance between the top surface 2936 of the printed second conductive layer 2934 and a soon to be printed fourth conductive layer (not shown) is a predetermined distance based on the design of the WFAECP.

In FIG. 29N, a sectional side-view of a seventh combination 2970 is shown in accordance with the present disclosure. The seventh combination 2970 is a combination of the sixth combination 2964 and a fourth printed conductive layer 2972. Specifically, the fourth printed conductive layer 2972 is printed on the top surface 2968 of the fourth printed dielectric layer 2966. In this example, a first portion 2974 of the fourth printed conductive layer 2972 is printed on the top surface 2968 of the fourth printed dielectric layer 2966 above the third printed conductive layer 2956 and corresponds to a PAE (e.g., first PAE 104) of the planar antenna array described earlier. A second portion 2976 of the fourth printed conductive layer 2972 is printed on the top surface 2968 of the fourth printed dielectric layer 2966 above the first portion 2918 of the first printed conductive layer 2914. As described earlier, there may be a plurality of portions of the fourth printed conductive dielectric layer 2972 along the top surface 2968 to form the PAEs of a planar antenna array but for the purpose of ease of illustration only a signal PAE is shown corresponding to the first portion 2974 of the fourth printed conductive layer 2972. In this example, the second portion 2976 of the fourth printed conductive layer 2972 (e.g., top conductor 106) and the second portion 2916 of the first conductive layer 2914 (e.g., bottom conductor 400) overlap at a location within the seventh combination 2970 that has an overlap width 2978. It is appreciated by those of ordinary skill in the art that at this location the second printed conductive layer 2934 (i.e., the inner conductor 706) is configured as a stripline transmission line that extends along a length corresponding to the overlap width 2978. In FIG. 29O, a section front-view of the seventh combination 2970 is shown in accordance with the present disclosure. In FIG. 29P, a section back-view of the seventh combination 2970 is shown in accordance with the present disclosure. In this example, the antenna slots (not shown but corresponding to, for example, first antenna slot 108 within the first PAE 104 and second antenna slot 410 within the second PAE 200 may be patterned within the first portion 2974 of the fourth printed conductive layer 2972 and the first portion 2918 of the printed first conductive layer 2914, respectively.

In FIG. 29Q, a sectional side-view of an eighth combination 2980 is shown in accordance with the present disclosure. In this example, at least one conductive via 2982 is fabricated between the second portion 2916 of the first conductive layer 2914 and second portion 2976 of the fourth conductive layer 2972 at a location within the overlap width 2978. The at least one conductive via 2982 may be drilled, punched, or passed through both second portion 2916 of the first conductive layer 2914 and second portion 2976 of the fourth conductive layer 2972 utilizing other known techniques and then filled with conductive ink, paste, or other conductive material. Alternatively, the at least one conductive via 2982 may be simultaneously fabricated in the previous process steps shown in FIGS. 29A-29P. Once formed, the at least one conductive via 2982 electrically shorts and thereby places the second portion 2976 of the fourth conductive layer 2972 at the same ground reference as the second portion 2916 of the first conductive layer 2914.

In FIG. 29R, a sectional side-view of a ninth combination 2984 is shown in accordance with the present disclosure. In this example, the ninth combination 2984 is a combination of the eighth combination 2980 and a waveguide 2986. The waveguide 2986 has waveguide walls that are mated to the eighth combination 2980. As an example, the waveguide 2986 may be mated directly to the top surface 2904 of the first dielectric layer 2902 or an optional additional rigid structure (not shown) may be attached to the top surface 2904 of the first dielectric layer 2902 and the waveguide 2986 may be mated to the rigid structure.

Figure 30:
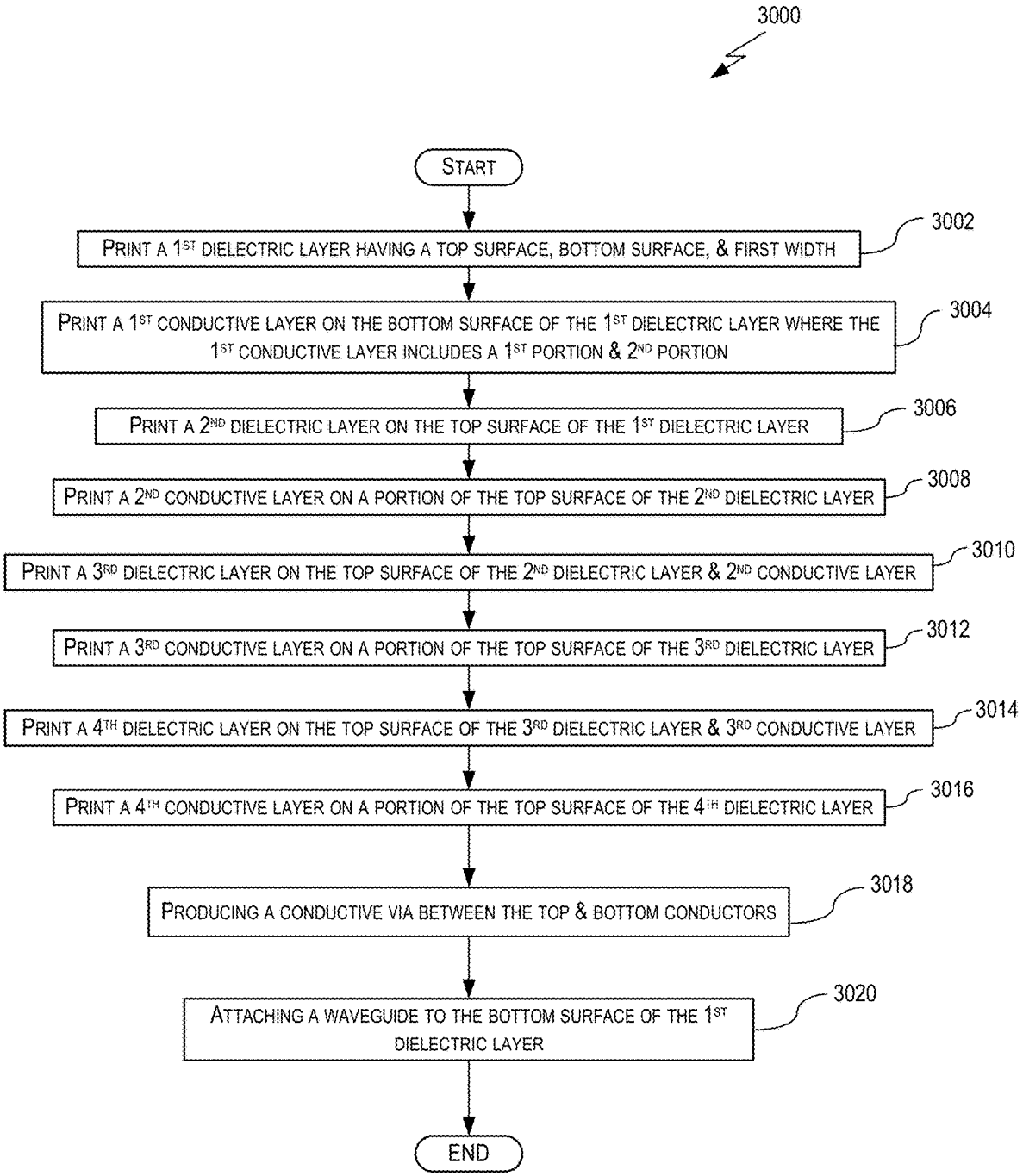
FIG. 30 is a flowchart of an example implementation of method for fabricating the WFAECP utilizing a three-dimensional ("3-D") additive printing process in accordance with the present disclosure.

In FIG. 30, a flowchart is shown of an example implementation of method 3000 for fabricating the WFAECP utilizing a 3-D additive printing process in accordance with the present disclosure. The method 3000 is related to the method for fabricating the WFAECP utilizing the additive 3-D printing process as shown in FIGS. 29A-29R.

The method 3000 starts by printing 3002 a first dielectric layer 2902 having a top surface 2904, bottom surface 2906, and a first width 2908. The method 3000 then prints 3004 a first conductive layer 2914 on the top surface 2904 of the first dielectric layer 2902. The first conductive layer 2914 includes a first portion 2918 and a second portion 2916. In this example, printing 3004 the first portion 2918 of the first conductive layer 2914 produces a PAE (e.g., second PAE 200) with an antenna slot (e.g., second antenna slot 410) and printing 3004 the second portion 2916 of the first conductive layer 2914 produces a bottom conductor (e.g., bottom conductor 400). The method 3000 then prints 3006 a second dielectric layer 2928 on the bottom surface 2906 of the first dielectric layer 2902, where the second dielectric layer 2928 includes a top surface 2930, and prints 3008 a second conductive layer 2934 on a portion of the top surface 2930 of the second dielectric layer 2928, where the second conductive layer 2934 has a top surface 2936. The method 3000 then prints 3010 a third dielectric layer 2950 on the top surface 2930 of the second dielectric layer 2928 and the top surface 2936 of the second conductive layer 2934, where the third dielectric layer 2950 has a top surface 2952, and prints 3012 a third conductive layer 2956 on a portion of the top surface 2952 of the third dielectric layer 2950, where the third conductive layer 2956 has a top surface 2958. The method 3000 then prints 3014 a fourth dielectric layer 2966 on the top surface 2952 of the third dielectric layer 2950 and the top surface 2958 of the third conductive layer 2956, where the fourth dielectric layer 2966 has a top surface 2968, and prints 3016 a fourth conductive layer 2972 on the top surface 2968 of the fourth dielectric layer 2966. The fourth conductive layer 2972 includes a first portion 2974 and a second portion 2976. In this example, printing 3016 the first portion 2974 of the fourth conductive layer 2972 produces a PAE (e.g., first PAE 104) with an antenna slot (e.g., first antenna slot 108), and printing 3016 the second portion 2976 of the fourth conductive layer 2972 produces a top conductor (e.g., top conductor 106). The method 3000 then includes producing 3018 at least one conductive via 2982 between the second portion 2976 of the fourth conductive layer 2972 and the second portion 2916 of the first conductive layer 2914 and attaches 3020 a waveguide 2986 to the top surface 2904 of a first dielectric layer 2902, where the second PAE (e.g., second PAE 200) is located within a cavity (e.g., waveguide cavity 408) of the waveguide 2986. The method 3000 then ends.

As an example, the method 3000 may further include printing another dielectric layer between the first dielectric layer 2902 and second dielectric layer 2928, where the additional dielectric layer includes a bottom surface, and printing another conductive layer on the bottom surface of the additional dielectric layer to produce a CE (e.g., CE 1000) above the first portion 2918 of the first conductive layer 2914.

It will be understood that various aspects or details of the invention may be changed without departing from the scope of the invention. It is not exhaustive and does not limit the claimed inventions to the precise form disclosed. Furthermore, the foregoing description is for the purpose of illustration only, and not for the purpose of limitation. Modifications and variations are possible in light of the above description or may be acquired from practicing the invention. The claims and their equivalents define the scope of the invention.

In some alternative examples of implementations, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

The description of the different examples of implementations has been presented for purposes of illustration and description, and is not intended to be exhaustive or limited to the examples in the form disclosed. Many modifications and variations will be apparent to those of ordinary skill in the art. Further, different examples of implementations may provide different features as compared to other desirable examples. The example, or examples, selected are chosen and described in order to best explain the principles of the examples, the practical application, and to enable others of ordinary skill in the art to understand the disclosure for various examples with various modifications as are suited to the particular use contemplated.

What is claimed is:

1. A waveguide-fed planar antenna array, comprising:

a plurality of dielectric layers forming a dielectric structure, wherein a top dielectric layer from of the plurality of dielectric layers includes a top surface, and wherein a bottom dielectric layer from the plurality of dielectric layers includes a bottom surface;

an inner conductor formed within the dielectric structure;

a first patch antenna element formed on the top surface;

a second patch antenna element formed on the bottom surface;

a bottom conductor formed on the bottom surface;

a top conductor formed on the top surface;

a conductive via electrically shorting the bottom conductor and the top conductor;

a first antenna slot within the first patch antenna element;

a second antenna slot within the second patch antenna element; and a waveguide having at least one waveguide wall and a waveguide backend, wherein the waveguide backend has a waveguide backend surface that is a portion of the bottom surface of the bottom dielectric layer, wherein the waveguide backend surface and the at least one waveguide wall form a waveguide cavity within the waveguide, wherein the second patch antenna element is located within the waveguide cavity at the waveguide backend surface, wherein the first patch antenna element and the second patch antenna element conductors, and wherein the waveguide is configured to support a transverse electromagnetic signal during use.

2. The waveguide-fed planar antenna array of claim 1, wherein the first antenna slot is angled along the first patch antenna element with respect to the inner conductor and wherein the second antenna slot is angled along the second patch antenna element with respect to the inner conductor.

3. The waveguide-fed planar antenna array of claim 1, wherein each dielectric layer from the plurality of dielectric layers includes a dielectric laminate material and wherein the inner conductor is a stripline or micro strip conductor.

4. The waveguide-fed planar antenna array of claim 1, wherein the dielectric structure comprises a stack-up height and a dielectric structure width, wherein the inner conductor is located in a middle dielectric layer within the dielectric structure that is approximately at a center position that is equal to approximately half of the stack-up height, and wherein the inner conductor has an inner conductor center that is located within the dielectric structure that is approximately at a second center position that is equal to approximately half of the dielectric structure width.

5. The waveguide-fed planar antenna array of claim 1, further comprises a first cavity formed within the dielectric structure above the bottom conductor and below the first patch antenna element.

6. The waveguide-fed planar antenna array of claim 5, wherein the first cavity is filled with air and wherein the inner conductor includes a portion located within the first cavity.

7. The waveguide-fed planar antenna array of claim 6, further comprising a first coupling element formed within the dielectric structure above the inner conductor and the first cavity, and below the first patch antenna element.

8. The waveguide-fed planar antenna array of claim 7, further comprising a second cavity formed within the dielectric structure below the top conductor and above the second patch antenna element.

9. The waveguide-fed planar antenna array of claim 1, further comprising a first coupling element formed within the dielectric structure above the inner conductor and below the first patch antenna element.

10. The waveguide-fed planar antenna array of claim 9, wherein the inner conductor has an inner conductor width and the first coupling element has a coupling element length and a coupling element width, wherein the first patch antenna element is circular and has a patch antenna element diameter, and wherein the coupling element length is less than the patch antenna element diameter.

11. The waveguide-fed planar antenna array of claim 10, wherein the first coupling element is a stub, wherein the coupling element length is orthogonal to an inner conductor length, and wherein the coupling element length and the coupling element width are predetermined to approximately optimize a radiated signal of the first patch antenna element at a predetermined operating frequency.

12. The waveguide-fed planar antenna array of claim 11, wherein the first patch antenna element is circular and has a radius, wherein the first antenna slot patch antenna element, a slot length and slot width, and wherein the radius of the first patch antenna element, the slot length, and the slot width are predetermined to approximately optimize the radiated signal of the first patch antenna element at the predetermined operating frequency.

13. The waveguide-fed planar antenna array of claim 1, further including a third patch antenna element on the top surface, a third antenna slot within the third patch antenna element.

14. The waveguide-fed planar antenna array of claim 1, wherein the inner conductor is a first inner conductor, and further comprising:

a second inner conductor;

a power divider in signal communication to an input port, the first inner conductor, and the second inner conductor;

a third patch antenna element formed on the top surface; and a third antenna slot within the third patch antenna element, wherein the first patch antenna element with the first antenna slot is located on the top surface above the first inner conductor, and wherein the third patch antenna element is located on the top surface above the second inner conductor.

15. A method for fabricating a waveguide-fed planar antenna array utilizing a lamination process, the method comprising: patterning a first conductive layer on a bottom surface of a first dielectric layer, wherein the first conductive layer includes a first portion and a second portion, wherein patterning the first portion of the first conductive layer produces a first patch antenna element with a first antenna slot, wherein patterning the second portion of the first conductive layer produces a bottom conductor, and wherein the first dielectric layer includes a top surface; patterning a second conductive layer on a portion of a top surface of a second dielectric layer to produce an inner conductor, wherein the second dielectric layer includes a bottom surface and the second conductive layer includes a top surface; laminating the bottom surface of the second dielectric layer to the top surface of the first dielectric layer; patterning a third conductive layer on a top surface of a third dielectric layer to produce a coupling element, wherein the third dielectric layer includes a bottom surface; patterning a fourth conductive layer on a top surface of a fourth dielectric layer, wherein the fourth conductive layer includes a first portion and a second portion, wherein patterning the first portion of the fourth conductive layer produces a second patch antenna element with a second antenna slot, and wherein patterning the second portion of the first conductive layer produces a top conductor; laminating a bottom surface of the fourth dielectric layer to the top surface of the third conductive layer and the top surface of the third dielectric layer; laminating a bottom surface of the third dielectric layer to the top surface of the second conductive layer and the top surface of the second dielectric layer; producing at least one conductive via between the second portion of the fourth conductive layer and the second portion of the first conductive layer; and attaching a waveguide to the bottom surface of a first dielectric layer, wherein the second patch antenna element is located within a cavity of the waveguide.

16. The method of claim 15, further comprising patterning another conductive layer on the bottom surface of the second dielectric layer to produce a second coupling element.

17. The method of claim 16, wherein the third dielectric layer includes sub-sections of the third dielectric layer to produce at least one cavity.

18. The method of claim 15, wherein at least one of the first conductive layer, second conductive layer, third conductive layer, and fourth conductive layer is formed by a subtractive method of electroplated or rolled metals or is formed by an additive method of printed inks or deposited thin-films, and wherein the subtractive method includes wet etching, milling, or laser ablation.

19. A method for fabricating a waveguide-fed planar antenna array utilizing a three-dimensional additive printing process, the method comprising:

printing a first dielectric layer having a top surface, bottom surface, and a first width;

printing a first conductive layer on the bottom surface of the first dielectric layer, wherein the first conductive layer includes a first portion and a second portion, wherein printing the first portion of the first conductive layer produces a first patch antenna element with an antenna slot, and wherein printing the second portion of the first conductive layer produces a bottom conductor;

printing a second dielectric layer on the top surface of the first dielectric layer, wherein the second dielectric layer includes a top surface;

printing a second conductive layer on a portion of the top surface of the second dielectric layer, wherein the second conductive layer has a top surface;

printing a third dielectric layer on the top surface of the second dielectric layer and the top surface of the second conductive layer, wherein the third dielectric layer has a top surface;

printing a third conductive layer on a portion of the top surface of the third dielectric layer, wherein the third conductive layer has a top surface;

printing a fourth dielectric layer on the top surface of the third dielectric layer and the top surface of the third conductive layer, wherein the fourth dielectric layer has a top surface;

printing a fourth conductive layer on the top surface of the fourth dielectric layer, wherein the fourth conductive layer includes a first portion and a second portion, wherein printing the first portion of the fourth conductive layer produces a second patch antenna element with a second antenna slot, and wherein printing the second portion of the fourth conductive layer produces a top conductor;

producing at least one conductive via between the second portion of the fourth conductive layer and the second portion of the first conductive layer; and attaching a waveguide to the bottom surface of a first dielectric layer, wherein the first patch antenna element is located within a cavity of the waveguide.

20. The method of claim 19, further comprising:

printing an additional dielectric layer between the first dielectric layer and second dielectric layer, wherein the additional dielectric layer includes a bottom surface; and printing an additional conductive layer on the bottom surface of the additional dielectric layer to produce a second coupling element above the first portion of the first conductive layer.

* * * * *